US007988513B2

(12) United States Patent
Nukanobu et al.

(10) Patent No.: US 7,988,513 B2
(45) Date of Patent: Aug. 2, 2011

(54) ELECTRON-EMITTING DEVICE, ELECTRON SOURCE AND DISPLAY APPARATUS USING THE SAME DEVICE, AND MANUFACTURING METHODS OF THEM

(75) Inventors: Koki Nukanobu, Kanagawa-Ken (JP); Takahiro Sato, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/693,057

(22) Filed: Jan. 25, 2010

(65) Prior Publication Data

US 2010/0120319 A1 May 13, 2010

Related U.S. Application Data

(62) Division of application No. 11/478,576, filed on Jul. 3, 2006, now Pat. No. 7,679,278.

(30) Foreign Application Priority Data

Jul. 25, 2005 (JP) ..... 2005-214528

(51) Int. Cl.
*H01J 9/00* (2006.01)

(52) U.S. Cl. ..... 445/23; 445/49

(58) Field of Classification Search ..... 445/23–25, 445/49–51

See application file for complete search history.

(56) References Cited

U.S. PATENT DOCUMENTS

| | | | | |
|---|---|---|---|---|
| 4,917,466 | A | 4/1990 | Nakamura et al. | 350/336 |
| 5,847,495 | A | 12/1998 | Yamanobe et al. | 313/310 |
| 6,384,542 | B2 | 5/2002 | Tsukamoto | 315/169.3 |
| 6,642,649 | B1 | 11/2003 | Yamamoto et al. | 313/495 |
| 6,835,110 | B2 | 12/2004 | Mizuno et al. | 445/6 |
| 6,896,571 | B2 | 5/2005 | Mizuno et al. | 445/24 |
| 6,900,581 | B2 | 5/2005 | Kyogaku et al. | 313/310 |
| 7,067,336 | B1 | 6/2006 | Kyogaku et al. | 438/20 |
| 7,077,716 | B2 | 7/2006 | Mizuno et al. | 445/24 |
| 2001/0019247 | A1 | 9/2001 | Tsukamoto | 315/169.3 |
| 2001/0054865 | A1 | 12/2001 | Danjo et al. | 313/495 |
| 2002/0008454 | A1 | 1/2002 | Ishiwata et al. | 313/310 |
| 2002/0084736 | A1 | 7/2002 | Shibata | 313/310 |
| 2002/0096986 | A1 | 7/2002 | Motoi et al. | 313/310 |
| 2002/0132041 | A1 | 9/2002 | Yamanobe et al. | 427/77 |

(Continued)

FOREIGN PATENT DOCUMENTS

EP 0 803 890 A1 10/1997

(Continued)

OTHER PUBLICATIONS

Japanese Office Action dated Oct. 12, 2010 issued in the counterpart application No. 2005-214528 along with English-language translation—7 pages.

(Continued)

*Primary Examiner* — Joseph L Williams

(74) *Attorney, Agent, or Firm* — Fitzpatrick, Cella, Harper & Scinto

(57) ABSTRACT

An electron-emitting device having little dispersion of its electron emission characteristic and a suppressed "fluctuation" of its electron emission quantity is provided. The electron-emitting device includes a substrate equipped with a first portion containing silicon oxide and a second portion arranged abreast of the first portion and having a higher heat conductance, and an electroconductive film including a gap therein, the electroconductive film arranged on the substrate, wherein the first and the second portions having a resistance higher than that of the electroconductive film, and the gap is arranged on the first portion.

8 Claims, 27 Drawing Sheets

U.S. PATENT DOCUMENTS

| | | | | |
|---|---|---|---|---|
| 2003/0161942 | A1 | 8/2003 | Arai et al. | 427/77 |
| 2005/0227062 | A1 | 10/2005 | Sato et al. | 428/323 |
| 2005/0258734 | A1 | 11/2005 | Nukanobu et al. | 313/495 |
| 2005/0282458 | A1 | 12/2005 | Takeda et al. | 445/46 |

FOREIGN PATENT DOCUMENTS

| | | | |
|---|---|---|---|
| EP | 1 003 197 | A2 | 5/2000 |
| EP | 1 032 020 | A2 | 8/2000 |
| JP | 1-132138 | | 5/1989 |
| JP | 01-279538 | | 11/1989 |
| JP | 1-279557 | | 11/1989 |
| JP | 2-247940 | | 10/1990 |
| JP | 03-261026 | | 11/1991 |
| JP | 04-094032 | | 3/1992 |
| JP | 7-201274 | | 8/1995 |
| JP | 8-96699 | | 4/1996 |
| JP | 09-293448 | | 11/1997 |
| JP | 10-055753 | | 2/1998 |
| JP | 2000-082381 | | 3/2000 |

OTHER PUBLICATIONS

Chinese Notification of the First Office Action dated Apr. 3, 2009, regarding Application No. 200610107472.2 (English translation attached).

European Search Report dated Jun. 5, 2009, regarding Application No. 06116583.3-2208/1753006.

ELECTRON-EMITTING DEVICE, ELECTRON SOURCE AND DISPLAY APPARATUS USING THE SAME DEVICE, AND MANUFACTURING METHODS OF THEM

This application is a division of U.S. application Ser. No. 11/478,576, filed Jul. 3, 2006, now U.S. Pat. No. 7,679,278, issued Mar. 16, 2010.

BACKGROUND OF THE INVENTION

1. Field of the Invention

The present invention relates to an electron-emitting device, an electron source using the device, and an image display apparatus. Moreover, the present invention relates to an information display apparatus such as a television, which receives a broadcast signal such as television broadcasting and performs the display and the reproduction of image information, character information and audio information, which are included in the broadcast signal.

2. Description of Related Art

The producing process of a conventional surface conduction electron-emitting device is schematically shown using FIGS. 24A to 24D. First, a pair of auxiliary electrodes 2 and 3 is formed on a substantially insulative substrate 1 (FIG. 24A). Next, the pair of auxiliary electrodes 2 and 3 is connected with an electroconductive film 4 (FIG. 24B). Then, the processing called as "energization forming", which forms a first gap 7 at a part of the electroconductive film 4 by applying an voltage between the pair of auxiliary electrodes 2 and 3, is performed (FIG. 24C). The "energization forming" processing is a process of flowing a current in the electroconductive film 4 to form the first gap 7 at a part of the electroconductive film 4 with the Joule heat generated by the current. A pair of electrodes 4*a* and 4*b* opposed to each other with the first gap 7 put between them is formed by the "energization forming" processing. Then, the processing called as "activation" is preferably performed. The "activation" processing schematically includes the process of applying a voltage between the pair of auxiliary electrodes 2 and 3 in a carbon containing gas atmosphere. By the processing, carbon films 21*a* and 21*b*, which are electroconductive films, are formed on the substrate 1 in the first gap 7 and on the electrodes 4*a* and 4*b* in the vicinity of the first gap 7 (FIG. 24D). An electron-emitting device is formed by the above process.

FIG. 8A is a plan view schematically showing the electron-emitting device after performing the "activation" processing. FIG. 8B is a schematic sectional view along a line B-B' of FIG. 8A, and is fundamentally the same as FIG. 24D. In FIGS. 24A to 24D, the members denoted by the same reference numerals as those in FIGS. 8A and 8B denote the same members as those in FIGS. 8A and 8B. When the electron-emitting device is made to emit electrons, the potential applied to one of the auxiliary electrode 2 and 3 is made to be higher than the potential applied to the other one. By applying voltages to the auxiliary electrodes 2 and 3 in this manner, a strong electric field is generated at a second gap 8. As a result, it is considered that electrons are emitted from many positions (a plurality of electron-emitting regions) of the portions constituting the outer edge of the second gap which portions are edge ends of the carbon film 21*a* or 21*b* connected to the auxiliary electrode 2 or 3 on the lower potential side.

Japanese Patent Application Laid-Open No. H07-201274, Japanese Patent Application Laid-Open No. H04-132138, Japanese Patent Application Laid-Open No. H01-279557, Japanese Patent Application Laid-Open No. H02-247940 and Japanese Patent Application Laid-Open No. H08-96699 disclose techniques controlling the positions of the gaps by controlling the shapes of the auxiliary electrodes 2 and 3 and the electroconductive film 4, and the like.

An image display apparatus can be configured by opposing a substrate equipped with an electron source composed of an arranged plurality of such electron-emitting devices therein and a substrate equipped with a light-emitting film made of a phosphor or the like, and by maintaining the space between the substrates in vacuum.

SUMMARY OF THE INVENTION

It is required for a recent image display apparatus to be able to display a brighter display image highly uniformly and stably over a long period. Consequently, in the image display apparatus equipped with the electron source including an arranged plurality of electron-emitting devices therein, it is required for each of the electron-emitting devices to stably maintain an excellent electron emission characteristic for a long period. Moreover, at the same time, it is also required that the dispersion of the electron emission quantity Ie from each of the electron-emitting device is small.

In the "energization forming" processing, the position where the first gap 7 is formed has a strong tendency to change even by a small contributing factor. That is, the position and the shape of the first gap 7 are determined by which part the Joule heat generated during the "energization forming" processing concentrates in.

If the electroconductive film 4 is uniform in quality and in shape and the auxiliary electrodes 2 and 3 are symmetry to each other, then the Joule heat generated in the electroconductive film 4 must be uniform. Consequently, it can be considered that the position at which the Joule heat concentrates most is exactly the middle of the auxiliary electrodes 2 and 3 if the heat conduction to the circumference (for example, to the auxiliary electrodes 2 and 3) is taken into consideration.

However, a film thickness variation of the electroconductive film 4, a shape error of the auxiliary electrodes 2 and 3, and the like arise actually. Consequently, in almost all cases, as shown in FIG. 8A, the gaps (the first gap 7 and the second gap 8) large meander in the region between the auxiliary electrodes 2 and 3.

In addition, because FIG. 8A is a schematic view after the performance of the "activation" processing, the shape of the first gap 7 is not drawn. But, the shape of the first gap 7 is almost the same meandering shape as that of the second gap 8. In addition, the width of the first gap 7 is wider than that of the second gap 8.

Consequently, the shapes of the gaps (the first gap 7 and the second gap 8) of each electron-emitting device differ from one another. As a result, the dispersion (variation) of the electron emission characteristic is caused.

Moreover, as described above, it is widely considered that field emissions are occurred at (electrons are tunneled (emitted) from) many positions constituting the outer edge of the gap 8, which is a part of the edge end of one carbon film 21*a* or 21*b*. For example, when the potential of the first auxiliary electrode 2 is made higher than that of the second auxiliary electrode 3 and the electron-emitting device is driven, the second carbon film 21*b* connected to the second auxiliary electrode 3 through the second electrode 4*b* can be considered as an emitter. As a result, many electron-emitting points (regions) exist at the portions constituting the outer edge of the second gap 8, which is the edge end of the second carbon film 21*b*. That is, it is widely considered that many electron-emitting points are located in a line on the edge end of the carbon film 21*a* or 21*b* connected to the auxiliary electrode 3 or 2 on which the low potential is applied along the second gap 8.

Consequently, as shown in FIG. 8A or the like, when the gaps (the second gap 8 and the first gap 7) meander, dispersion arises in the effective resistance values from an auxiliary electrode to each electron-emitting point. As a result, in such an electron-emitting device, "fluctuation" of electron emission quantity (phenomenon in which a change of electron emission current arises in a short time) arises in almost all cases.

Moreover, the meandering of the gaps (the second gap 8 and the first gap 7) can be reduced using the techniques disclosed in Japanese Patent Application Laid-Open No. H07-201274, Japanese Patent Application Laid-Open No. H04-132138, Japanese Patent Application Laid-Open No. H01-279557, Japanese Patent Application Laid-Open No. H02-247940 and Japanese Patent Application Laid-Open No. H08-96699 shown as the prior art. However, although the "fluctuation" caused by the meandering of the gaps as the primary cause can be decreased, it has been found that only removing the cause of the meandering is not sufficient to decrease the "fluctuation" of the electron emission quantity.

Consequently, in the electron source including many arranged electron-emitting devices mentioned above, the variation of electron emission characteristics and changes of the electron emission quantities which are expected to originate in the meandering of the gaps 7 and 8 and the "fluctuation" of the electron emission quantities have arisen. Moreover, in the image display apparatus using the electron-emitting device, there has been a case where luminance variation (dispersion) and luminance changes which are expected to originate in the meandering of the gaps and the "fluctuation" of the electron emission quantities. Consequently, it has been difficult to obtain a highly accurate and good display image.

Accordingly, in view of the problem mentioned above, it is an object of the present invention to provide an electron-emitting device which has little dispersion in its electron emission characteristic and suppressed "fluctuation" of its electron emission quantity.

Moreover, at the same time, it is another object of the present invention to provide a simple, excellently controllable manufacturing method of an electron-emitting device having little dispersion in its electron emission characteristic and little "fluctuation" of its electron emission quantity.

Moreover, it is further object of the present invention to provide an electron source having little dispersion in its electron emission characteristic and a stable electron emission characteristic, and a manufacturing method of the electron source. And, at the same time, it is still further object of the present invention to provide an image display apparatus having little dispersion and changes of its luminance, and a manufacturing method of the image display apparatus.

Accordingly, the present invention settles the problem, and is an electron-emitting device including a substrate, and an electroconductive film arranged on the substrate and including a gap therein, wherein the substrate includes at least a first portion containing silicon oxide, and second portions which are arranged abreast of the first portion and severally have a heat conductance higher than that of the first portion, wherein the first and the second portions severally have a higher resistance than that of the electroconductive film, wherein the electroconductive film is arranged on the first and the second portions, wherein the gap is arranged on the first portion.

Further the present invention is also characterized by: "the second portions are arranged abreast of both the sides of the first portion to sandwich the first portion between the second portions"; "the heat conductance of each of the second portions is at least four times as large as that of the first portion"; "the resistivity of the material constituting each of the first and the second portions is $10^8\Omega$ or more"; "the sheet resistance of the electroconductive film is within a range of $10^2$ $\Omega/\square$ to $10^7$ $\Omega/\square$"; and "the first portion contains silicon oxide as a main ingredient."

Moreover, the present invention is an electron-emitting device including: a pair of electrodes arranged on a substrate; and an electroconductive film which is connected to the pair of electrodes and includes a gap therein, wherein a layer having a higher resistance than that of the electroconductive film, wherein the layer has an aperture to expose the gap, wherein a heat conductance of the substrate at a part located below the aperture is lower than that of the layer.

The present invention is also characterized by an electron source equipped with a plurality of the electron-emitting devices of the present invention, and an image display apparatus including the electron source and a light-emitting member.

The present invention is also characterized by an information display apparatus equipped with at least a receiver outputting at least one of image information, character information and audio information which are included in a received broadcast signal, and the image display apparatus connected to the receiver.

Moreover, the present invention is a manufacturing method of an electron-emitting device having an electroconductive film including a gap at a part thereof, the method including: a first step of preparing a substrate including at least a first portion and second portions which are arranged abreast of the first portion and severally have a heat conductance higher than that of the first portion, wherein the first and the second portions are covered with the electroconductive film having a lower resistance than those of the first and the second portions; a second step of forming a gap at a part of the electroconductive film on the first portion by flowing a current in the electroconductive film.

Further, the present invention is also characterized by: "the heat conductance of each of the second portions is at least four times as large as that of the first portion"; "the resistivity of the material constituting each of the first and the second portions is $10^8\Omega$ or more"; "the sheet resistance of the electroconductive film is within a range of $10^2$ $\Omega/\square$ to $10^7$ $\Omega/\square$"; and "the first portion contains silicon oxide as a main ingredient."

Moreover, the present invention is a manufacturing method of an electron-emitting device equipped with a pair of electrodes arranged on a substrate, an electroconductive film which is connected to the pair of electrodes and includes a gap at a part thereof, the method including: a step of preparing the substrate equipped with (A) the pair of electrodes, (B) the electroconductive film connecting both the pair of electrodes, (C) a layer having an aperture located between the pair of electrodes to expose a part of the electroconductive film, the layer arranged on the electroconductive film and having a resistance higher than that of the electroconductive film; and a step of forming a gap in the aperture in a part of the electroconductive film by flowing a current in the electroconductive film through the pair of electrodes, wherein a heat conductance of a part of the substrate located at least below the aperture is lower than that of the layer.

The present invention is also characterized by a manufacturing method of an electron source manufactured by using the manufacturing method of a plurality of electron-emitting devices of the present invention, and a manufacturing method of an image display apparatus manufactured by using the manufacturing method of the electron source, the image display apparatus including a light-emitting member.

In another aspect, an electron emitting device according to the present invention comprises an insulating substrate; first and second electrodes disposed on the substrate to be opposite each other with a space; a conductive film extending on the substrate between the first and second electrodes, one end of the conductive film connecting to the first electrode, the other end thereof connecting to the second electrode and the conductive film including a gap therein at a position between the first and the second electrodes; and an anode arranged above the gap, electrons emitted when applying a voltage between the first and second electrodes being directed to the anode, Wherein the insulating substrate includes a first portion of a first insulating material underneath the gap of the conductive film and a second portion of a second insulating material adjacent to the first portion and between the first and second electrodes, and The thermal expansion rate of one first insulating material is less than that of the second insulating material and the heat conductance of the second insulating material is larger than that of the first insulating material.

In the embodiment, the heat conductance of the second insulating material is at least four times as large as of the first insulating material.

In the embodiment, the width of the first portion in a spacing direction of the gap of the conductive film is less than half the space between the first and second electrodes, preferably less than one tenth the space between the first and second electrode.

According to the present invention, an electron-emitting device which has little "fluctuation" and can maintain a good electron emission characteristic with little dispersion for a long time can be realized. Moreover, because the position and the shape of a gap (the first gap 7 and/or the second gap 8)), it is possible to provide an electron-emitting device and an electron source which have little dispersion of their electron emission characteristics. As a result, it is possible to provide an image display apparatus and an information display apparatus which can display a high quality display image being excellent in uniformity and having little luminance changes.

DETAILED DESCRIPTION OF THE PREFERRED EMBODIMENTS

Although electron-emitting devices and their manufacturing methods according to the present invention are described in the following, the materials and the values which are shown in the following are only examples. As long as modified examples of various materials and various values are within a scope capable of attaining the objects and advantages of the present invention, the modified examples can be adopted as the materials and values described above in order to be fitted to the application of the present invention.

First Embodiment

Figure 26A:
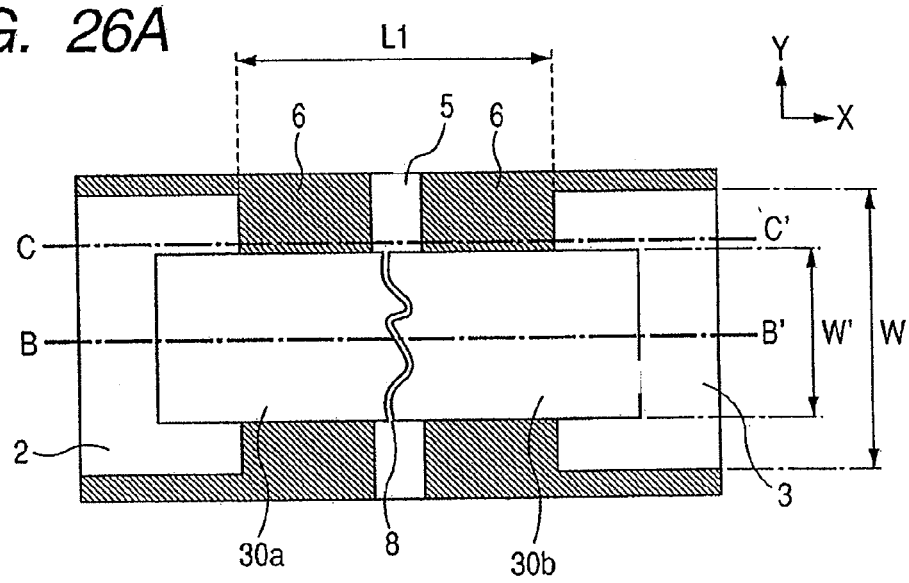
FIGS. 26A, 26B and 26C are schematic views showing the configuration of the electron-emitting device according to the present invention.
Figure 26B:
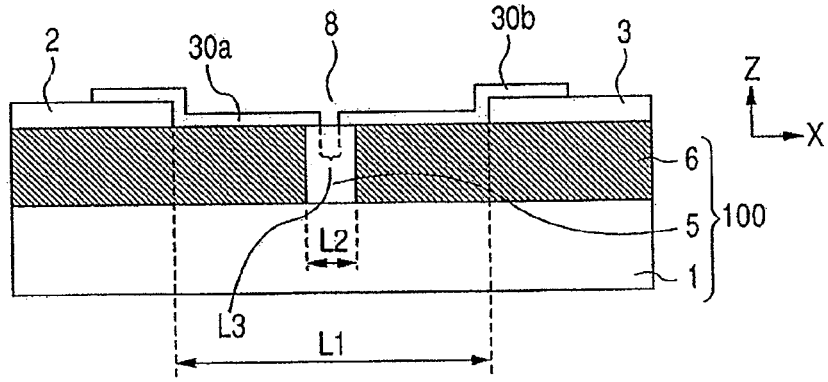
Figure 26C:
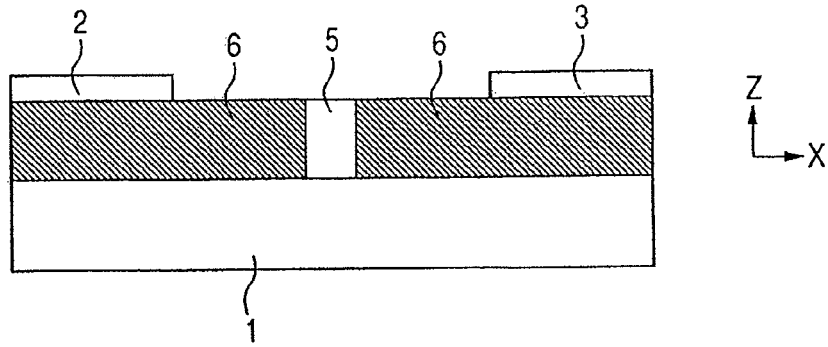

The basic configuration of a first embodiment which is the most typical example of the form of an electron-emitting device according to the present invention is first described using FIGS. 26A to 26C.

FIG. 26A is a schematic plan view showing the typical configuration of the present embodiment. FIGS. 26B and 26C are schematic sectional views taken along lines B-B' and C-C', respectively.

The example of the form shown in FIGS. 26A to 26C is an example in which a substrate 100 is substantially composed of an insulative substrate 1, a first portion 5 and second portions 6. Each of the second portions 6 has higher heat conductance (higher thermal conductivity) than that of the first portion 5. In the example of the form, the second portions 6 are separated to be arranged at two regions, and the second portions are arranged to put the first portion 5 between them. The first and second portions are juxtaposed to each other.

On the substrate 100, a first auxiliary electrode 2 and a second auxiliary electrode 3 are arranged to be separate from each other by an interval L1. A first electroconductive film 30*a* and a second electroconductive film 30*b* are connected to the first auxiliary electrode 2 and the second auxiliary electrode 3, respectively. The first electroconductive film 30*a* and the second electroconductive film 30*b* are opposed to each other with a gap 8 put between them. That is, the gap 8 is arranged between the first auxiliary electrode 2 and the second auxiliary electrode 3. And the gap 8 is arranged in the region just above the first portion 5. A width L3 of the second gap 8 is typically set to be within a range of from 1 nm to 10 nm, both inclusive, in order to make a drive voltage to be 30V or less in consideration of the cost of a driver and the like, and in order to suppress discharge caused by unexpected voltage changes at the time of a drive.

In addition, FIGS. 26A to 26C show the first electroconductive film 30*a* and the second electroconductive film 30*b* as two completely separated films. However, because the gap 8 has a very narrow width as mentioned above, the gap 8, the first electroconductive film 30*a* and the second electroconductive film 30*b* can be collectively expressed as "an electroconductive film including a gap therein."

Moreover, there are some cases where the first electroconductive film 30*a* and the second electroconductive film 30*b* are connected with each other in a very minute region. Because a very minute region has a high resistance, the influences of the region to the electron emission characteristic are restrictive, and consequently such a minute region can be permitted. Such a form in which the first electroconductive film 30*a* and the second electroconductive film 30*b* are connected to each other at a part can be also expressed as the "electroconductive film including a gap therein."

In addition, FIG. 26A shows the example in which the gap 8 meanders without any specific periodicity. However, the gap 8 is not necessarily needed to meander. The gap 8 may be a desired form such as a straight line, a line wound with periodicity, an arc, a combined form of an arc and a straight line.

Hereupon, the gap 8 is formed by the arrangement of the first and the second electroconductive films 30*a* and 30*b* so that their edge ends (outer edges) may be opposed to each other.

It is conceivable that many electron-emitting points (regions) exist at parts of edge end of one electroconductive film 30*a* or 30*b*, which are parts constituting an outer edge of the gap 8. For example, when the electron-emitting device is driven by applying the pieces of potential to the first and the second auxiliary electrodes 2 and 3 so that the potential of the first auxiliary electrode 2 may be higher than that of the second auxiliary electrode 3, the second electroconductive film 30*b* connected to the second auxiliary electrode 3 corresponds to an emitter. That is, many electron-emitting points (regions) exist at parts of the edge end of the second electroconductive film 30*b*, which are parts constituting the outer edge of the gap 8. On the contrary, when the electron-emitting device is driven by applying the pieces of potential to the first and the second auxiliary electrodes 2 and 3 so that the potential of the second auxiliary electrode 3 may be higher than that of the first auxiliary electrode 2, the first electroconductive film 30*a* connected to the first auxiliary electrode 2 corresponds to an electron-emitting film (an emitter). That is, many electron-emitting points (regions) exist at parts of the edge end of the first electroconductive film 30*a*, which are parts constituting the outer edge of the gap 8.

The gap 8 can be also formed by performing various nanoscale highly accurate processing methods using a focused ion beam (FIB) or the like to an electroconductive film. Consequently, the gap 8 of the electron-emitting device of the present invention is not limited to what is formed by the "activation" processing, which will be described later.

Figure 1A:
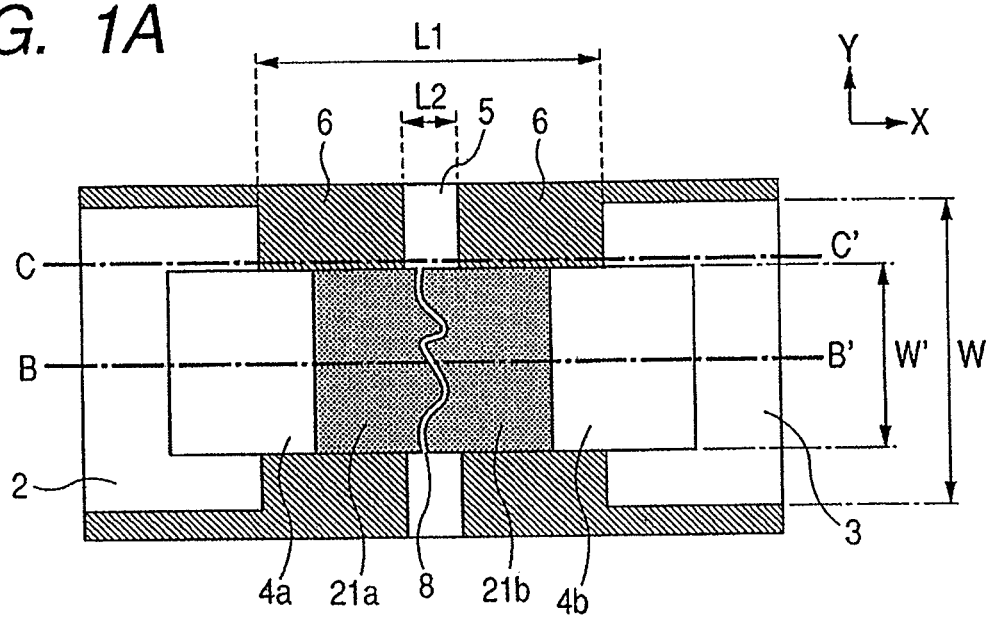
FIGS. 1A, 1B and 1C are a plane view and sectional views schematically showing a configuration example of an electron-emitting device of the present invention.
Figure 1B:
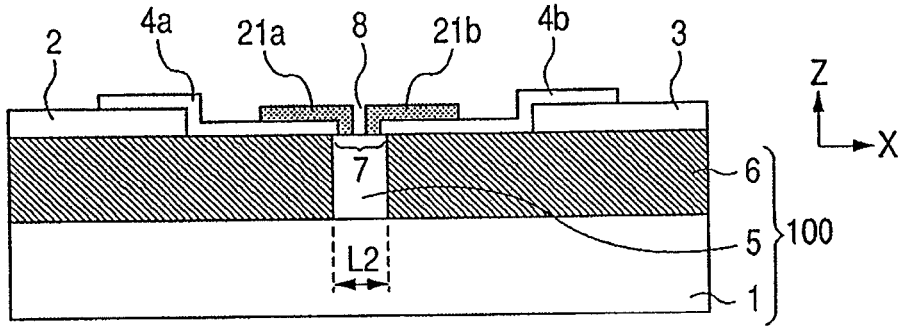
Figure 1C:
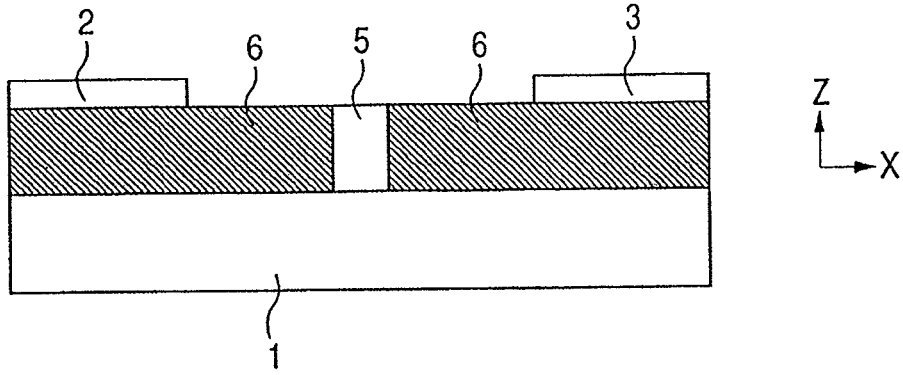

In addition, FIGS. 26A to 26C show the example of the substrate 100 made of the substrate 1, the first portion 5 and the second portion 6, the latter two separately formed on the surface of the substrate 1. However, the first portion 5 may be formed by a part of the substrate 1. Moreover, as shown in FIGS. 1A to 1C, the first portion 5 may be formed of another member stacked on the surface of the substrate 1. Similarly, the second portion 6 may be formed of a part of the substrates 1, or may be another member stacked on the surface of the substrate 1.

However, as mentioned above, it is necessary for the second portion 6 to have heat conductance (thermal conductivity) higher than that of the first portion 5. Moreover, a portion having heat conductance different from those of the first portion 5 and the second portion 6 may be arranged in a region on the substrate 1 where the auxiliary electrodes 2 and 3 and the electroconductive films 30*a* and 30*b* are not arranged. As such a region, for example, the region except the region under the first auxiliary electrode 2 and the second auxiliary electrode 3 and the region between the first auxiliary electrode 2 and the second auxiliary electrode 3 and the like can be cited.

By adopting such a configuration, the "fluctuation" of the electron emission quantity can be reduced. Although this reason is not certain, probably, the inventor considers that the reason is that the existence of the second portions 6 having high heat conductance on both the sides of the gap 8 will be able to suppress a temperature rise of the electroconductive films 30*a* and 30*b* at the time of a drive. The inventor considers that the reason is that the diffusion and deformations of the materials of the electroconductive films 30*a* and 30*b* under drive, or the diffusion of impurity ions existing in the substrate 100 will be suppressed by this configuration. That is, the inventor considers that the reason is that the dispersion of the current flowing from the auxiliary electrode 2 or 3 into each electron-emitting point (region) and the dispersion of an effective resistance from the auxiliary electrode 2 or 3 to each electron-emitting point (region) will be suppressed. Moreover, it is conceivable that, because the temperature rise in the vicinity of the gap 8 at the time of a drive is also suppressed, the heat deformation of the surface of the substrate 100 in the vicinity of the gap 8 is also suppressed, and that the shape change of the gap 8 can be also suppressed as the result. Consequently, the inventor considers that the voltage effectively applied to the gap 8 at the time of the drive will be stabled, and that the "fluctuation" of an emission current Ie (or luminance) will be suppressed.

In addition, the form in which at least the second portions 6 directly touch the electroconductive films 30*a* and 30*b* is shown hereupon. However, as long as it is within a scope in which the advantages of the present invention can be achieved, another layer may be arranged between the second portions 6 and the electroconductive films 30*a* and 30*b*. Moreover, as long as being within a scope in which the advantages of the present invention can be achieved, it is unnecessary that the second portions 6 are homogeneous over the whole area of the second portions 6. Similarly, as long as being within a scope in which the advantages of the present invention can be achieved, another layer may be arranged on the first portion 5, and it is unnecessary that the first portion 5 is homogeneous over the whole area of the first portion 5.

Moreover, the electroconductive films 30*a* and 30*b* shown here can be also composed of carbon films 21*a* and 21*b* and electrodes 4*a* and 4*b* as a second embodiment, which will be described later.

As the materials of the electroconductive films 30*a* and 30*b*, electroconductive materials such as metal and semiconductor can be used. For example, metal such as Pd, Ni, Cr, Au, Ag, Mo, W, Pt, Ti, Al, Cu and the like, their alloys, and carbon can be used. In particular, the electroconductive films 30*a* and 30*b* are preferably a carbon film because they can be formed by the "activation" processing, which will be described later. The carbon film in the present embodiment is made of materials and a composition which are the same as those of the carbon film of a second embodiment, which will be described later.

The electroconductive films 30*a* and 30*b* are preferably formed to have a sheet resistance (Rs) within a range of resistance values from $10^2$ Ω/□ to $10^7$ Ω/□, both inclusive. The film thickness showing the resistance value mentioned above is concretely preferably within a range of from 5 nm to 100 nm, both inclusive. In addition, the Rs is a value which appears when the resistance R of a film having a thickness t, a width w and a length l at the time of being measured in the lengthwise direction is set to R=Rs(l/w). When the resistivity is set to ρ, Rs=ρ/t. Moreover, the width W' of each of the electroconductive films 30*a* and 30*b* is preferably set to be smaller than the width W of each of the auxiliary electrodes 2 and 3 (see FIG. 26A). By setting the width W to be wider than the width W', the dispersion of the distance from each of the auxiliary electrodes 2 and 3 to each electron-emitting region can be reduced. Although there is no special restriction in the value of the width W', it is preferable the width W' is within a range of from 10 μm to 500 μm, both inclusive, as a practical range.

In addition, the main role of the first auxiliary electrode 2 and the second auxiliary electrode 3 is the role of terminals for applying a voltage to the electroconductive films 30*a* and 30*b*. Accordingly, if there is other means for applying a voltage to the gap 8, the auxiliary electrodes 2 and 3 can be omitted.

As the substrate 1, silica glass, soda lime glass, a glass substrate composed of a glass substrate and silicon oxide (typically $SiO_2$) stacked on the glass substrate, or a glass substrate containing decreased alkaline components can be used.

The first portion 5 and the second portions 6 are preferable made of insulating materials. The reason is that, if the first portion 5 is a substantial conductive material, it becomes impossible to generate a strong electric field at the gap 8, and that no electrons are emitted in the worst case. Moreover, if the second portions 6 have high electrical conductivity, there is the possibility that a current having a magnitude sufficient for destroying the electron-emitting points (regions) when an electric discharge occurs at the time of the "activation" processing or a drive.

Consequently, it is important for the first portion 5 to be a substantially insulating material. And it is important for the second portions 6 to have electrical conductivity lower than those of the electroconductive films 30*a* and 30*b* (typically to have a high sheet resistance value or a high resistance value). The resistivity of the material constituting the first portion 5 is, in practice, preferably the same as or larger than the resistivity ($10^8$ Ωm or more) of the materials constituting the second portions 6. In other words, the resistance value (or a sheet resistance value) of the first portion 5 is preferably the same as or larger than the resistance value (or the sheet resistance Value) of the second portions 6.

Accordingly, if the thickness, which will be described later, is considered, then the sheet resistance values of the first portion 5 and the second portions 6 are concretely preferably $10^{13}$ Ω/□ or more. In order to realize such a sheet resistance value, the first portion 5 and the second portions 6 practical preferably have a resistivity equal to $10^8$ Ωm or more.

As the material of the second portions 6, a material having heat conductance (thermal conductivity) higher than those of the substrate 1 and the first portion 5 is selected. Specifically, silicon nitride, alumina, aluminum nitride, tantalum pentoxide and titanium oxide can be used.

Moreover, although the thicknesses (thicknesses in the Z direction in FIGS. 26A to 26C) of the second portions 6 also depend on material, they are preferable effectively 10 nm or more, more preferably 100 nm or more, for the sake of the advantages of the present invention. Moreover, although there is no upper limit value of the thickness from the viewpoint of the advantages, it is effectively preferable to make the thickness be 10 μm or less in view of the stability of the process, or thermal stress with the substrate 1.

The first portion 5 preferably contains silicon oxide (typically $SiO_2$) in order to realize a high electron emission characteristic (especially a high electron emission quantity) in the "activation" processing, which will be described later, and for the sake of the stability at the time of a drive. And, the first portion 5 especially preferably contains silicon oxide as a main ingredient. In case of containing the silicon oxide as the main, the percentage of the silicon oxide contained in the first portion 5 practically 80 wt % or more, preferably 90 wt % or more.

The practical range of the width of the gap 8 is 1 nm to 10 nm, as will be described later. Consequently, if a deformation (thermal expansion) of the first portion 5 arises at the time of a drive, the shape of the gap 8 is subjected to the influence, and changes of an emission current Ie and a device current If are induced. The silicon oxide (typically $SiO_2$) has a very small coefficient of linear thermal expansion. Consequently, even if the temperature of the vicinity of the gap 8 becomes high at the time of a drive, the changes of the emission current Ie and the device current If such as the "fluctuation", can be especially effectively suppressed. Moreover, in order to realize such an effect with sufficient reproducibility, it is preferable that the heat conductance of the second portions 6 is at least four times as large as the heat conductance of the first portion 5.

The interval L1 in the direction (X direction) in which the first auxiliary electrode 2 and the second auxiliary electrode 3 are opposed to each other, and each thickness are suitably designed according to the application form of an electron-emitting device and the like. For example, in the case where the electron-emitting device is used for an image display apparatus such as a television, which will be described later, the interval L1 and the film thicknesses are designed correspondingly to its resolution. Above all, because a high definition (HD) television is required to be highly accurate, it is necessary to make its pixel sizes small. Consequently, while the size of an electron-emitting device is limited, in order to obtain sufficient luminance, the electron-emitting device is designed so that a sufficient emission current Ie may be obtained.

The interval L1 of the first auxiliary electrode 2 and the second auxiliary electrode 3 in the X directions (the direction of being opposed to each other) is practically set to be within a range of from 5 μm to 100 μm, both inclusive. The reason why the interval L1 is 5 μm or more is that, when the interval L1 is less than 5 μm, there are some cases where the electron-emitting device is seriously damaged when undesired or unexpected discharges are generated at the time of the "activation" processing, which will be described later, or at the time of a drive. Moreover, the reason why the interval L1 is 100 μm or more is that, when the interval L1 is more than 100 μm, it becomes difficult to design such auxiliary electrodes 2 and 3 in case of being used for a high definition (HD) television. The film thicknesses of the auxiliary electrodes 2 and 3 are practically within a range of from 100 nm to 10 μm, both inclusive.

As the materials of the auxiliary electrodes 2 and 3, electroconductive materials such as metal and semiconductors can be used. For example, respectively, metals and alloys such as Ni, Cr, Au, Mo, W, Pt, Ti, Al, Cu, Pd and the like, and metals or metal oxides such as Pd, Ag, Au, $RuO_2$, Pd—Ag and the like can be used.

Because the electroconductive films 30*a* and 30*b* are thinner compared with the auxiliary electrodes 2 and 3, the auxiliary electrodes 2 and 3 severally have heat conductance sufficiently higher than those of the electroconductive films 30*a* and 30*b*.

A width L2 of the first portion 5 in the X direction is set to be sufficiently narrower than the interval L1. In order to efficiently reduce the "fluctuation" of the electron emission quantity, the width L2 is preferably a half or less of the interval L1, more preferably one-tenth or less of the interval L1.

The first portion 5 is located directly under the gap 8, and it is preferable that the value of the width L2 is close to the width (width L3 in the X directions of FIGS. 1A to 1C) of the gap 8 as much as possible. This is because it is preferable in order to achieve the advantages of the present invention mentioned above that the contact areas of the electroconductive films 30*a* and 30*b* with the second portions 6 located directly under them are made to be large as much as possible. However, there are many cases where the width L3 and meandering shape of the gap 8 cannot be uniformly formed like the case where the "activation" processing, which will be described later, is performed, although the situation also depends on the manufacturing method of the gap 8.

Accordingly, the value of the interval L2 is set to be larger than the width L3 of the gap 8. And the interval L2 is practically set to be 10 nm or more, preferably 20 nm or more, in consideration of the accuracy of patterning and the like.

Figure 27:
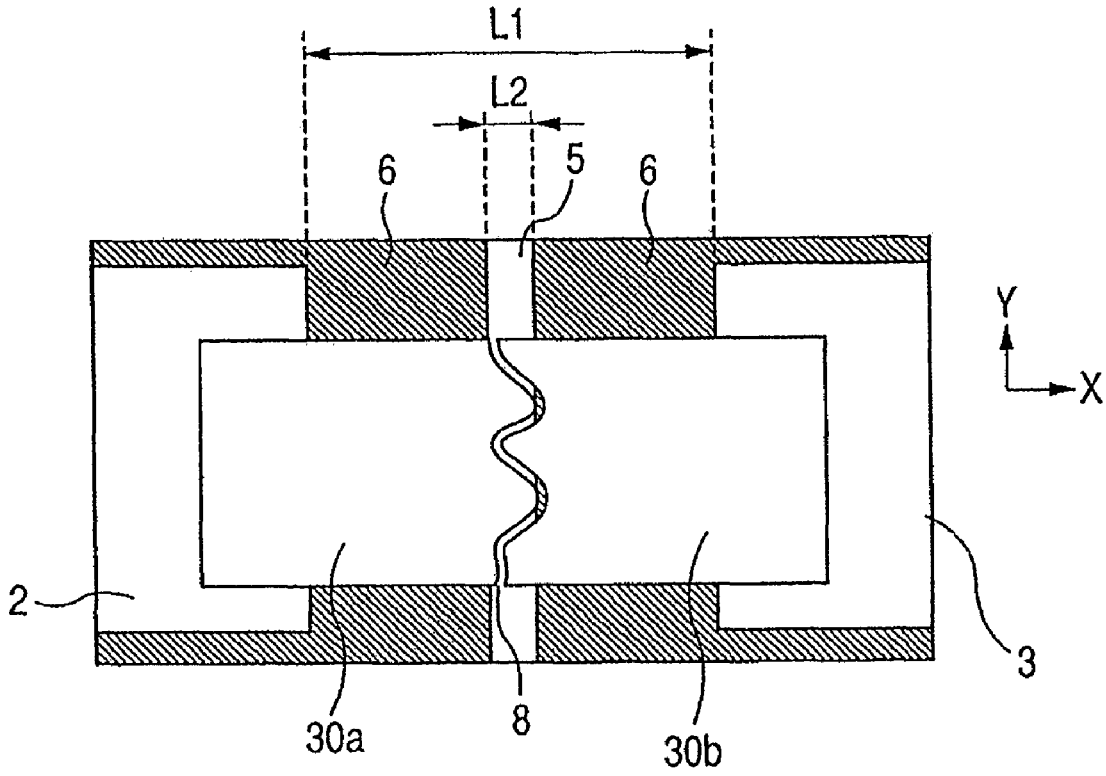
FIG. 27 is a schematic view showing a modified example of the electron-emitting device of the present invention.

At all event, in order to achieve the advantages mentioned above, it is necessary for at least a part of the gap 8 to be situated in the region immediately above the first portion 5. That is, it is necessary for the gap 8 that the gap 8 existing on at least a part of Z-X cross sections extending in the Y direction is located within the region immediately above the first portion 5. It is needless to say that it is preferable that the whole gap 8 on the X-Y plane is located within the region immediately above the first portion 5 as shown in FIGS. 26A to 26C. However, within the limit of achieving the advantages of the present invention, for example, as shown in FIG. 27, the form in which a part of the gap 8 on the X-Y plane protrudes from the inside of the region right above the first portion 5 is not be excepted.

Consequently, it is practically preferable that 80% or more of the gap 8 in the X-Y plane is situated right above the first portion 5. In addition, it is possible to replace the rate of 80% with 80% of the area of the gap 8 in the X-Y plane. Moreover, in other words, what is practically necessary is that 80% or more of the length of each of the portions constituting the gap 8 on the X-Y plane of the edge ends of the pair of the electroconductive films 30*a* and 30*b* is situated immediately above the first portion 5.

Moreover, the surface of the substrate 100 located in the gap 8 (the surface of the first portion 5) is preferably concave as the shape of the surface will be described later with regard to the "activation" processing. Because the creeping distance of the first electroconductive film 30*a* and the second electroconductive film 30*b* can be kept long in case of such a form, and creeping withstanding voltage can be improved, which is preferable.

In addition, if the first portion 5 is arranged directly under the gap 8, it is not needed that the first portion 5 is located in the center between the auxiliary electrodes 2 and 3. Moreover, although the example of forming the first portion 5 in a straight line in the Y direction is shown in the example shown in FIG. 26A, the first portion 5 may not be a straight line.

FIG. 26C shows the case where the first portion 5 is put between the second portions 6 even in the regions where the electroconductive films 30*a* and 30*b* are not arranged between the first auxiliary electrode 2 and the second auxiliary electrode 3. However, in the present invention, it is not limited to this form, and the first portion 5 may not exist in the regions where the electroconductive films 30*a* and 30*b* are not arranged between the first auxiliary electrode 2 and the second auxiliary electrode 3. That is, it is possible to adopt the form in which all of the regions of the surface of the substrate 100 between the first auxiliary electrode 2 and the second auxiliary electrode 3 where the electroconductive films 30*a* and 30*b* are not arranged are occupied by the second portions 6.

However, in any forms, the first portion 5 is arranged under the second gap 8. Consequently, a first gap 7 is also arranged on the first portion 5.

Moreover, various modified examples can be used for the electron-emitting device of the present invention.

Second Embodiment

The basic configuration of a second embodiment which is a modified example of the electron-emitting device of the present invention is described using FIGS. 1A to 1C.

FIG. 1A is a schematic plan view showing the typical configuration of the present embodiment. FIGS. 1B and 1C are schematic sectional views taken along a line B-B' and a line C-C' in FIG. 1A, respectively. In FIGS. 1A to 1C, the same reference numerals are given to the same members as those described in the first embodiment. The sizes of the interval L1, and the widths L2 and L3, the material and the size of each member, and the like in the example of the form are the same as those which have been already described with regard to the first embodiment.

The present embodiment is the same as the first embodiment except for replacing the electroconductive films (30*a* and 30*b*) in the first embodiment with carbon films (21*a* and 21*b*) and electrodes (4*a* and 4*b*). In addition, the carbon films (21*a* and 21*b*) have electrical conductivity.

In the present embodiment, the first auxiliary electrode 2 and the second auxiliary electrode 3 are arranged on the substrate 100. And the first electrode 4*a* is connected to the first auxiliary electrode 2, and the second electrode 4*b* is connected to the second auxiliary electrode 3. Furthermore, the first carbon film 21*a* is connected to the first electrode 4*a*, and the second carbon film 21*b* is connected to the second electrode 4*b*.

Moreover, the first electrode 4*a* and the second electrode 4*b* are opposed to each other with the first gap 7 put between them. And at least a part (preferably the whole) of the first gap 7 arranged right above the first portion 5.

Moreover, the first carbon film 21*a* and the second carbon film 21*b* are opposed to each other with the second gap 8 put between them. And the second gap 8 is arranged inside the first gap 7. That is, the width (the interval between the electrodes 4*a* and 4*b*) of the first gap 7 is larger than the width (the interval of the first carbon film 21*a* and the second carbon film 21*b*) of the second gap 8.

The second gap 8 of the present embodiment corresponds to the gap 8 of the first embodiment. Consequently, the second gap 8 is formed of the edge end (outer edge) of the first carbon film 21*a* and the edge end (outer edge) of the second carbon film 21*b* which are opposed to each other in the example of the form.

It is conceivable that many electron-emitting regions exist at parts of the edge end of one carbon film 21*a* or 21*b*, which constitutes an outer edge of the second gap 8. For example, when the electron-emitting device is driven under the setting of the potential of the first auxiliary electrode 2 to be higher than that of the second auxiliary electrode 3, the second carbon film 30*b* connected to the second auxiliary electrode 3 corresponds to an emitter. That is, many electron-emitting regions exist in the portions of the edge end of the second carbon film 30*b*, which is the portions constituting the outer edge of the second gap 8.

In the example of the form show in FIGS. 1A to 1C, the first electrode 4*a* and the first carbon film 21*a* constitute the first electroconductive film 30*a* in the first embodiment. And the second electrode 4*b* and the second carbon film 21*b* constitute the second electroconductive film 30*b*. By adopting such a form, it is possible to put the electroconductive films 30*a* and 30*b* into two functions: the carbon films 21*a* and 21*b* functioning as an electron-emitting film (emitter) and the electrodes 4*a* and 4*b* functioning as resistors. That is, by controlling the resistance values of the electrodes 4*a* and 4*b*, most of the effective resistance from the auxiliary electrodes 2 and 3 to the second gap 8 can be controlled. As a result, discharges between the first carbon film 21*a* and the second carbon film 21*b* can be suppressed, and further suppression of the "fluctuation" can be performed.

The width of the first gap 7 is typically set within a range of from 10 nm to 1 μm, both inclusive. Moreover, the second gap 8 is typically set within a range of from 1 nm to 10 nm, both inclusive, in order to make the drive voltage of the electron-emitting device be less than 40 V in consideration of the cost of the driver thereof, and in order to suppress unexpected or undesired discharges owing to voltage changes, which is not expected, at the time of a drive.

In addition, FIGS. 1A to 1C shows the first carbon film 21*a* and the second carbon film 21*b* as completely separated two films. However, because the second gap 8 has a very narrow width as mentioned above, the second gap 8, the first carbon film 21*a* and the second carbon film 21*b* can be collectively expressed as "an electroconductive film including a gap therein."

Moreover, the first carbon film 21*a* and the second carbon film 21*b* are sometimes connected to each other in a very minute region. Because the very minute region has a high resistance, the influence onto the electron emission characteristic of the electron-emitting device is restrictive, and consequently it is permissible. Such a form in which the first carbon film 21*a* and the second carbon film 21*b* are connected to each other at a part can be also expressed as "an electroconductive film including a gap therein."

In addition, FIG. 1A shows the example in which the second gap 8 meanders without any specific periodicity. However, in the present embodiment, the gap 8 does not necessarily need to meander. The gap 8 may be a desired form such as a straight line, a line wound with periodicity, an arc, a combined form of an arc and a straight line.

Hereupon, the gap 8 is formed by the opposed edge ends (outer edges) of the first carbon film 21*a* and the second carbon film 21*b*.

It is conceivable that many electron-emitting regions exist at parts of edge end of one carbon film 21*a* or 21*b*, which are parts constituting an outer edge of the gap 8. For example, when the electron-emitting device is driven by applying the pieces of potential to the first and the second auxiliary electrodes 2 and 3 so that the potential of the first auxiliary electrode 2 may be higher than that of the second auxiliary electrode 3, the second carbon film 21*b* connected to the second auxiliary electrode 3 corresponds to an emitter. That is, many electron-emitting regions exist at parts of the edge end of the second carbon film 21*b*, which are parts constituting the outer edge of the gap 8.

Although the whole of the second gap 8 is preferably situated immediately above the first portion 5 similarly to the first embodiment, it is practically preferable that 80% or more of the second gap 8 is situated right above the first portion 5.

The first gap 7 can be formed by performing various processing techniques such as electronic beam lithography and focused ion beam (FIB) to a electroconductive film. Consequently, the first gap 7 of the electron-emitting device of the present invention is not limited to what is formed by the "energization forming" processing, which will be described later. Moreover, similarly, the second gap 8 can be also formed by performing various nanoscale highly accurate processing methods using a focused ion beam (FIB) or the like to a carbon film. Consequently, the second gap 8 of the electron-emitting device of the present invention is not limited to what is formed by the "activation" processing, which will be described later.

By adopting such a configuration, the "fluctuation" of the electron emission quantity can be reduced similarly in the first embodiment. Although this reason is not certain, probably, the inventor considers that the reason is that the existence of the second portions 6 having high heat conductance on both the sides of the second gap 8 will be able to suppress a temperature rise of the electrodes 4*a* and 4*b* at the time of a drive. The inventor considers that the reason is that the diffusion and deformations of the materials of the electrodes 4*a* and 4*b* under drive, or the diffusion of impurity ions existing in the substrate 100 will be suppressed by this.

That is, the inventor considers that the reason is that the dispersion of the current flowing from the auxiliary electrode 2 or 3 into each electron-emitting region and the dispersion of an effective resistance value from the auxiliary electrode 2 or 3 to each electron-emitting region will be suppressed. As a result, the inventor considers that the voltage effectively applied to the second gap 8 at the time of the drive will be stabled, and that the "fluctuation" of an emission current Ie (or luminance) will be suppressed.

As the materials of the electrodes 4*a* and 4*b*, electroconductive materials such as metal and semiconductor can be used. For example, metal such as Pd, Ni, Cr, Au, Ag, Mo, W, Pt, Ti, Al, Cu and the like, their alloys, and the like can be used. When the resistance values of the electrodes 4*a* and 4*b* are made to be too large, a desired electron emission quantity cannot be acquired, and as a result, the "fluctuation" cannot be sometimes reduced. Accordingly, the electrodes 4*a* and 4*b* are preferably formed to have a sheet resistance (Rs) value within a range of from $10^2$ Ω/□ to $10^7$ Ω/□, both inclusive in consideration of the case where the "energization forming" processing, which will be described later, is performed well, or the like. The film thickness showing the resistance value mentioned above is concretely preferably within a range of from 5 nm to 100 nm, both inclusive. In addition, the Rs is a value which appears when the resistance R of a film having a thickness t, a width w and a length l at the time of being measured in the lengthwise direction is set to R=Rs(l/w). When the resistivity is set to ρ, Rs=ρ/t. Moreover, the width W' of each of the electrodes 4*a* and 4*b* (see FIG. 1A) is preferably set to be smaller than the width W of each of the auxiliary electrodes 2 and 3. By setting the width W to be wider than the width W', the dispersion of the distance from each of the auxiliary electrodes 2 and 3 to each electron-emitting region can be reduced. Although there is no special restriction in the value of the width W', it is preferable the width W' is within a range of from 10 μm to 500 μm, both inclusive, as a practical range. In addition, because the electrodes 4*a* and 4*b* are thin in comparison with the auxiliary electrodes 2 and 3, the auxiliary electrodes 2 and 3 has sufficiently higher heat conductance in comparison with the electrodes 4*a* and 4*b*.

The carbon films 21*a* and 21*b* are severally made of a film containing carbon. And it is preferable that the film contains carbon as its principal component. In addition, the film containing carbon as the principal component is practically one containing 70 wt % or more, preferably 80 wt % or more, of carbon in a carbon film. And the carbon films 21*a* and 21*b* severally has electrical conductivity. Moreover, the carbon films 21*a* and 21*b* preferably contain graphite-like carbon. The graphite-like carbon includes one having the crystal structure of perfect graphite (the so-called HOPG). Moreover, the graphite-like carbon includes one having crystal grains, each having a diameter of about 20 nm, and having a slightly disordered crystal structure (PG). Moreover, the graphite-like carbon includes one having crystal grains, each having a diameter of about 2 nm, and having a large disordered crystal structure (GC). Moreover, the graphite-like carbon also includes amorphous carbon (indicates amorphous carbon and/or a mixture of amorphous carbon and the crystallite of the graphite)

That is, even if disorder of a layer such as a grain boundary between graphite particles exists, the carbon film can be preferably used as the carbon films 21*a* and 21*b*.

In addition, the auxiliary electrodes 2 and 3 can be omitted, as described with regard to the first embodiment.

As for the substrate 100, what has been described in the first embodiment can be adopted.

The first portion 5 preferably contains silicon oxide (typically $SiO_2$) in order to realize a high electron emission characteristic (especially a high electron emission quantity) in the "activation" processing, and for the sake of the stability at the time of a drive. And, the first portion 5 especially preferably contains silicon oxide as a main ingredient. In case of containing the silicon oxide as the main, the percentage of the silicon oxide contained in the first portion 5 practically 80 wt % or more, preferably 90 wt % or more.

The width of the second gap 8 is the order of from 1 nm to 10 nm. Consequently, if a deformation of the first portion 5 arises at the time of a drive, the shape of the second gap 8 is subjected to the influence, and changes of an emission current Ie and a device current If are induced. The silicon oxide (typically $SiO_2$) has a very small coefficient of linear thermal expansion. Consequently, even if the temperature of the vicinity of the second gap 8 becomes high at the time of a drive, the changes of the emission current Ie and the device current If such as the "fluctuation", can be especially effectively suppressed. Moreover, in order to manifest such an effect with good reproducibility, it is preferable that the heat conductance of the second portions 6 is at least four times as large as the heat conductance of the first portion 5.

The first portion 5 is located directly under the second gap 8, and it is preferable that the value of the width L2 is close to the width (width in the X directions of FIGS. 1A to 1C) of the second gap 8 as much as possible. This is because it is preferable in order to achieve the advantages of the present invention mentioned above that the contact areas of the electrodes 4*a* and 4*b* with the second portions 6 located directly under them are made to be large as much as possible. However, there are many cases where the width L3 and meandering shape cannot be uniformly formed like the case where the "activation" processing, which will be described later, is performed, although the situation also depends on the manufacturing method of the gap 8.

Accordingly, the value of the interval L2 is set to be larger than the width of the second gap 8. And the interval L2 is practically set to be 10 nm or more, preferably 20 nm or more, in consideration of the accuracy of patterning and the like.

At all event, in order to achieve the advantages mentioned above, it is necessary for at least a part of the gap 8 to be situated in the region immediately above the first portion 5. That is, it is necessary for the gap 8 that the gap 8 existing on at least a part of Z-X cross sections extending in the Y direction is located within the region immediately above the first portion 5. It is needless to say that it is preferable that the whole gap 8 on the X-Y plane is located within the region immediately above the first portion 5 as shown in FIGS. 1A to 1C. However, as described with regard to the first embodiment, within the limit of achieving the advantages of the present invention, for example, as shown in FIG. 27, the form in which a part of the gap 8 on the X-Y plane protrudes from the inside of the region right above the first portion 5 is not be excepted.

Consequently, it is practically preferable that 80% or more of the gap 8 in the X-Y plane is situated right above the first portion 5. In addition, it is possible to replace the rate of 80% with 80% of the area of the gap 8 in the X-Y plane. Moreover, in other words, what is practically necessary is that 80% or more of the length of each of the portions constituting the gap 8 on the X-Y plane of the edge ends of the pair of the electroconductive films 30*a* and 30*b* is situated immediately above the first portion 5.

In addition, if the first portion 5 is arranged directly under the second gap 8, it is not needed that the first portion 5 is located in the center between the auxiliary electrodes 2 and 3. Moreover, although the example of forming the first portion 5 in a straight line in the Y direction is shown in the example shown in Fig. A, the first portion 5 may not be a straight line.

FIG. 1C shows the case where the first portion 5 is put between the second portions 6 even in the regions where the electrodes 4*a* and 4*b* are not arranged between the first auxiliary electrode 2 and the second auxiliary electrode 3. However, in the present invention, it is not limited to this form, and the first portion 5 may not exist in the regions where the electrodes 4*a* and 4*b* are not arranged between the first auxiliary electrode 2 and the second auxiliary electrode 3. That is, it is possible to adopt the form in which all of the regions of the surface of the substrate 100 between the first auxiliary electrode 2 and the second auxiliary electrode 3 where the electrodes 4*a* and 4*b* are not arranged are occupied by the second portions 6.

However, in any forms, the first portion 5 is arranged directly under the second gap 8. Consequently, at least a part of the first gap 7 is arranged on the first portion 5.

Third Embodiment

Figure 3A:
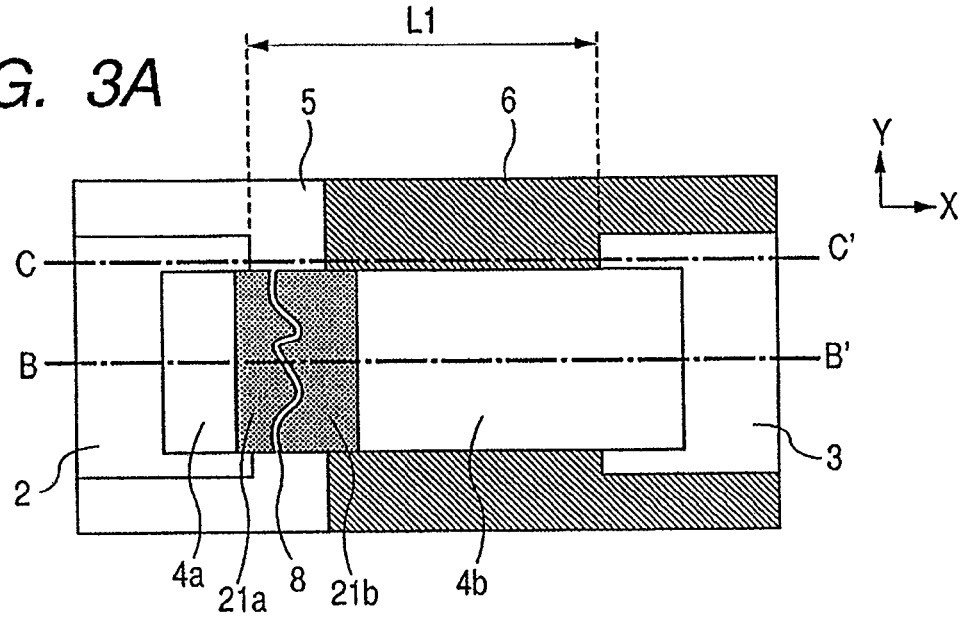
FIGS. 3A, 3B and 3C are a plane view and sectional views schematically showing another configuration example of the electron-emitting device of the present invention.
Figure 3B:
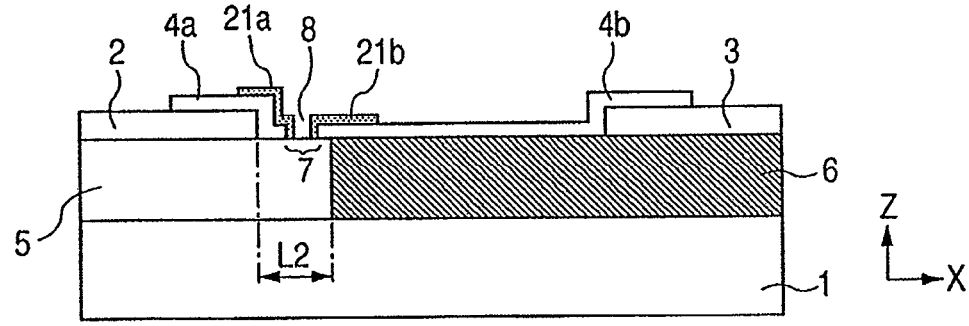
Figure 3C:
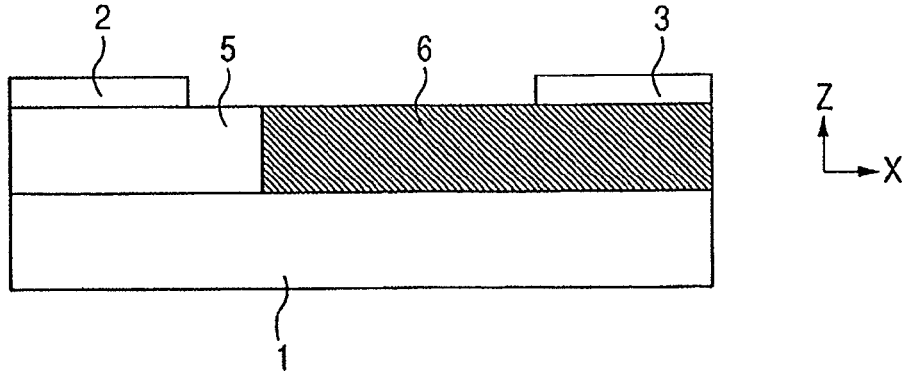

The basic configuration of a third embodiment which is a modified example of the electron-emitting device of the present invention is described using FIGS. 3A to 3C.

FIG. 3A is a schematic plan view. FIGS. 3B and 3C are schematic sectional views taken along a line B-B' and a line C-C' in FIG. 3A, respectively. In FIGS. 3A to 3C, the same reference numerals are given to the same members as those described in the first and the second embodiments. The sizes of the interval L1, and the width L2, the material and the size of each member, and the like in the example of the form are the same as those which have been already described with regard to the first and the second embodiments.

Although the first portion 5 is put between the second portions 6 in the second embodiment shown in FIGS. 1A to 1C, the first portion 5 and a second portion 6 are parallelly provided in the present embodiment shown in FIGS. 3A to 3C. Consequently, the present embodiment is essentially the same as the first and the second embodiments except for being different from the second embodiment in the structure of the substrate 100 and the position of the second gap 8 brought about the difference of the structure of the substrate 100.

Moreover, the equivalent effect to the suppression effect of the "fluctuation" mentioned above can be acquired even in the form shown in FIGS. 3A to 3C.

However, in the form shown in FIGS. 3A to 3C, the auxiliary electrode 2 is located nearer to the second gap 8 in comparison with the auxiliary electrode 3. Consequently, it is preferable to drive the electron-emitting device so that the potential of the second auxiliary electrode 3 may be lower than that of the first auxiliary electrode 2 at the time of making the electron-emitting device emit electrons (at the time of a drive).

By driving the electron-emitting device in this manner, the second electrode 4*b* connected to the auxiliary electrode 3 on the lower potential side functions as the emitter side. Then, many electron-emitting points (regions) exist at the edge end of the second carbon film 21*b*, which constitutes the second gap 8. Accordingly, by arranging a high resistance second portion 6 directly under the electrode 4*b* on the emitter side, damage can be reduced even if unexpected or undesired discharges are generated in comparison with the setting of the first electrode 4*a* to lower potential.

FIG. 3C shows the example in which the second portion 6 and the first portion 5 are parallelly provided even in the regions where the electrodes 4*a* and 4*b* are not arranged between the first auxiliary electrode 2 and the second auxiliary electrode 3. Moreover, in the regions where the auxiliary electrodes 2 and 3 and the electrodes 4*a* and 4*b* are not arranged, portions having heat conductance different from those of the first portion 6 and the second portion 6 may be arranged. Moreover, the first portion 5 may not exist in the regions where the electrodes 4*a* and 4*b* and the carbon films 21*a* and 21*b* are not arranged between the first auxiliary electrodes 2 and 3. That is, it is possible to adopt the form in which all of the regions of the surface of the substrate 100 between the auxiliary electrodes 2 and 3 where the electrodes 4*a* and 4*b* are not arranged are occupied by the second portion 6. However, in any forms, the first portion 5 is arranged directly under the second gap 8. Consequently, the first gap 7 is also arranged on the first portion 5.

Moreover, the structure of the substrate 100 shown in the present embodiment is applicable also to the structure of the substrate 100 of the first embodiment. That is, in that case, the first electrode 4*a* and the first carbon film 21*a*, which are shown in FIGS. 3A to 3C are replaced with the first electroconductive film 30*a*, and the second electrode 4*b* and the second carbon film 21*b* are replaced with the second electroconductive film 30*b*.

Fourth Embodiment

Figure 4A:
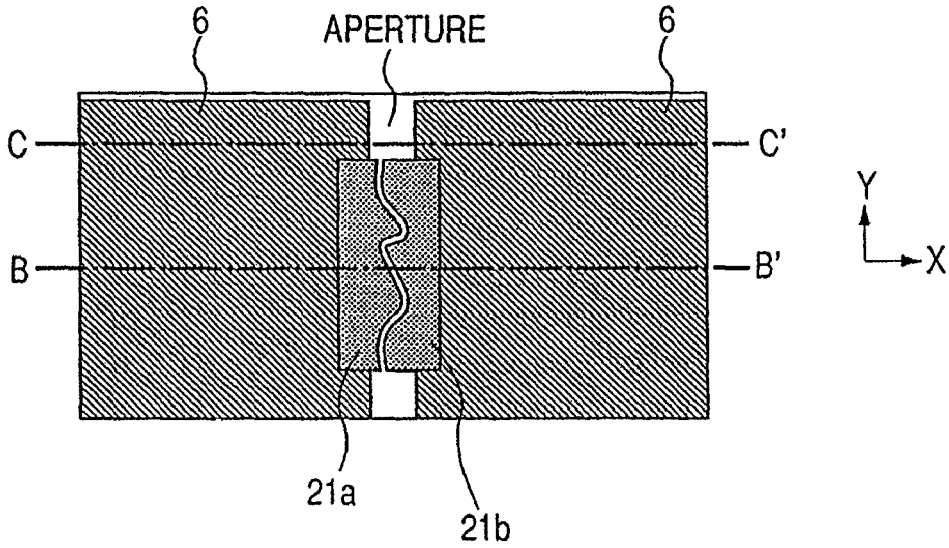
FIGS. 4A, 4B and 4C are a plane view and sectional views schematically showing a further configuration example of the electron-emitting device of the present invention.
Figure 4B:
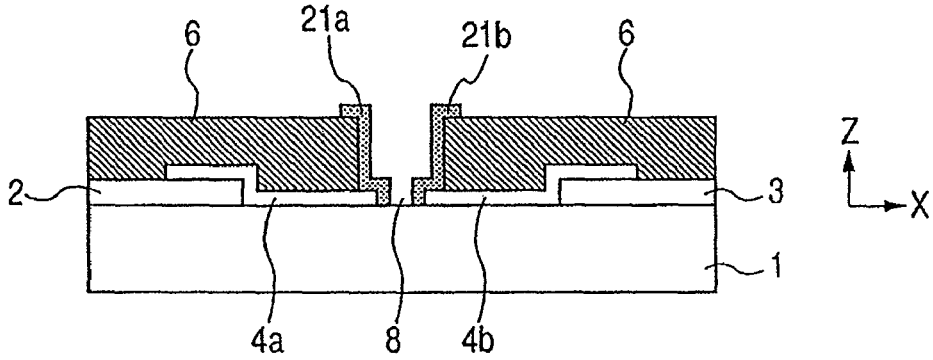
Figure 4C:
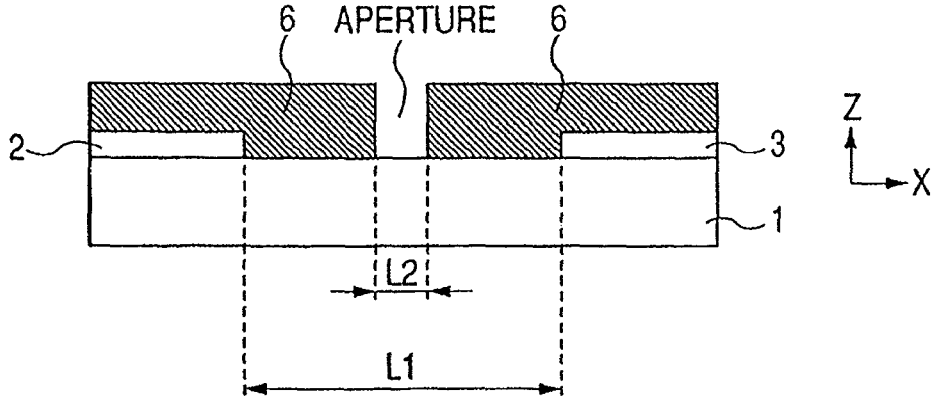

The basic configuration of a fourth embodiment, which is a modified example of the electron-emitting device of the present invention, is described using FIGS. 4A to 4C.

In FIGS. 4A to 4C, the same reference numerals are given to the same members as those described with regard to the first to the third embodiments. The sizes of the interval L1, and the width L2, the material and the size of each member, and the like in the example of the form are the same as those which have been already described with regard to the first to the third embodiments.

FIG. 4A is a schematic plan view, and FIGS. 4B and 4C are schematic sectional views taken along lines B-B' and C-C' in FIG. 4A, respectively.

In this modified example, as shown in FIG. 4B, the second portions 6 equipped with an aperture, from which the second gap 8 is exposed, are arranged on the electrodes 4*a* and 4*b*, as shown in FIG. 4B. In the form shown in FIGS. 1A to 1C and FIGS. 3A to 3C, although the case where the first portion 5 and the second portions 6 are arranged on the lower side of the electrodes 4*a* and 4*b*, the first portion 5 and the second portions 6 are arranged on the upper side of the electrodes 4*a* and 4*b* in this embodiment. In addition, the first portion 5 in the present modified example corresponds to the aperture. Because the electron-emitting device of the present invention is driven in a vacuum, in the present modified example the first portion 5 becomes the vacuum.

In the example of this form, when the carbon films 21*a* and 21*b* are used as the second embodiment, as shown in FIG. 4B, it is preferable to cover the side of the aperture portion of the second portions 6 with the electroconductive films 21*a* and 21*b*. As described with regard to the first embodiment, the second portions 6 are members having high resistances, and are preferably made of an insulating material. Consequently, when electrons emitted from the gap 8 pass through the aperture, a part of the emitted electrons may collide with the second portions 6 to charge up the inside of the aperture of the second portions 6. Accordingly, it is preferable to cover the surface in the aperture (the side surface in the aperture) with the electroconductive films 21*a* and 21*b* having electrical conductivity. By forming the covered surface, even if electrons collide with the surfaces (side surfaces) of the second portions 6 in the aperture, the influence on the beam orbits of the emitted electrons can be suppressed. Moreover, the extent (the diameter of the electronic beam) of the electrons emitted from the gap 8 can be defined by the aperture. Consequently, in addition to the suppression effect of the "fluctuation" mentioned above, the electron-emitting device of the present embodiment attains the effect capable of emitting a highly accurate electron beam only by controlling the shape of the aperture. Then, the image display apparatus using the electron-emitting device of the present embodiment can obtain a highly accurate stable display image.

Fifth Embodiment

The basic configuration of a fifth embodiment, which is a modified example of the electron-emitting device of the present invention, is described using FIGS. 6A to 6D.

In FIGS. 6A to 6D, the same reference numerals are given to the same members as those described with regard to the first to the fourth embodiments. The sizes of the interval L1, the width L2 and the like, the material and the size of each member, and the like in the example of the form are the same as those which have been already described with regard to the first to the fourth embodiments.

The present embodiment shown in FIGS. 6A to 6D is an example of arranging the direction in which the first carbon film 21*a* and the second carbon film 21*b* are opposed to each other so as to intersect with the surface of the substrate 1. More specifically, it is an example of stacking the first portion 5, second portions 6 and the first auxiliary electrode 2 on the substrate 1. Also in the example of the form, the substrate 100 is composed of the substrate 1, the first portion 5 and the second portions 6.

Consequently, the second gap 8 is arranged on the side surface (side surface of the first portion 5) of a layered product composed of the first portion 5, the second portions 6 and the first auxiliary electrode 2. Except for the point, the present embodiment is essentially the same as the second and the third embodiments shown in FIGS. 1A to 1C or FIGS. 3A to 3C. Moreover, even by the form shown in FIGS. 6A to 6D, an effect equivalent to the suppression effect of the "fluctuation" mentioned above can be obtained.

Figure 6A:
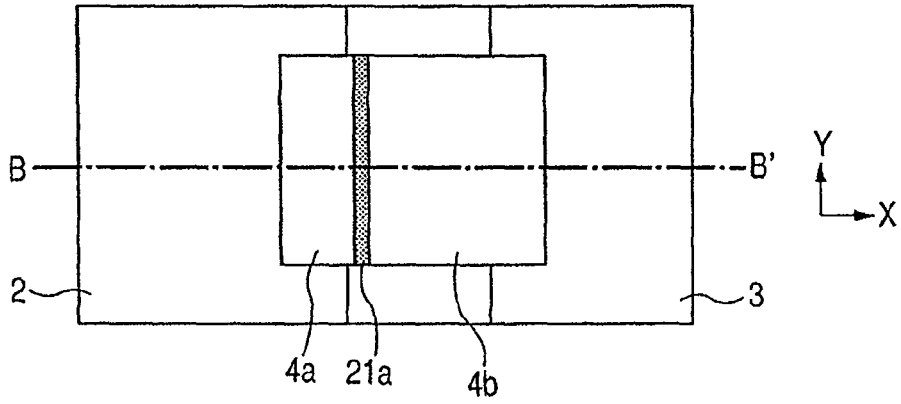
FIGS. 6A, 6B, 6C and 6D are a plane view and sectional views schematically showing a still further configuration example of the electron-emitting device of the present invention.
Figure 6B:
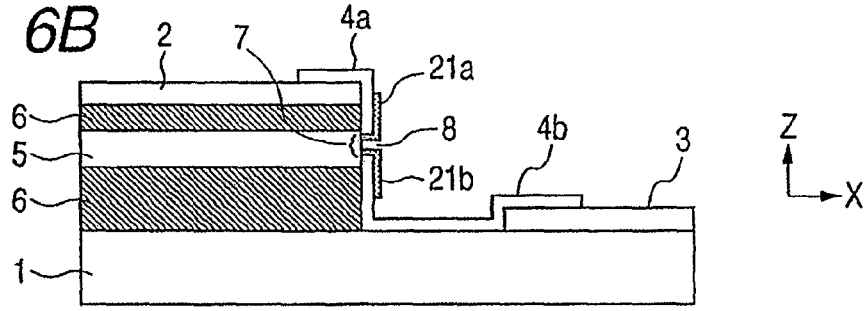
Figure 6C:
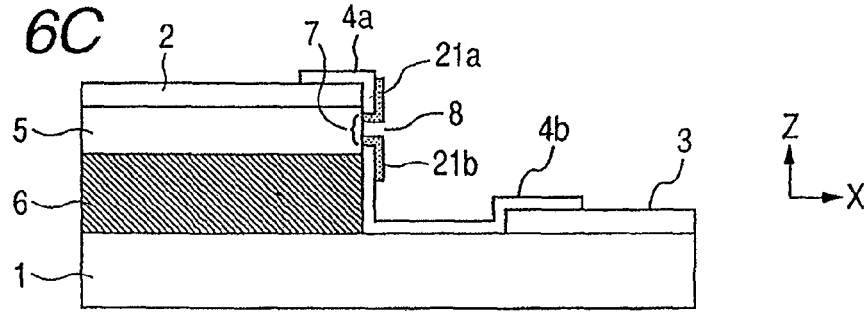
Figure 6D:
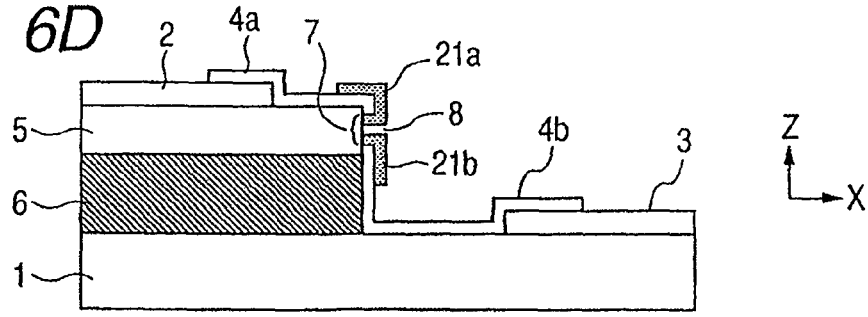

FIG. 6A is a schematic plan view, and FIG. 6B is a sectional view taken along the line B-B' of FIG. 6A. FIGS. 6C and 6D are other examples of the sectional views taken along the line B-B' of FIG. 6A.

Also in the present embodiment, as shown in FIG. 1 mentioned above, the first portion 5 may be arranged to be put between the second portions 6 (FIG. 6B). That is, there can be adopted the form of stacking a second portion 6, the first portion 5, a second portion 6, the first auxiliary electrode 2 on the substrate 1 in this order.

Moreover, as the example of the form shown in FIGS. 3A to 3C, the example of the form of parallelly providing the first portion 5 and the second portion 6 can be adopted. That is, the first portion 5 may be arranged between the first auxiliary electrode 2 and the second portion 6 (FIG. 6C). That is, the form of stacking the second portion 6, the first portion 5 and the first auxiliary electrode 2 in this order may be adopted.

Moreover, as shown in FIG. 6D, the end of the first auxiliary electrode 2 may be distant from the end of the first portion 5. By such formation, the distance between the first auxiliary electrode 2 and the first carbon film 21*a*, namely the distance between the first auxiliary electrode and the second gap 8, can be taken to be long. As a result, by controlling the resistance value of the first electrode 4*a*, as already described with regard to the third embodiment, even if a discharge takes place, the damage to electron-emitting regions can be suppressed.

In addition, in the example shown here, the side surface of the layered product, on which the second gap 8 is arranged, is arranged to be substantially perpendicular to the surface of the substrate 1.

In the first embodiment, the direction in which the first electroconductive film 30*a* and the second electroconductive film 30*b* are opposed to each other is the direction of the plane of the substrate 1 (the X direction). Moreover, in the second to the fourth embodiments, the direction in which the first carbon film 21*a* and the second carbon film 21*b* are opposed to each other is the direction of the plane of the substrate 1 (X direction).

However, it is preferable that the direction in which the first carbon film 21*a* and the second carbon film 21*b* is opposed to each other is perpendicular to the surface of the substrate 1 in view of improving an electron emission efficiency $\eta$.

In the electron-emitting device of the present invention, an anode electrode 44 is arranged to be separated from the plane of the substrate 1 in the Z direction, which will be described with reference to FIG. 10, at the time of a drive.

Consequently, if the direction in which the first carbon film 21*a* and the second carbon film 21*b* are opposed to each other faces the anode electrode 44 like the present embodiment, the electron emission efficiency $\eta$ can be made to be large.

However, in the present embodiment, the side surface of the layered product is not limited to be perpendicular to the surface of the substrate 1. Effectively, it is preferable that the side surface of the layered product is set to the surface of the substrate to be within a range of from 30 degrees to 90 degrees, both inclusive.

In addition, the electron emission efficiency $\eta$ is a value expressed by the electron emission quantity Ie/device current If. Here, the electron emission quantity Ie is a current flowing into the anode electrode 44, and the device current If can be defined by the current flowing between the first auxiliary electrode 2 and the second auxiliary electrode 3.

In order to make the electron emission efficiency $\eta$ high, in the example of the form shown in FIGS. 6A to 6C, it is preferable to drive the electron-emitting device under the setting of the potential of the first auxiliary electrode 2 to be higher than that of the second auxiliary electrode 3. By such setting, because the direction of emitting electrons to be emitted from the vicinity of the gap 8 faces the anode electrode 44, the current (the electron emission quantity) which reaches the anode electrode 44 can be made much to the device current If.

In this way, in the case where the potential of the first auxiliary electrode 2 is set to be higher than that of the second auxiliary electrode 3 at the time of a drive, it is preferable that the second portions 6 have a high insulative performance. At the time of performing such a drive, as described with regard to the third embodiment, the second carbon film 21*b* connected to the second auxiliary electrode 3 side becomes an electron-emitting body (emitter). Consequently, if the second portion 6 located directly under the second electrode 4*b* has a high insulative performance, then the damage to the electron-emitting regions can be suppressed even if a discharge is generated.

Moreover, the structure of the substrate 100 shown with regard to the present embodiment can be also applied to the structure of the substrate 100 of the first embodiment. That is, in that case, the first electrode 4*a* and the first carbon film 21*a* shown in FIGS. 6A to 6D is replaced with the first electroconductive film 30*a*, and the second electrode 4*b* and the second carbon film 21*b* are replaced with the second electroconductive film 30*b*.

Next, the manufacturing methods of the electron-emitting device of the present invention are described. According to the manufacturing methods of the present invention which will be described in the following, the electron-emitting devices of the first to the fifth embodiments mentioned above can be formed.

In addition, the manufacturing methods of forming the electron-emitting devices of the present invention mentioned above are not limited to the manufacturing methods using the "energization forming" processing and the "activation" processing, which will be shown in the following, as mentioned above.

In the following, a technique of forming the first gap 7 by the "energization forming" processing is shown. According to the following manufacturing method, the position and the shape of the first gap 7 can be easily controlled in the "energization forming" processing. As a result, because the second gap 8 can be arranged immediately above the first portion 5 by performing the "activation" processing furthermore, the position of the electron-emitting region can be controlled.

In the following, description is given to a case where the electron emitting device of the second embodiment shown in FIGS. 1A to 1C is formed using the "energization forming" processing and the "activation" processing.

First, the description is given to a forming process of the first gap 7 at the time of performing the "energization forming" process to the electrical conductive material to which the auxiliary electrodes 2 and 3 are connected, which has been described with regard to the conventional technique.

It is conceivable that, at the very initial stage of the formation of the first gap 7, first, a very minute part of the electrodes 4*a* and 4*b* is made to have a high resistance (a fissure is produced) by Joule heat. In addition, at this stage, only a part of the first gap 7, which is to be finally formed, is formed. That is, the gap 7 is not formed from the ends to the ends of the electrodes 4*a* and 4*b* in the direction (Y direction) substantially perpendicular to the direction in which the auxiliary electrodes 2 and 3 are opposed to each other (X direction). Then, the distribution of the current flowing through the electrodes 4*a* and 4*b*, which has caused by the voltage applied at "energization forming" changes owing to the change to be a high resistance (the generation of a fissure) mentioned above. Consequently, it is conceivable that a concentration of currents occurs at another part in the electrodes 4*a* and 4*b* in turn, and that the change to be a high resistance (the generation of a fissure) is generated at that part. It is considered that, by the successive chain reaction occurrences of such a change to be a high resistance, the parts which has changed to have a high resistance (fissure) are gradually connected to each other, and that the first gap 7 existing in the Y direction is finally formed.

Based on the matter mentioned above, an example of the manufacturing methods of the present invention will be concretely described with reference to FIG. 2 in the following by exemplifying the electron-emitting device of the second embodiment. The manufacturing method according to the present invention can be implemented by, for example, the following processes 1-5.

(Process 1)

Figure 2A:
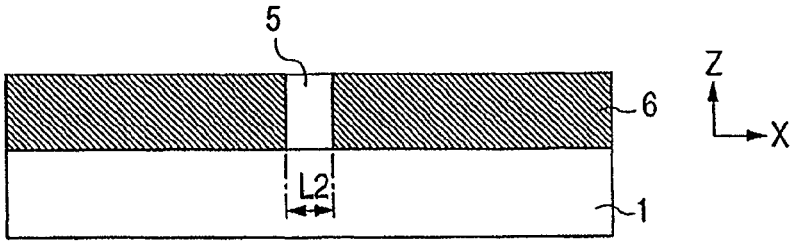
FIGS. 2A, 2B, 2C, 2D and 2E are schematic views showing the outline of a manufacturing method of the electron-emitting device of the present invention.

The substrate 1 is fully washed, and the first portion 5 is formed using a photolithographic technique (resist coating, exposure, development and etching). After that, the material for forming the second portions 6 is deposited by a vacuum evaporation method, a sputtering method, a CVD method, or the like. After that, lift off is performed using a stripping agent, and the first portion 5 and the second portions 6 are arranged so that the first portion 5 may be put between the second portions 6 (FIG. 2A). Accordingly, the first portion 5 and second portion 6 are juxtaposed to each other (the first portion 5 and second portion 6 are arranged side-by-side).

At this time, it is preferable to form the first portion 5 and the second portions 6 so that their surfaces (namely the surface of the substrate 100) may be substantially flat. However, as long as there are no special changes in the film thickness of an electroconductive film 4 formed at the process 3 to be mentioned later, the surface of the first portion 5 may become somewhat uneven to the surfaces of the second portions 6.

Moreover, an example of forming the first portion 5 and the second portions 6 on the substrate 1 is shown here. However, one or both of the first portion 5 and the second portions 6 may be formed on a part of the substrate 1.

As the substrate 1, silica glass, soda lime glass, a glass substrate produced by stacking silicon oxide (typically $SiO_2$) on the glass substrate, the silicon oxide formed by a well-known film formation method such as the sputtering method, or a glass substrate containing reduced alkali components can be used. It is preferable to use the silicon oxide (typically $SiO_2$) as the substrate 1 in the present invention.

The first portion 5 is located directly under the second gap 8. Consequently, in order to perform the quantum mechanical tunneling of electrons at the gap 8, it is required for the first portion 5 to have a sufficiently high insulative performance in the gap 8.

Consequently, the first portion 5 is preferably made of an insulative material. To put it concretely, the resistivity of the material constituting the first portion 5 is practically equal to or more than the resistivity of the material constituting the second portions 6 ($10^8$ Ωm or more). Moreover, when the resistivity is expressed in another way with a sheet resistance value, the sheet resistance value of the first portion 5 is preferably equal to or more than the sheet resistance value of the second portions ($10^{13}$ Ω/□ or more).

For the purpose of acquiring a good electron emission characteristic by the "activation" processing, which will be mentioned later, the insulative material is preferably the one containing the silicon oxide (typically $SiO_2$). In particular, the first portion 5 preferably contains the silicon oxide as a main ingredient. In case of containing the silicon oxide as a main ingredient, the rate of the silicon oxide contained in the first portion 5 is practically 80 wt % or more, preferably 90 wt % or more.

A member having higher conductance than that of the first portion 5 is used for the second portions 6. To put it concretely, it is preferable that the member of the second portions 6 has heat conductance being at least four times as large as that of the first portion because the position of the first gap 7 can be arranged on the first portion 5 at a high probability in such the heat conductance. Moreover, a material of a higher resistance than that of the electroconductive film 4 formed in the second portions 6 at a process 3, which will be described later, is used. When the second portions 6 have higher resistances than that of the electroconductive film 4 formed at the process 3, the resistance value between the auxiliary electrodes 2 and 3 connected with the electroconductive film 4 does not fall below the resistance of the electroconductive film 4. As a result, the possibility that a discharge is generated at the time of the "activation" processing, which will be mentioned later, can be made to be low. Moreover, because the quantity of the electrons existing in the second portions 6 is little even when the discharge is generated, the influence of the discharge can be reduced. Moreover, because the emission current Ie at the time of a drive can be stabilized, a good image can be maintained in case of being used for an image display apparatus.

Accordingly, the second portions 6 have higher resistances than that of the electrode 4, and the material thereof is preferably one having a resistivity of $10^8$ Ωm or more. Moreover, when it is put in another way with a sheet resistance value, the sheet resistance of the second portions 6 is preferably $10^{13}$ Ω/□ or more.

As the materials for forming the second portions 6, as described above, the materials with heat conductance higher than those of the materials for the first portion 5 are selected. Specifically, silicon nitride, alumina, aluminum nitride, tantalum pentoxide and titanium oxide can be used. Moreover, when the second portions 6 are formed of the materials mentioned above and the first portion 5 is formed of a insulating material containing silicon oxide as a main ingredient, an effective electron-emitting region (second gap 8) can be arranged immediately above the first portion 5 by the "activation" processing, which will be described later. This is because the "activation" processing, which will be described later, is effectively performed on the member containing silicon oxide. The inventor considers the reason as follows. With the materials used for the second portions 6 which are mentioned above, even if the "activation" processing is performed, the electron emission characteristic is not improved, and the second gap 8 which produces a good electron emission characteristic is not formed. Consequently, even if a part of the first gap 7 deviates from the position immediately above the first portion 5, the electron-emitting region can be effectively formed on the first portion 5 by performing the "activation" processing.

Moreover, although the thicknesses of the second portions 6 also depend on the selection of the above materials, each of the thicknesses are preferably 10 nm or more, and more preferably 100 nm or more, for the sake of the advantages of the present invention. Moreover, although the upper limit of the thickness does not exist, 10 μm or less is preferable in view of the stability of a process, and the relation of thermal stress with the substrate 1.

When the control of the shape of the first gap 7 is performed, the width L2 of the first portion 5 in the X direction is set to be sufficiently smaller than the interval L1. For efficiently reducing the "fluctuation" of the electron emission quantity, the width L2 is preferably set to be L1/10 or less, or preferably L1/10 or less practical. Moreover, in order to practically manifest the effect of suppressing the range of the meandering of the first gap 7, it is preferable that the heat conductance of the second portions 6 is at least four times as large as that of the first portion 5.

(Process 2)

Figure 2B:
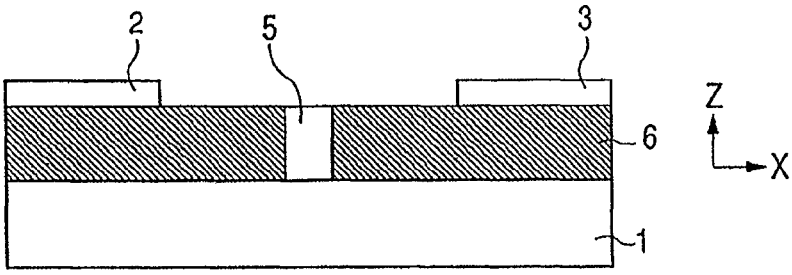

Next, a material for forming the auxiliary electrodes 2 and 3 is deposited by the vacuum evaporation method, the sputtering method and the like. By performing patterning using the photolithographic technique or the like, the first auxiliary electrode 2 and the second auxiliary electrode 3 are formed (FIG. 2B).

At this time, the first auxiliary electrode 2 and the second auxiliary electrode 3 are formed so that the boundaries between the first portion 5 and the second portions 6 may be located between the first auxiliary electrode 2 and the second auxiliary electrode 3. Here, because the form of putting the first portion 5 between the second portions 6 is used, the first auxiliary electrode 2 and the second auxiliary electrode 3 are formed so that the two boundaries between the first portion 5 and the second portions 6 may be located between the first auxiliary electrode 2 and the second auxiliary electrode 3. In the embodiment shown in FIGS. 3A to 3C, the first auxiliary electrode 2 and the second auxiliary electrode 3 are formed so that one boundary between the first portion 5 and the second portion 6 may be located between the first auxiliary electrode 2 and the second auxiliary electrode 3.

As the materials of the auxiliary electrodes 2 and 3, electroconductive materials such as a metal, a semiconductor and the like can be used. For example, metals or alloys such as Ni, Cr, Au, Mo, W, Pt, Ti, Al, Cu, Pd and the like, and metals or metal oxides such as Pd, Ag, Au, $RuO_2$, Pd—Ag and the like can be used. As the film thicknesses, intervals L1, widths W and the like of the auxiliary electrodes 2 and 3, the values described with regard to the first and the second embodiments can be suitably applied.

(Process 3)

Figure 2C:
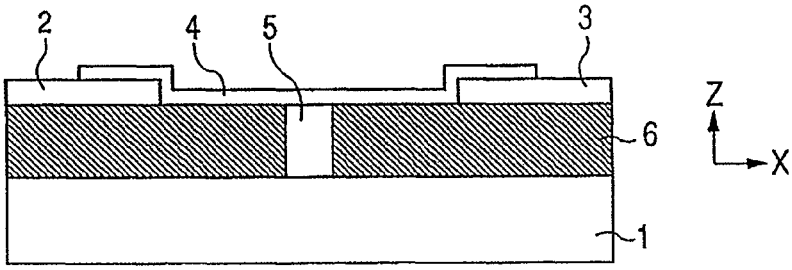

Successively, the electroconductive film 4 connecting the space between the first auxiliary electrode 2 and the second auxiliary electrodes 3, which are formed on the substrate 1, is formed (FIG. 2C).

As the manufacturing method of the electroconductive film 4, for example, the following method can be adopted. That is, first, an organometallic solution is coated to be dried, and thereby an organometallic film is formed. Then, the heat baking processing of the organometallic film is performed to make the organometallic film a metallic compound film such as a metal film or a metal oxide film. After that, by performing patterning by lift off, etching or the like, an electroconductive film 4 is obtained.

As the materials of the electroconductive film 4, electroconductive materials such as metals, semiconductors and the like can be used. For example, metals or metallic compounds (alloys, metal oxides and the like) such as Ni, Cr, Au, Mo, W, Pt, Ti, Al, Cu, Pd and the like can be used.

In addition, although the description has been performed based on the method of applying an organometallic solution here, the method of forming the electroconductive film 4 is not restricted to this method. For example, the electroconductive film 4 can be also formed by the well-known techniques such as the vacuum evaporation method, the sputtering method, the CVD method, the dispersion coating method, the dipping method, the spinner method, the ink-jet method and the like.

In order to perform the "energization forming" processing good at the following process, the electroconductive film 4 is formed to have a sheet resistance (Rs) in a range of from $10^2$ Ω/□ to $10^7$ Ω/□, both inclusive.

In addition, the Rs is a value which appears when the resistance R of a film having a thickness t, a width w and a length l at the time of being measured in the lengthwise direction is set to R=Rs(l/w). When the resistivity is set to ρ, Rs=ρ/t.

The film thickness showing the resistance value mentioned above is within a range of from 5 nm to 50 nm, both inclusive. Moreover, the width W' of the electroconductive film 4 is set to be smaller than the width W of each of the auxiliary electrodes 2 and 3 (see FIG. 1A).

In addition, the process 3 and the process 2 can be replaced with each other in their orders.

(Process 4)

Successively, the "energization forming" processing is performed. Specifically, the processing is performed by flowing a current through the electroconductive film 4. In order to flow a current through the electroconductive film 4, specifically, it can be performed by applying a voltage between the first auxiliary electrode 2 and the second auxiliary electrode 3.

Figure 2D:
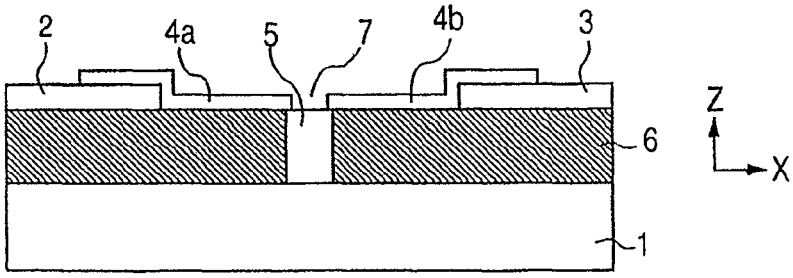

By flowing a current through the electroconductive film 4, the first gap 7 is formed in a part of the electroconductive film 4 (on the first portion 5). As a result, the first electrode 4*a* and the second electrode 4*b* are arranged to be opposed to each other in the X direction with the first gap 7 put between them (FIG. 2D). In addition, the first electrode 4*a* and the second electrode 4*b* sometimes connected to each other at a minute part.

Figure 10:
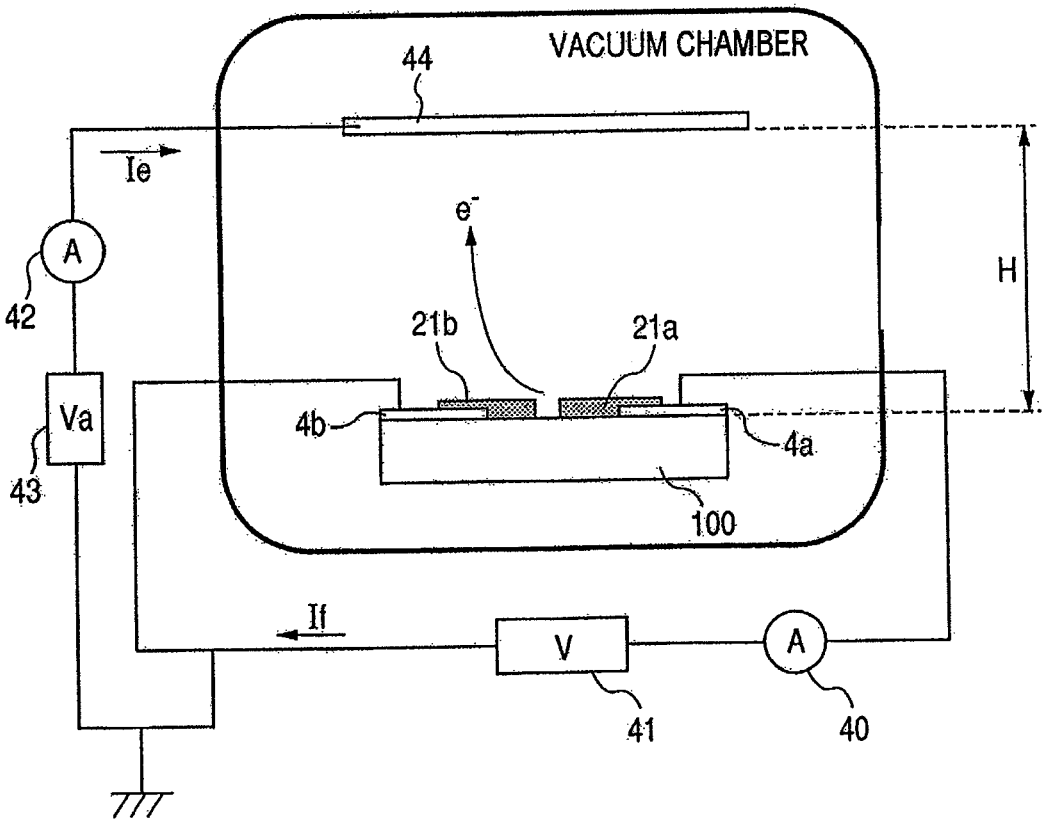
FIG. 10 is a schematic view showing an example of a vacuum chamber equipped with a measurement evaluation function of an electron-emitting device.

The processing after the "energization forming" processing can be performed after arranging the substrate 100, to which the steps 1-3 have been completed, is arranged in, for example, the vacuum chamber shown in FIG. 10, and making the inside of the vacuum chamber vacuum.

In addition, the measurement evaluation apparatus shown in FIG. 10 is equipped with a vacuum device (vacuum chamber), and the vacuum chamber is equipped with equipment required for a vacuum chamber, such as a not shown exhaust pump, a vacuum gauge, and the like. The inside of the vacuum chamber is made to be able to perform various measurement evaluations under a desired vacuum.

In addition, an exhaust pump (not shown) can be equipped with the one for a high vacuum chamber which does not use any oil, such as a magnetic levitated turbo-pump, a dry-sealed vacuum pump and the like, and the one for an ultra-high vacuum chamber system such as an ion pump.

Moreover, a carbon containing gas used for the "activation" processing, which will be described later, can be introduced into the vacuum chamber at a desired pressure by additionally installing a not shown gas introducing apparatus to the present measurement evaluation apparatus. Moreover, the whole vacuum chamber and the substrate 100 arranged in the vacuum chamber can be heated by a not shown heater.

Figure 11A:
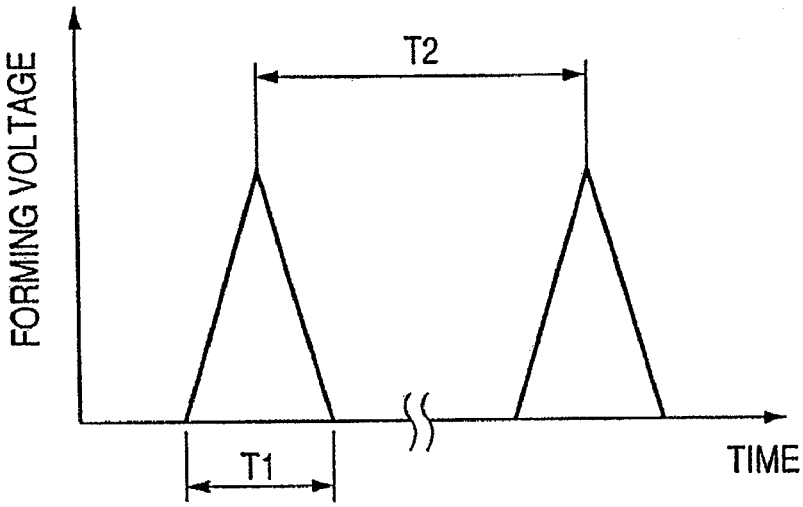
FIGS. 11A and 11B are schematic views showing an example of the forming pulses at the time of manufacturing the electron-emitting device of the present invention.

The "energization forming" processing can be performed by repeatedly applying a pulse voltage having a pulse peak value of constant voltage (constant) to the interval between the first auxiliary electrode 2 and the second auxiliary electrode 3. Moreover, the "energization forming" processing can be also performed by applying a pulse voltage, gradually increasing its pulse peak value. An example of pulse waveforms when their pulse peak values are constant is shown in FIG. 11A. Reference signs T1 and T2 denote a pulse width and a pulse interval (pause time) of a voltage waveform in FIG. 11A. The pulse width T1 can be set to be within a range of from 1 μsec to 10 msec, and the pulse interval T2 can be set to be within a range of from 10 μsec to 100 msec. A triangular wave and a rectangular wave can be used as the pulse waveform itself to be applied.

Figure 11B:
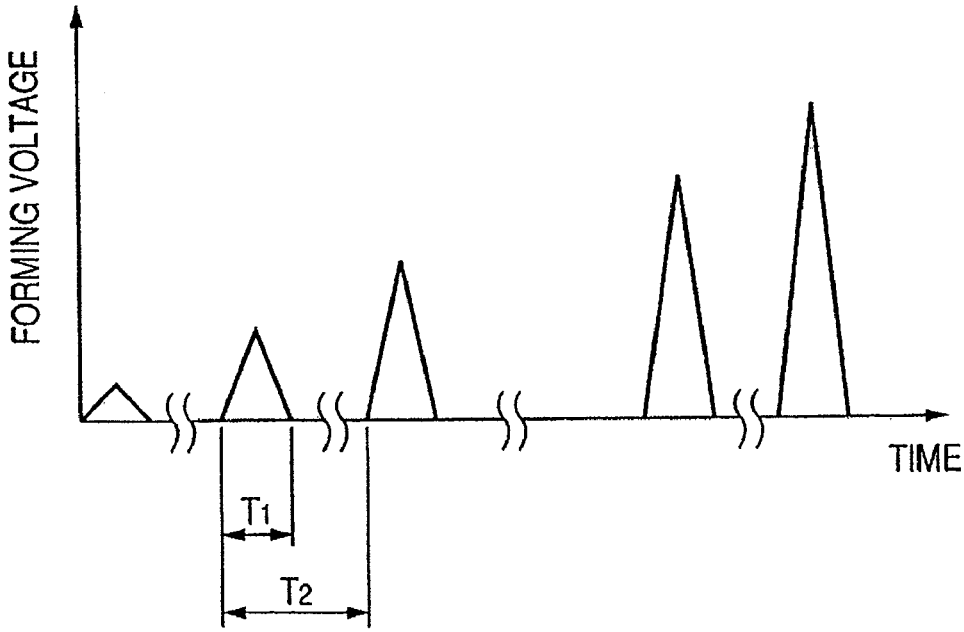

Next, an example of a pulse waveform in the case of increasing a pulse peak value while applying a pulse voltage is shown in FIG. 11B. In FIG. 11B, reference signs T1 and T2 denotes a pulse width and a pulse interval (pause time) of the voltage waveform, respectively. The pulse width T1 can be set to be within a range of from 1 μsec to 10 msec, and the pulse interval T2 can be set to be within a range of from 10 μsec to 100 msec. A triangular wave and a rectangular wave can be used as the pulse waveform itself to be applied. The peak value of the pulse voltage to be applied is increased by a step of 0.1 V, for example.

In the example described above, the triangular wave pulse is applied between the first auxiliary electrode 2 and the second auxiliary electrode 3. However, the waveform to be applied to the interval between the auxiliary electrodes 2 and 3 is not limited to the triangular wave, and may use a desired waveform such as the rectangular wave and the like. Moreover, the peak value, the pulse width, the pulse interval and the like of the triangular wave pulse are also not restricted to the values mentioned above. In order to form the first gap 7 in a good state, pertinent values can be selected according to the resistance value and the lie of the electron-emitting device.

Figure 9A:
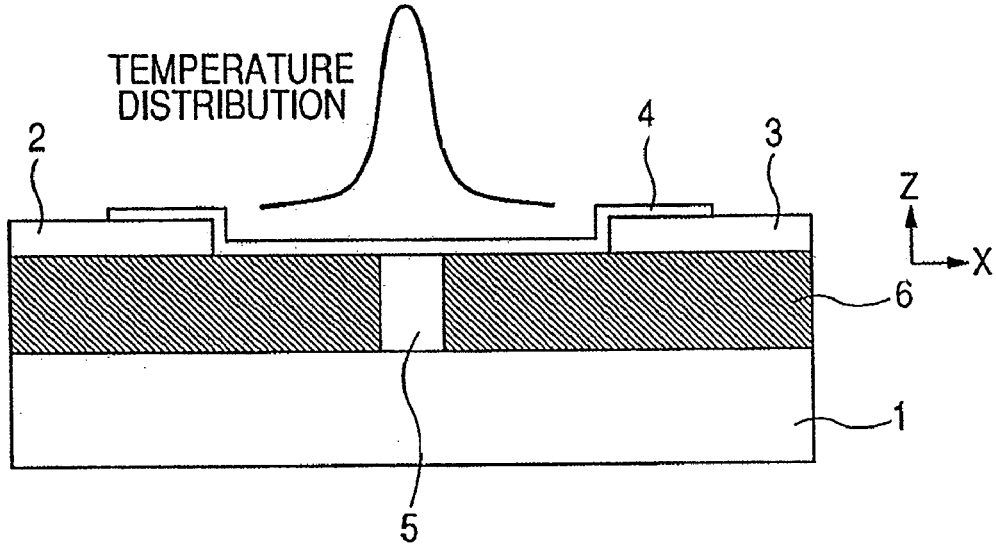
FIGS. 9A and 9B are schematic views showing temperature distributions at the time of applying forming pulses at the time of manufacturing an electron-emitting device of the present invention.
Figure 9B:
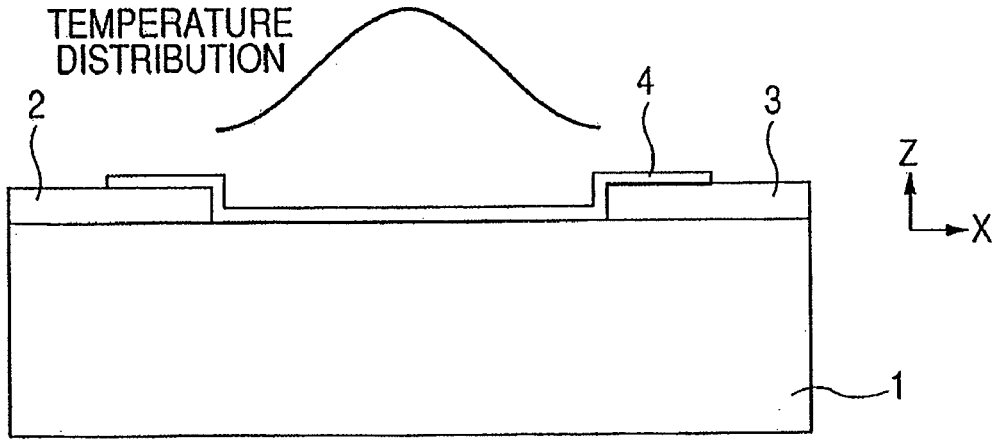

Next, the reason why the shape of the first gap 7 is controlled by the manufacturing method of the present invention in the "energization forming" processing is described using FIGS. 9A and 9B.

Figure 8A:
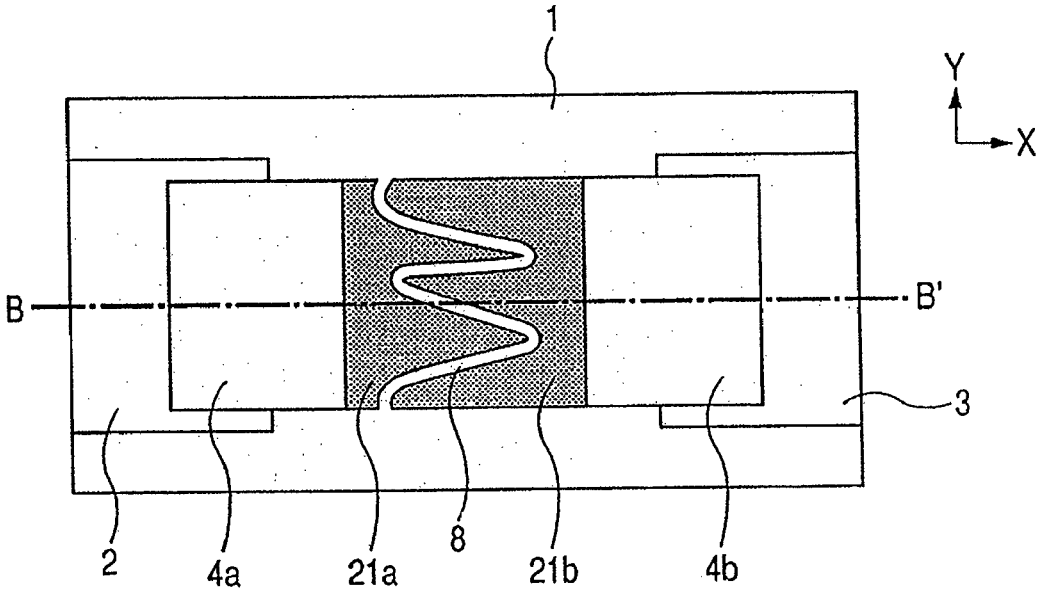
FIGS. 8A and 8E are schematic plan view and a schematic sectional view showing an example of a conventional electron-emitting device.

A temperature distribution during electrification in case of performing the conventional "energization forming" processing is shown in FIG. 9B. In this case, the temperature distribution by Joule heat becomes broad between the auxiliary electrodes 2 and 3. As a result, by the various pieces of nonuniformity which have been mentioned above, the first gap 7 sometimes meander in a large degree as shown in FIG. 8A. On the other hand, by the manufacturing method of the present invention, the temperature distribution during electrification in the case of performing the "energization forming" processing can be made to be steep as shown in FIG. 9A.

Figure 25:
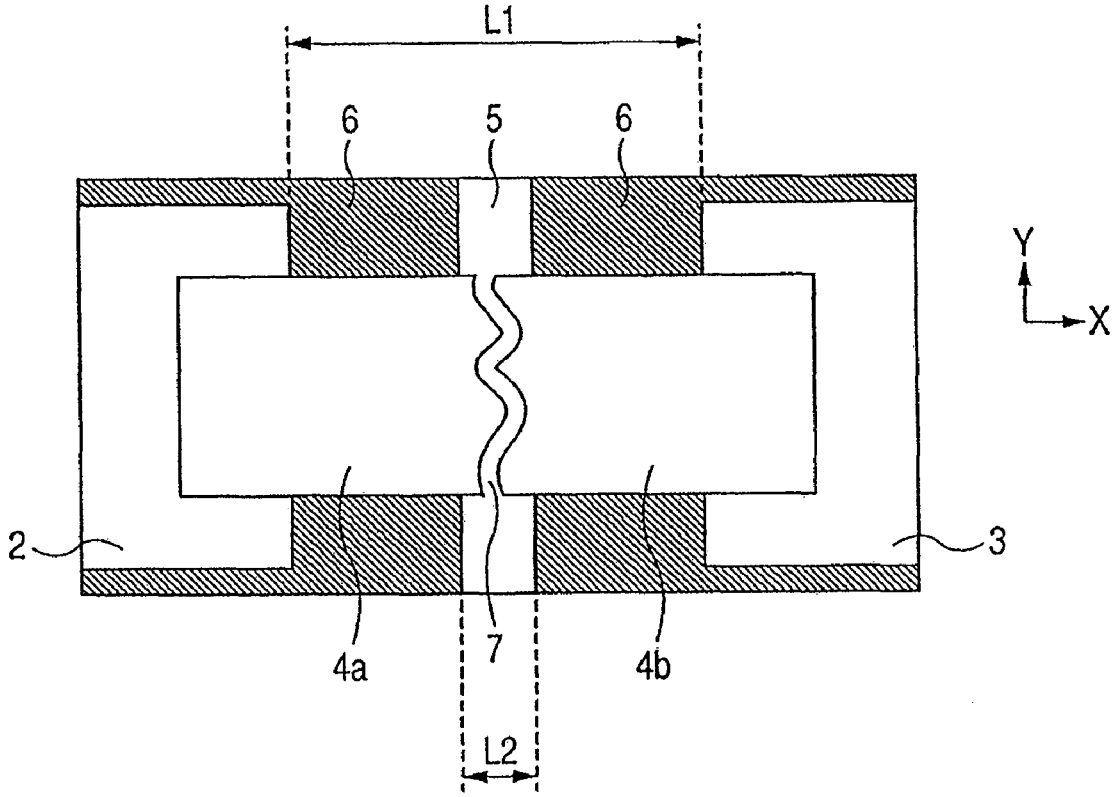
FIG. 25 is a schematic view showing a part of an electron-emitting device according to the present invention.

In the present invention, because heat diffuses to the second portions 6 having the heat conductance higher than that of the first portion 5, the temperature distribution by the Joule heat becomes steeper than that of the conventional "energization forming." Even if there are some various pieces of nonuniformity mentioned above, the first gap 7 can be arranged right above the width L2 of the first portion 5. When the width L2 is excessively deviated from the range mentioned above, there would be a case that a part of the first gap 7 does not fits within the range immediately above the first portion 5 in FIG. 25. However, even in such a case, as mentioned above, an electron-emitting region can be effectively arranged only on the first portion 5 by the "activation" processing, which will be mentioned later, by selecting the materials of the first portion 5 and the second portions 6.

(Process 5)

Figure 2E:
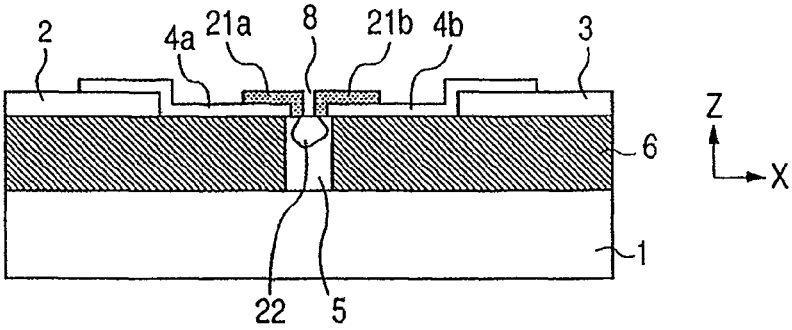

Next, the "activation" processing is preferably performed (FIG. 2E).

The "Activation" processing can be performed by introducing a carbon containing gas into, for example, the vacuum chamber shown in FIG. 10, and by applying a bipolar voltage between the auxiliary electrodes 2 and 3 under the atmosphere containing the carbon containing gas.

By this processing, the carbon films 21*a* and 21*b* can be formed from the carbon containing gas existing in the atmosphere. To put it concretely, the carbon films 21*a* and 21*b* can be deposited on the substrate 100 (on the first portion 5) between the first electrode 4*a* and the second electrode 4*b*, and the electrodes 4*a* and 4*b* in the vicinity of the first portion 5.

As the carbon containing gas, for example, an organic material gas can be used. As the organic material, aliphatic hydrocarbons such as alkane, alkene and alkyne; aromatic hydrocarbons; alcohols; aldehydes; ketones; amines; organic acids such as phenol, carvone, sulfonic acid and the like; and the like can be cited. Specifically, saturated hydrocarbon expressed by the composition formula of CnH2n+2, such as methane, ethane, propane and the like; unsaturated hydrocarbon expressed by the composition formula of CnH2n or the like, such as ethylene, propylene and the like; benzene; toluene; methanol; ethanol; formaldehyde; acetaldehyde; acetone; methyl ethyl ketone; methylamine; ethyl amine; phenol; formic acid; acetic acid; propionic acid; and the like can be used.

Moreover, because the preferable partial pressure of the carbon containing gas in the vacuum chamber changes according to the form of the electron-emitting device, the shape of the vacuum chamber, the kind of the carbon containing gas to be used, and the like, the partial pressure is suitably set.

Figure 12A:
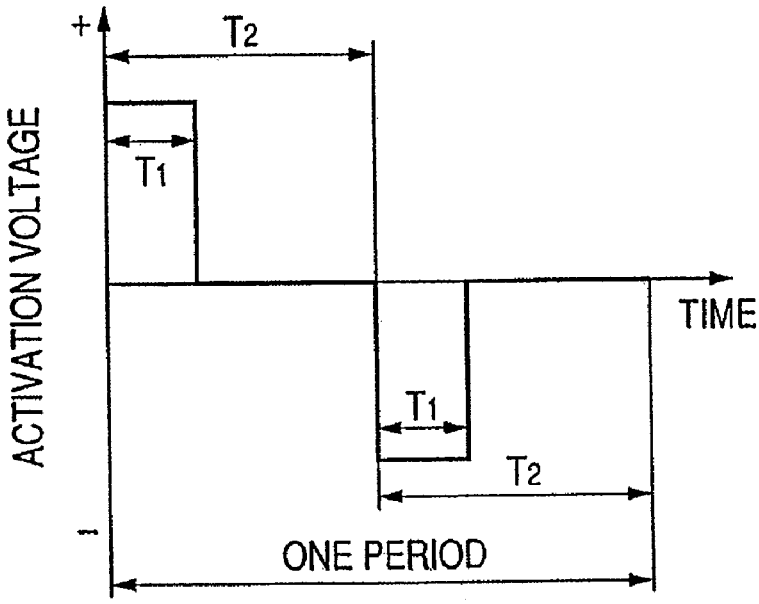
FIGS. 12A and 12B are schematic views showing examples of activation pulses at the time of manufacturing the electron-emitting device of the present invention.
Figure 12B:
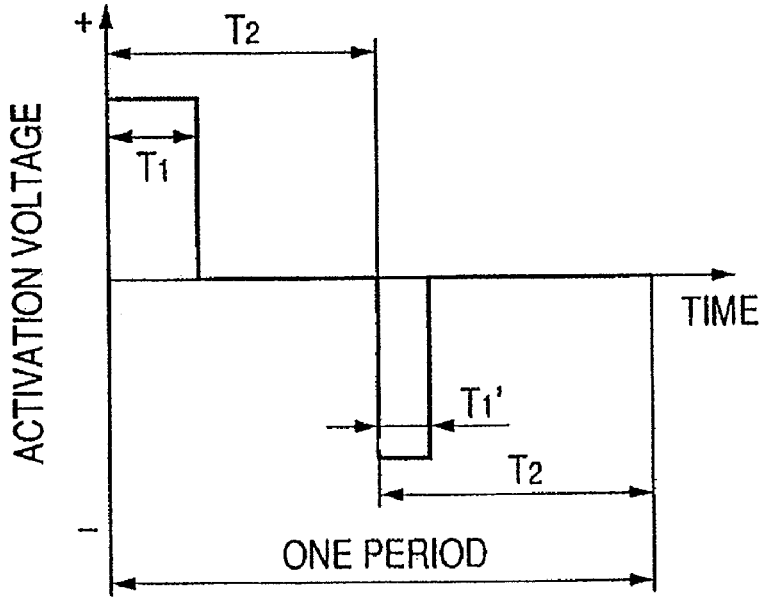

As the voltage waveform applied between the auxiliary electrodes 2 and 3 during the "activation" processing, for example, pulse waveforms shown in FIGS. 12A and 12B can be also used. The maximum voltage value (absolute value) to be applied is preferably suitably selected within a range of from 10 to 25 V.

A reference sign T1 denotes a pulse width of a pulse voltage to be applied, and a reference sign T2 denotes a pulse interval in FIG. 12A. In this example, although the case where the voltage value has the equal positive and the negative absolute values is shown, the voltage value may have different positive and negative absolute values. Moreover, a reference sign T1 denotes the pulse width of a pulse voltage of a positive voltage value, and a reference sign T1' denotes the pulse width of the pulse voltage of a negative voltage value in FIG. 12B. A reference sign T2 denotes a pulse interval. In addition, in this example, although the case where the pulse width T1 and T1' satisfy a relation of T1>T1', and the positive and the negative absolute values of the voltage value are set to be equal, the voltage value may have different positive and negative absolute values. The "activation" processing preferably ends after the rise of the device current If becomes gentle.

Moreover, even if either of the waveforms shown in FIGS. 12A and 12B is used, a quality-changed portion (concave portion) 22 can be formed on the surface of the substrate as shown in FIG. 22E by performing the "activation" processing until the rise of the device current If becomes gentle. The inventor considers the quality-changed portion (concave portion) 22 as follows.

When the temperature of a substrate rises under the condition in which SiO2 (the material of the substrate) exists near to carbon, Si is consumed.

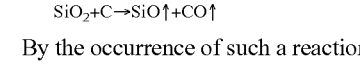

$$SiO_2+C \rightarrow SiO\uparrow+CO\uparrow$$

By the occurrence of such a reaction, Si in the substrate is consumed, and the surface of the substrate (the surface of the first portion 5) is whittled to form a shape (concave portion) having a whittled surface.

If the substrate has the quality-changed portion (concave portion) 22, the creeping distance of the first carbon film 21*a* and the second carbon film 21*b* can be increased. Consequently, it is possible to suppress the generation of a discharge phenomenon and the excessive device current If which are considered to originate in a strong electric field applied between the first carbon film 21*a* and the second carbon film 21*b* at the time of a drive.

The carbon films 21*a* and 21*b* formed by the "activation" processing can be made to be a carbon film containing the graphite-like carbon described with regard to the second embodiment.

It is preferable to performs "stabilization" processing, which is the processing of performing heating in a vacuum, of the electron-emitting device produced by the above processes 1-5 before performing the drive thereof (before radiating an electronic beam to the light-emitting member in the case of applying the electron-emitting device to an image display apparatus).

It is preferable to remove the excessive carbon and the excessive organic materials which have adhered to the surface of the substrate 100 and other positions by the "activation" processing mentioned above by performing the "stabilization" processing.

Specifically, the vacuum chamber is exhausted of the excessive carbon and the excessive organic materials. Although it is preferable to remove the organic materials in the vacuum chamber as much as possible, it is preferable to remove the organic materials up to $1\times10^{-8}$ Ps or less as its partial pressure. Moreover, the total pressure in the vacuum chamber including other gases other than the organic materials is preferably $3\times10^{-6}$ Pa or less.

Although the atmosphere at the time of the end of the "stabilization" process is preferably maintained as the atmosphere at the time of driving the electron-emitting device after performing the "stabilization" processing, the atmosphere is not limited to that one. If the organic materials are sufficiently removed, the sufficiently stable characteristics can be maintained even when the pressure itself is somewhat rises.

The electron-emitting device of the present invention can be formed according to the above process.

In addition, the electron-emitting device of the embodiment shown in FIGS. 4A to 4C can be formed as follows, for example. An example is described using FIGS. 5A to 5E.

Figure 5A:
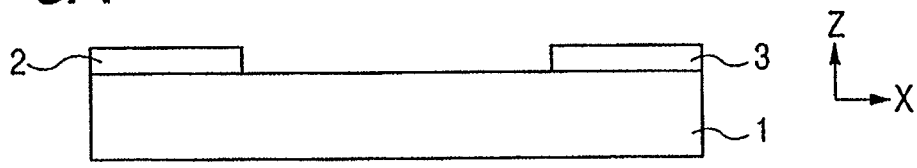
FIGS. 5A, 5B, 5C, 5D and 5E are schematic views showing the outline of a manufacturing method of the electron-emitting device of the present invention.
Figure 5B:
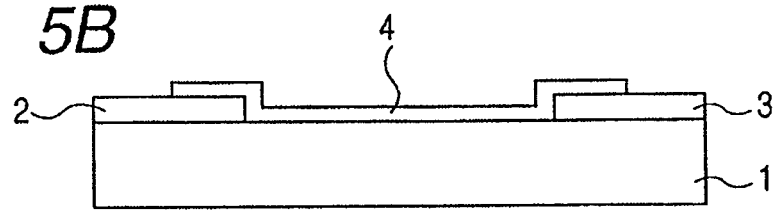
Figure 5C:
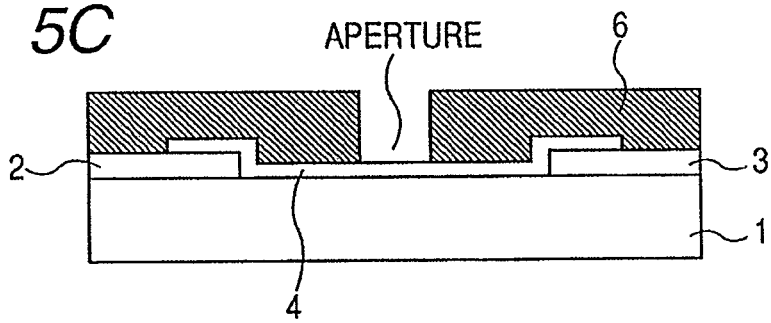
Figure 5D:
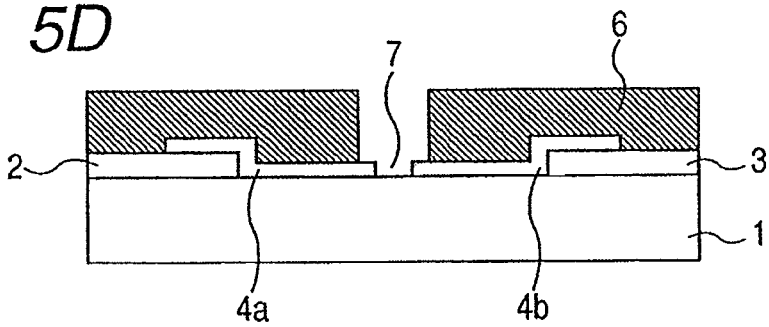
Figure 5E:
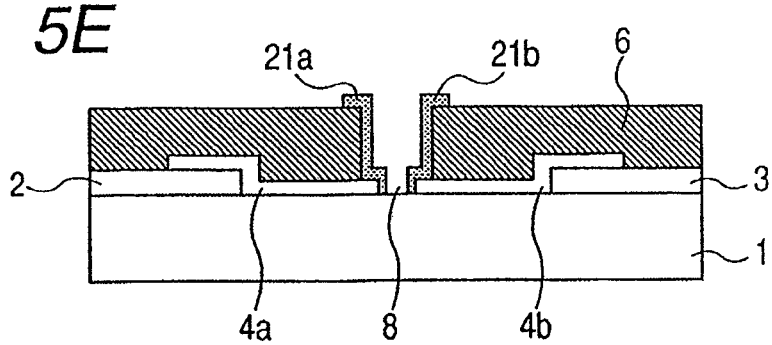

That is, the same processes as the process 2 and the process 3, which have been described above, are preformed on a substrate of the material equivalent to that of the first portion 5, which substrate is used as the substrate 1 described with regard to the process 1 (FIGS. 5A and 5B). Next, a layer 6 made of a material equivalent to that of the second portions 6 described above is formed as a film on the electroconductive film 4. At this time, an aperture is previously formed using the photolithographic technique and the like at a position where the first gap 7 of the layer made of the material equivalent to that of the second portions 6 (FIG. 5C). And by performing the same process as the process 4 mentioned above, the first gap 7 can be formed in the aperture (FIG. 5D). Successively, by performing the same process as the process 5 (FIG. 5*e*), the electron-emitting device having the structure shown in FIGS. 4A to 4C can be acquired.

Moreover, the electron-emitting device of the embodiment shown in FIG. 6B can be formed as follows, for example. An example is described using FIGS. 7A to 7F.

First, a material layer constituting the second portion 6, a material layer constituting the first portion 5, a material layer constituting the second portion 6 are stacked in this order on the substrate 1 described with regard to the process 1 mentioned above. Each of these layers can be deposited on the substrate 1 by the vacuum evaporation method, the sputtering method, the CVD method or the like. Next, the material layer constituting the first auxiliary electrode 2 is deposited on the material layer constituting the second portion 6 by the vacuum evaporation method, the sputtering method, the CVD method or the like (see FIG. 7A).

Figure 7A:
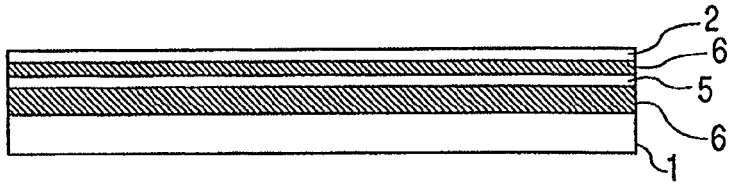
FIGS. 7A, 7B, 7C, 7D, 7E and 7F are schematic views showing the outline of a manufacturing method of the electron-emitting device of the present invention.
Figure 7B:
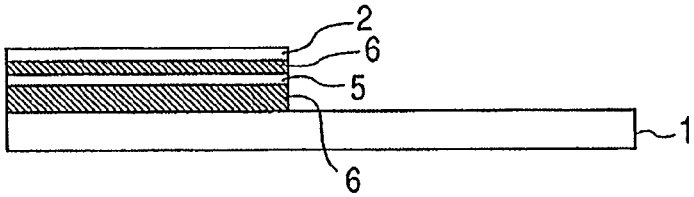

After that, a layered product equipped with a stepped shape is formed by the well-known patterning methods such as the photolithographic technique and the like (FIG. 7B).

Figure 7C:
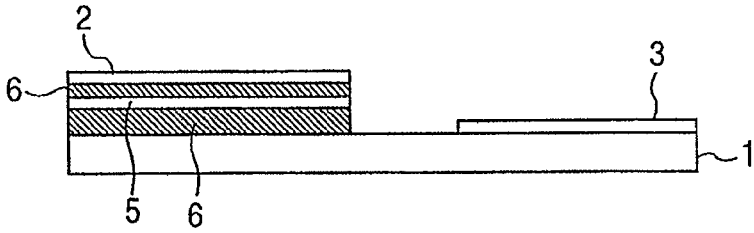

Next, the second auxiliary electrode 3 is formed on the substrate 1 (FIG. 7C).

Figure 7D:
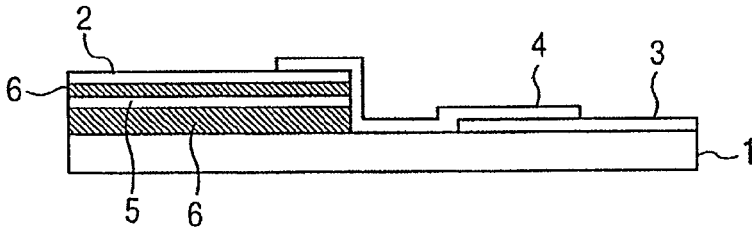
Figure 7E:
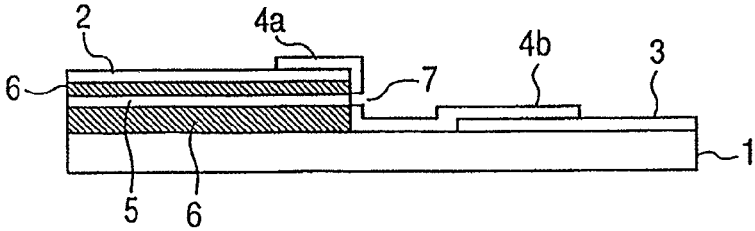
Figure 7F:
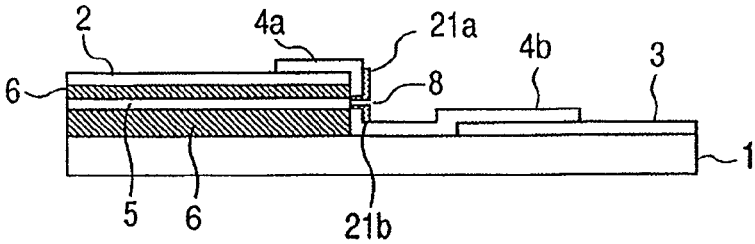

Successively, the electroconductive film 4 is formed similarly to the process 3 mentioned above so that the side surface of the layered product may be covered, and so as to connect between the first auxiliary electrode 2 and the second auxiliary electrodes 3 (FIG. 7D).

Then, the "energization forming" processing and the "activation" processing are performed similarly to the process 4 and process 5 mentioned above (FIGS. 7E and 7F).

The electron-emitting device of the embodiment shown in FIG. 6B can be thus formed. In addition, the example of the form shown in FIG. 6C can be formed by omitting one side of the layers composed of the materials constituting the second portions 6 in the process mentioned above. Moreover, because the example of the form shown in FIG. 6D can be acquired only by further adding of a shifting process of the position of the end of the first auxiliary electrode 2 to the manufacturing method of the example of the form shown in FIG. 6C, the example of the form shown in FIG. 6D can be formed without no problems by adding the patterning process.

In addition, the manufacturing method of the electron-emitting device of the embodiments mentioned above is only examples, and the electron-emitting devices of the first to the fifth embodiments, which have been described above, are not limited to the electron-emitting devices manufactured by the manufacturing method described above.

Next, the basic characteristics of the electron-emitting devices of the present invention shown in the first to the fifth embodiments mentioned above are described with reference to FIG. 13. Typical examples of the relations between the emission current Ie and the device current If of the electron-emitting device of the present invention, which currents are measured by the measurement evaluation apparatus shown in FIG. 10, and the device voltage Vf to be applied to the auxiliary electrodes 2 and 3 are shown in FIG. 13.

Figure 13:
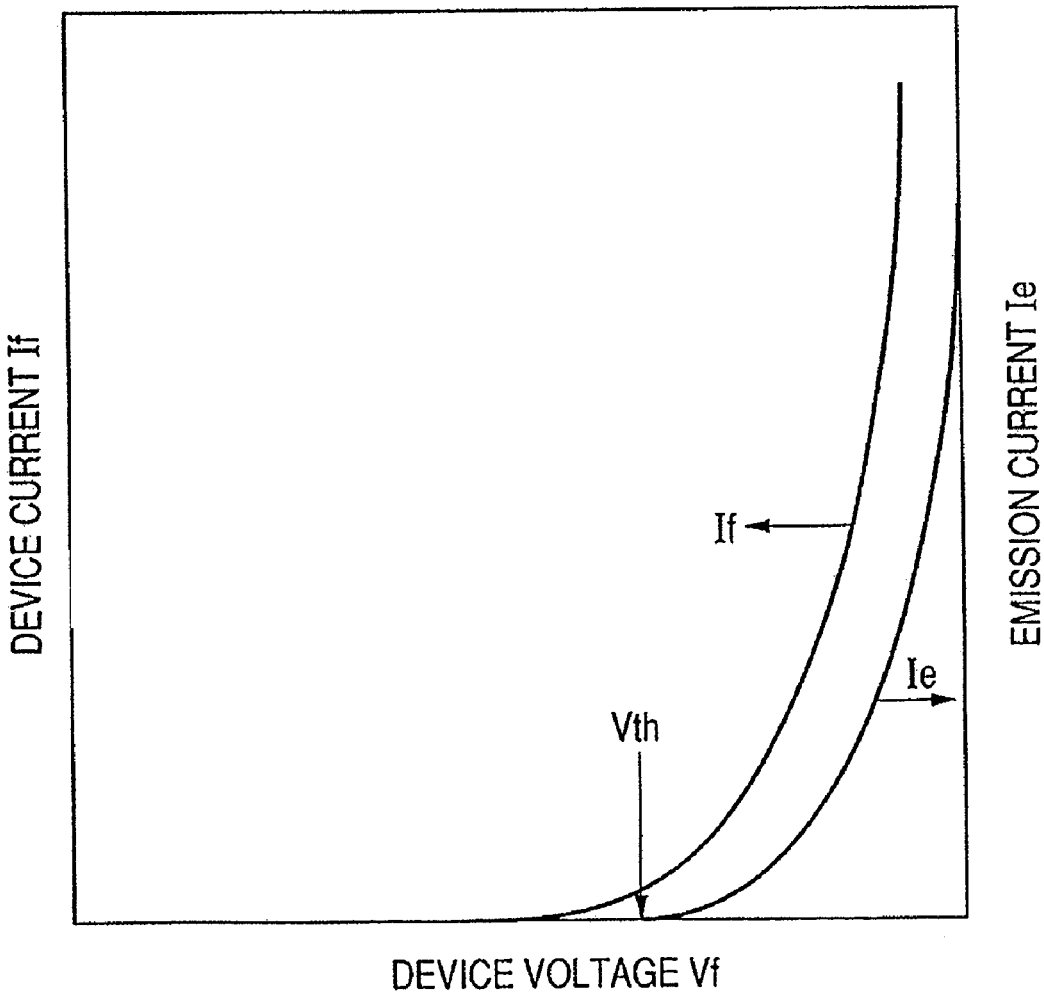
FIG. 13 is a schematic view showing electron emission characteristics of the electron-emitting device of the present invention.

In addition, because the emission current Ie is remarkably small compared with the device current If, FIG. 13 is shown by arbitrary units. The electron-emitting device of the present invention has three natures with regard to the emission current Ie as also apparent from FIG. 13.

First, if a device voltage equal to or more than a certain voltage (called as a threshold voltage: Vth in FIG. 13) is applied, the emission current Ie of the electron-emitting device of the present invention rapidly increases. On the other hand, the emission current Ie can be hardly detected to the device voltages equal to or less than the threshold voltage Vth. That is, the electron-emitting device is a non-linear device with the clear threshold voltage Vth to the emission current Ie.

Second, because the emission current Ie depends on the device voltage Vf, the emission current Ie can be controlled by the device voltage Vf.

Third, emitted charges captured by the anode electrode 44 depend on the time of applying the device voltage Vf. That is, charge quantity captured by the anode electrode 44 can be controlled by the time of applying the device voltage Vf.

By using the above characteristic of the electron-emitting device, the electron emission characteristic can be easily controlled according to an input signal.

Figure 14A:
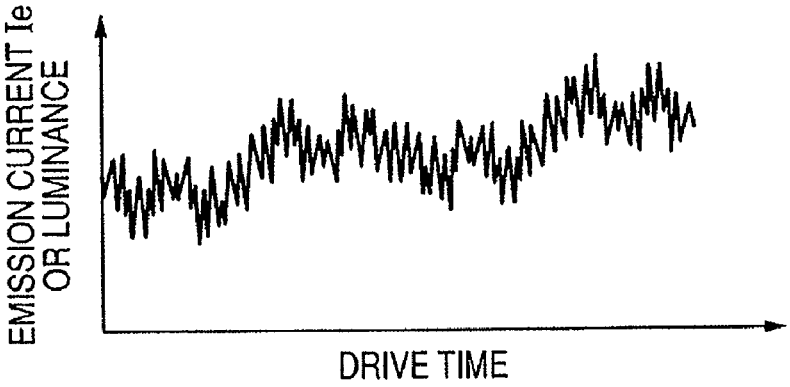
FIGS. 14A, 14B and 14C are schematic views showing drive characteristics of the electron-emitting device of the present invention.
Figure 14B:
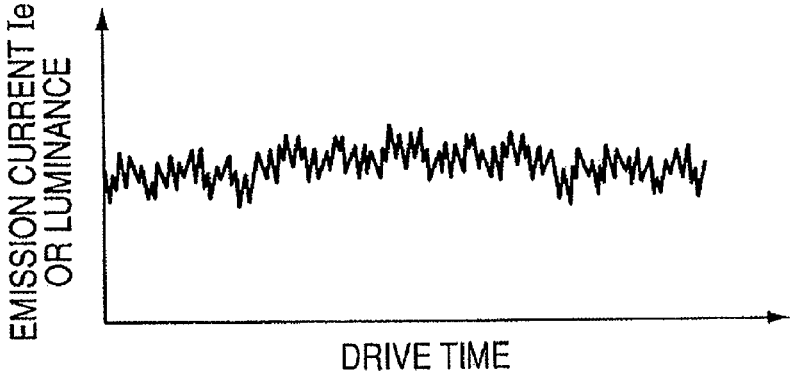
Figure 14C:
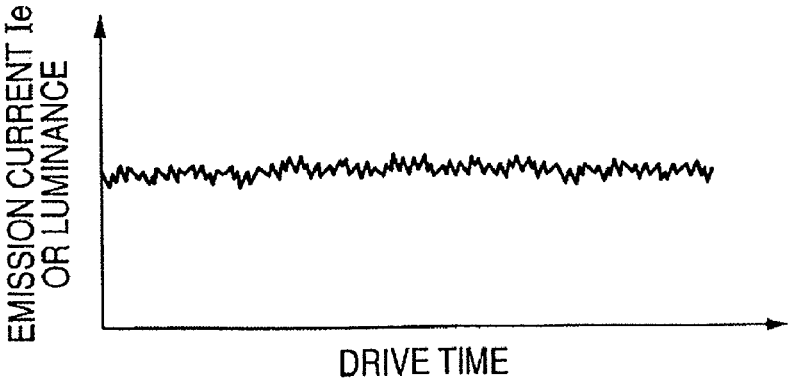

FIGS. 14A to 14C show the emission current Ie (or luminance) at the time of driving an electron-emitting device for a long time. The ordinate axes and the abscissa axes are expressed by the same scale in the FIGS. 14A to 14C.

Figure 8B:
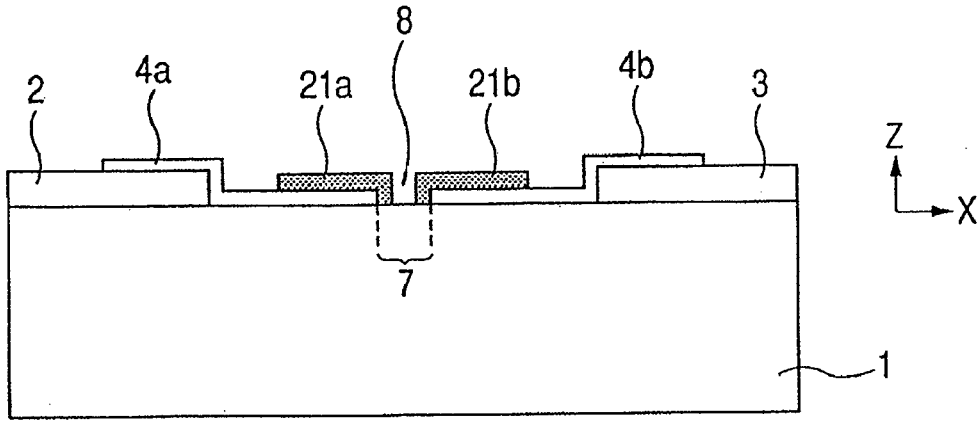

In the case where the meander of the second gap 8 is large (that is, the meander of the first gap 7 is large) like the conventional example shown in FIGS. 8A and 8B, as shown in FIG. 14A, the fluctuation of the emission current Ie (or luminance) is large.

Moreover, FIG. 14B shows the state of the changes of the emission current Ie (or luminance) of the electron-emitting device in which the whole surface of the substrate 100 is made of silicon oxide, although the meander of the second gap 8 is suppressed to be small. FIG. 14B shows the case of a typical structure equivalent to the form in which the first portion 5 and the second portions 6 in the structure shown in FIGS. 1A to 1C are replaced with a single silicon oxide layer. In this case, as shown in FIG. 14B, the fluctuation of the emission current Ie (or luminance) is not sufficient, although the fluctuation is somewhat improved compared with that of FIG. 14A.

FIG. 14C shows the state of the changes of the emission current Ie (or luminance) in the electron-emitting device of the second embodiment shown in FIGS. 1A to 1C. In addition, this characteristic is the same also in the electron-emitting device of other embodiments of the present invention. It is conceivable that the heat produced in the vicinity of the second gap 8 located on the first portion 5 at the time of a drive is immediately diffused to the second portions 6 using a high heat conduction material. As a result, as described with regard to the first embodiment, a local temperature rise at the second gap 8 at the time of a drive and temperature rises of the electroconductive films 4*a*, 4*b*, 21*a* and 21*b* themselves itself are suppressed. Consequently, the inventor considers that, in the electron-emitting device of the present invention, the fluctuation of the emission current (or luminance) is suppressed most.

Next, application examples of the electron-emitting device of the present invention shown in the first to the fifth embodiments described above are described in the following.

By arranging a plurality of the electron-emitting devices of the present invention on a substrate, for example, an electron source and an image display apparatus such as a flat panel type television can be configured.

As an arrangement form of the electron-emitting device on a substrate, for example, a matrix type arrangement is cited. In this arrangement form, the first auxiliary electrode 2 mentioned above is connected to one of m wires of X direction wiring arranged on the substrate. And the second auxiliary electrode 3 mentioned above is electrically connected to one of n wires of Y direction wiring arranged on the substrate. In addition, m and n are both positive integers.

Figure 15:
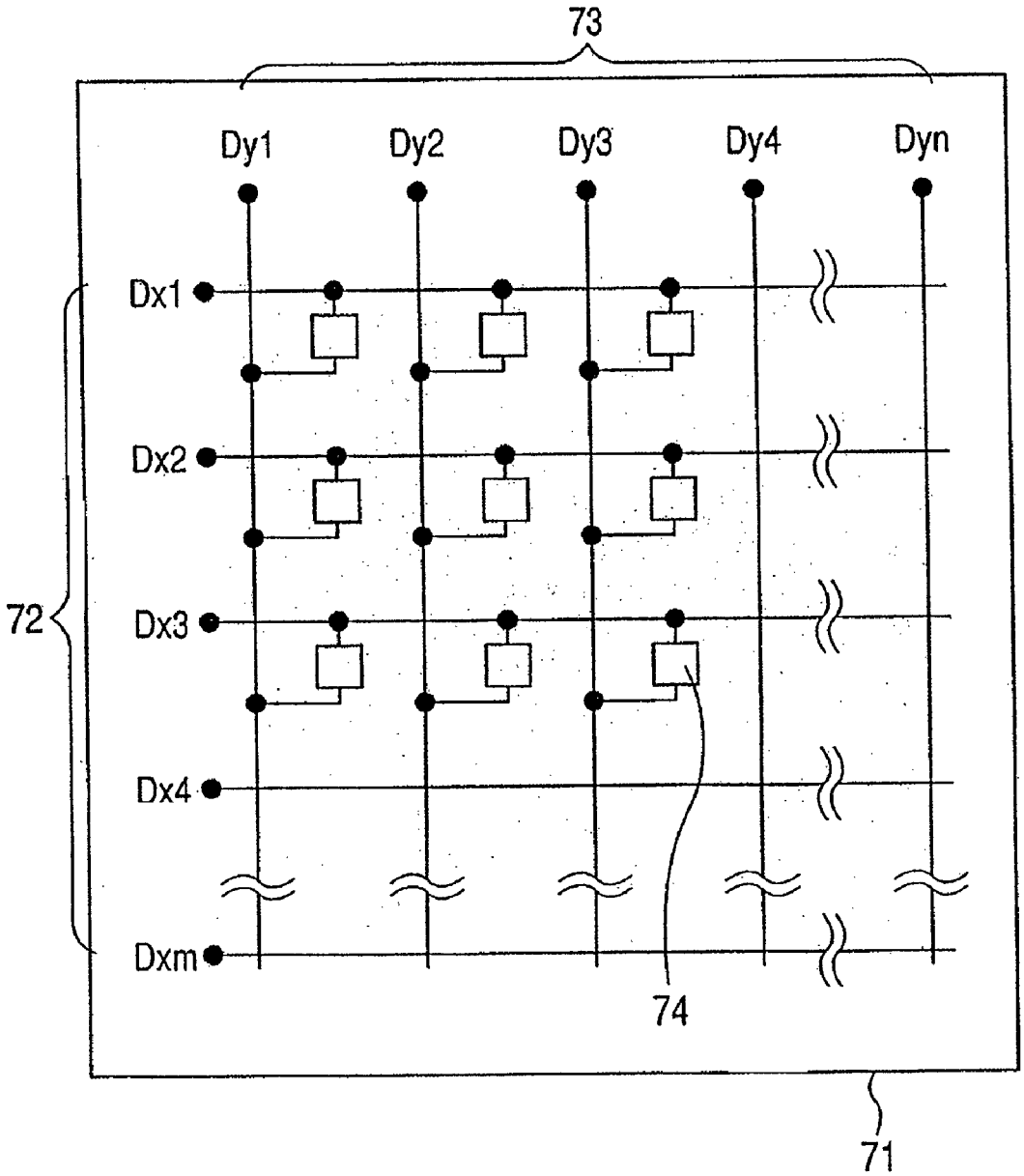
FIG. 15 is a schematic view for illustrating an electron source substrate using the electron-emitting device of the present invention.

Next, the configuration of the electron source substrate of the matrix type arrangement is described using FIG. 15.

The m wires of the X direction wiring 72 mentioned above is composed of Dx1, Dx2, . . . , Dxm, and are formed on the insulation substrate 71 by the vacuum evaporation method, the printing method, the sputtering method and the like. The X direction wiring 72 is made of an electroconductive material such as a metal. The n wires of the Y direction wiring 73 is composed of n wires of Dy1, Dy2, . . . , Dyn, and can be formed by the same technique and same materials as those of the X direction wiring 72. A not shown insulating layer is arranged at each portion between the m wires of the X direction wiring 72 and the n wires of the Y direction wiring 73 (intersection part). The insulating layer can be formed by the vacuum evaporation method, the printing method, the sputtering method and the like.

Moreover, not shown scanning signal applying means for applying a scanning signal is electrically connected to the X direction wiring 72. On the other hand, not shown modulating signal generating means for applying a modulating signal for modulating the electrons emitted from each electron-emitting device 74 selected synchronously with the scanning signal is electrically connected to the Y direction wiring 73. A drive voltage Vf applied to each electron-emitting device is supplied as a difference voltage between the applied scanning signal and the modulating signal.

Figure 16:
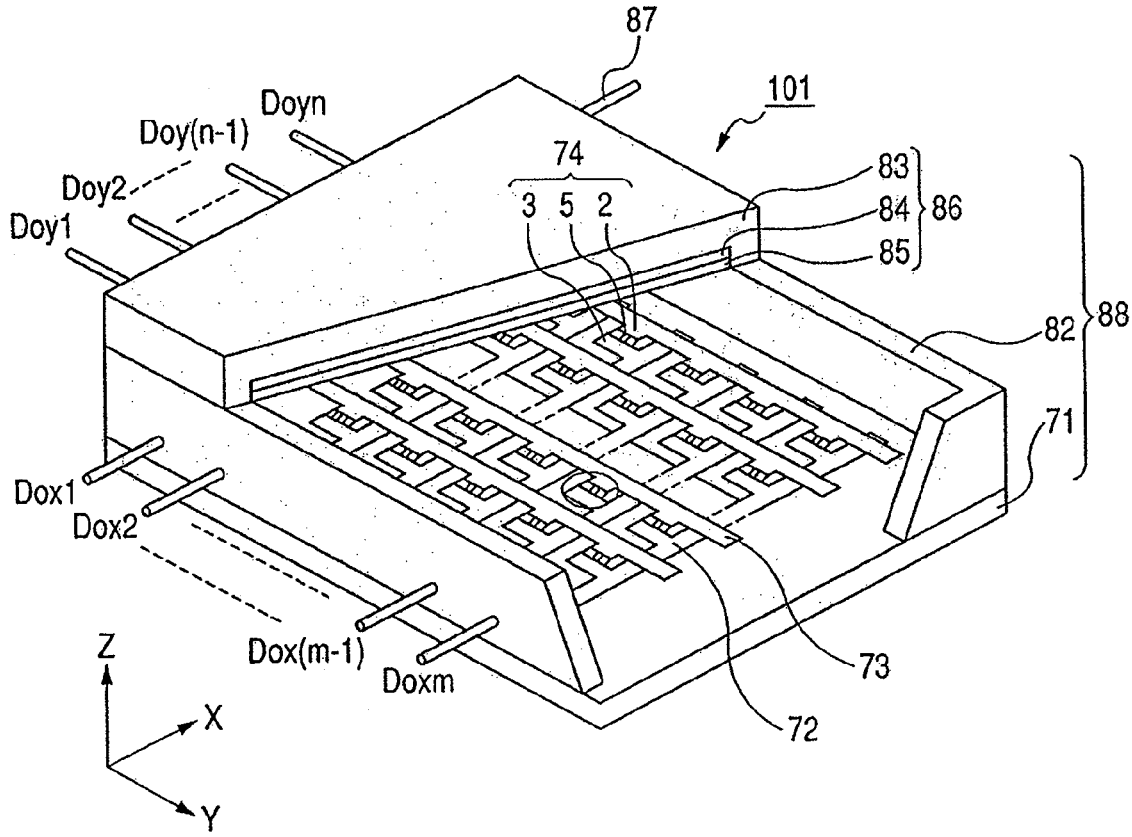
FIG. 16 is a schematic view for illustrating the configuration of an example of the image display apparatus using the electron-emitting device of the present invention.

Next, examples of an electron source and an image display apparatus using the electron source substrate of the above matrix arrangement are described with reference to FIGS. 16, 17A and 17B. FIG. 16 is a basic configuration diagram of envelope (display panel) 88 constituting an image display apparatus, and FIGS. 17A and 17B are schematic view showing the configuration of phosphor films.

In FIG. 16, a plurality of electron-emitting devices 74 of the present invention is arranged in a matrix on an electron source substrate (rear plate) 71. A face plate 86 is composed of a transparent substrate 83 made of glass or the like, on the inner surface of which alight-emitting member (phosphor film) 84, an electroconductive film 85 and the like are formed. A supporting frame 82 is arranged between the face plate 86 and the rear plate 71. The rear plate 71, the supporting frame 82 and the face plate 86 are sealed with one another by giving an adhesive such as frit glass, indium or the like to their joining regions. The envelope (display panel) 88 is composed of the sealed structure. In addition, the above electroconductive film 85 is a member corresponding to the anode 44 described with reference to FIG. 10.

The envelope 88 can be composed of a face plate 86, a supporting frame 82 and a rear plate 71. Moreover, the envelope 88 which has sufficient strength to the atmospheric pressure can be constituted by installing not shown support members called as spacers between the face plate 86 and the rear plate 71.

Figure 17A:
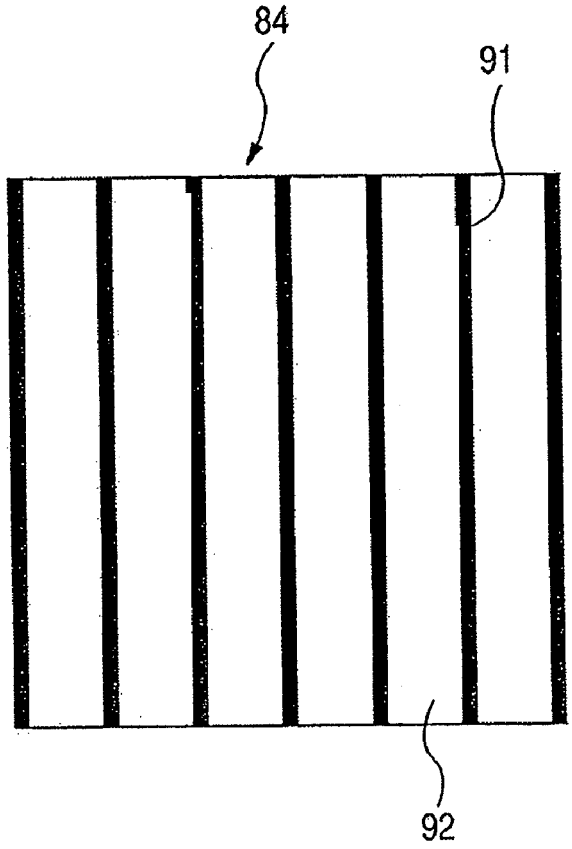
FIGS. 17A and 17B are schematic views for illustrating phosphor films.
Figure 17B:
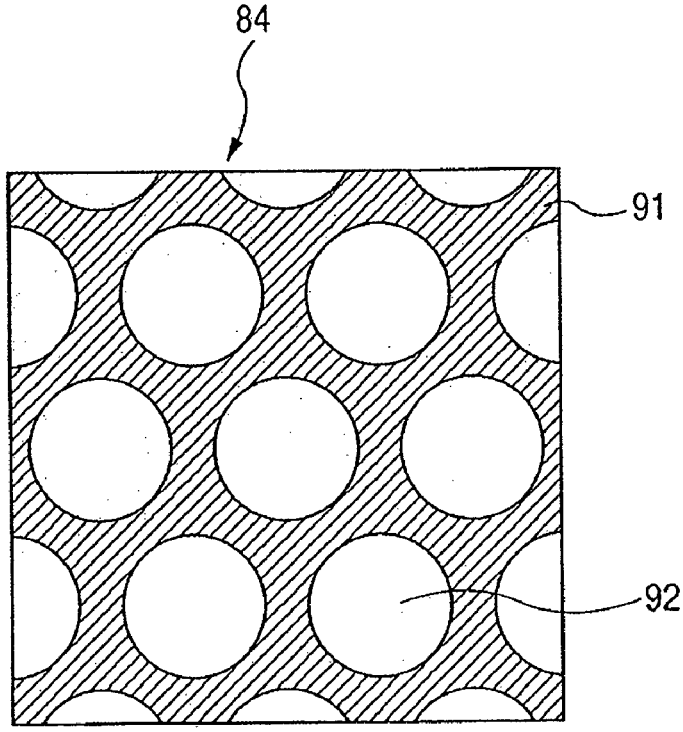

FIGS. 17A and 17B severally show concrete configuration examples of the light-emitting member (such as a phosphor film) 84 shown in FIG. 16. In the case of monochrome, the light-emitting member (such as a phosphor film) 84 consists of only a monochromatic phosphor 92. In case of constituting a color image display apparatus, the phosphor film 84 includes at least a phosphor 92 of the three primary colors of R, G and B, and a light absorption members 91 arranged between each color. A black member can be preferably used for the light absorption members 91. FIG. 17A shows a form arranging the light absorption members 91 in a stripe. FIG. 17B shows a form arranging the light absorption members 91 in a matrix. Generally, the form of FIG. 17A is called as a "black stripe", and the form of FIG. 17B is called as a "black matrix." The objects of providing the light absorption members 91 are obscuring color mixture and the like at toned portions between each phosphor 92 of the three primary color phosphor, which becomes necessary at the time of color display, and suppressing the decrease of contrast owing to the reflection of external light by the phosphor film 84. As the materials of the light absorption member 91, not only a material containing graphite as the principal component, which is frequently used ordinarily, but also any materials, as long as they have a property of little transmission and reflection of light, can be used. Moreover, the materials may have electrical conductivity or insulative.

Moreover, the electroconductive film 85 called as a "metal back" or the like is provided on the inner surface side (electron-emitting device 74 side) of the phosphor film 84. The objects of the electroconductive film 85 is improving luminance by performing the mirror reflection of the light proceeding toward the electron-emitting device 74 among the light emitted from the phosphor 92 to the face plate 86 side. Moreover, the other objects are to operate as the anode 44 for applying an electron beam accelerating voltage, and to suppress the damage of the phosphor caused by collisions of negative ions generated in the envelope 88.

The electroconductive film 85 is preferably formed of an aluminum film. The electroconductive film 85 can be produced by performing smoothing processing (usually called as "filming") of the surface of the phosphor film 84 after the production of the phosphor film 84, and by depositing Al thereon by vacuum evaporation or the like.

In order to raise the electrical conductivity of the phosphor film 84 furthermore, a transparent electrode (not shown) made of ITO or the like may be formed between the phosphor film 84 and the transparent substrate 83 on the face plate 86.

Each of the electron-emitting devices 74 in the envelope 88 is connected to the X direction wiring 72 and the Y direction wiring 73, which have been mentioned above with reference to FIG. 15. Consequently, it is possible to emit electrons from a desired electron-emitting device 74 by applying a voltage through terminals Dox1-Doxm and Doy1-Doyn connected to each of the electron-emitting devices 74. At this time, a voltage within a range of from 5 kV to 30 kV, both inclusive, preferably within a range of from 10 kV to 25 kV, both inclusive, is applied to the electroconductive film 85 through a high-voltage terminal 87. In addition, the interval between the face plate 86 and the substrate 71 is set to be within a range of from 1 mm to 5 mm, both inclusive, preferably within a range of from 1 mm to 3 mm, both inclusive. By performing such a configuration, the electrons emitted from a selected electron-emitting device transmit the metal back 85, and collide with the phosphor film 84. Then, the electrons excite the phosphor 92 to make it emit light, and thereby an image is displayed.

In addition, in the configuration described above, the detailed portions such as the material of each member are not restricted to the contents mentioned above, and can be suitably changed according to an object.

Moreover, an information display apparatus can be configured using the envelope (display panel) 88 of the present invention described with reference to FIG. 16.

To put it concretely, the information display apparatus includes a receiving apparatus and a tuner tuning a received signal, and displays or reproduces the signal included in the tuned signal on a screen by outputting the signal to the display panel 88. The receiving apparatus can receive broadcast signals of television broadcasting and the like. Moreover, the signal included in the tuned signal indicates at least one of image information, character information and audio information. In addition, it can be said that the above "screen" corresponds to the phosphor film 84 in the display panel 88 shown in FIG. 16. This configuration can constitute the information display apparatus such as a television. It is of course, when a broadcast signal is encoded, the information display apparatus of the present invention can also include a decoder. Moreover, an audio signal is output to audio reproduction means such as a speaker, which is separately provided, and can be reproduced synchronously with the image information and the character information to be displayed on the display panel 88.

Moreover, as a method of outputting the image information or the character information to the display panel 88 to display and/or reproduce on the screen, the method can be performed as follows, for example. First, an image signal corresponding to each pixel of the display panel 88 is generated from the received image information or the received character information. And the generated image signal is input into a drive circuit C12 of a display panel C11. Then, based on the image signal input into the drive circuit C12, the voltage applied to each electron-emitting device 74 in the display panel 88 from the drive circuit C12 is controlled, and an image is displayed.

Figure 23:
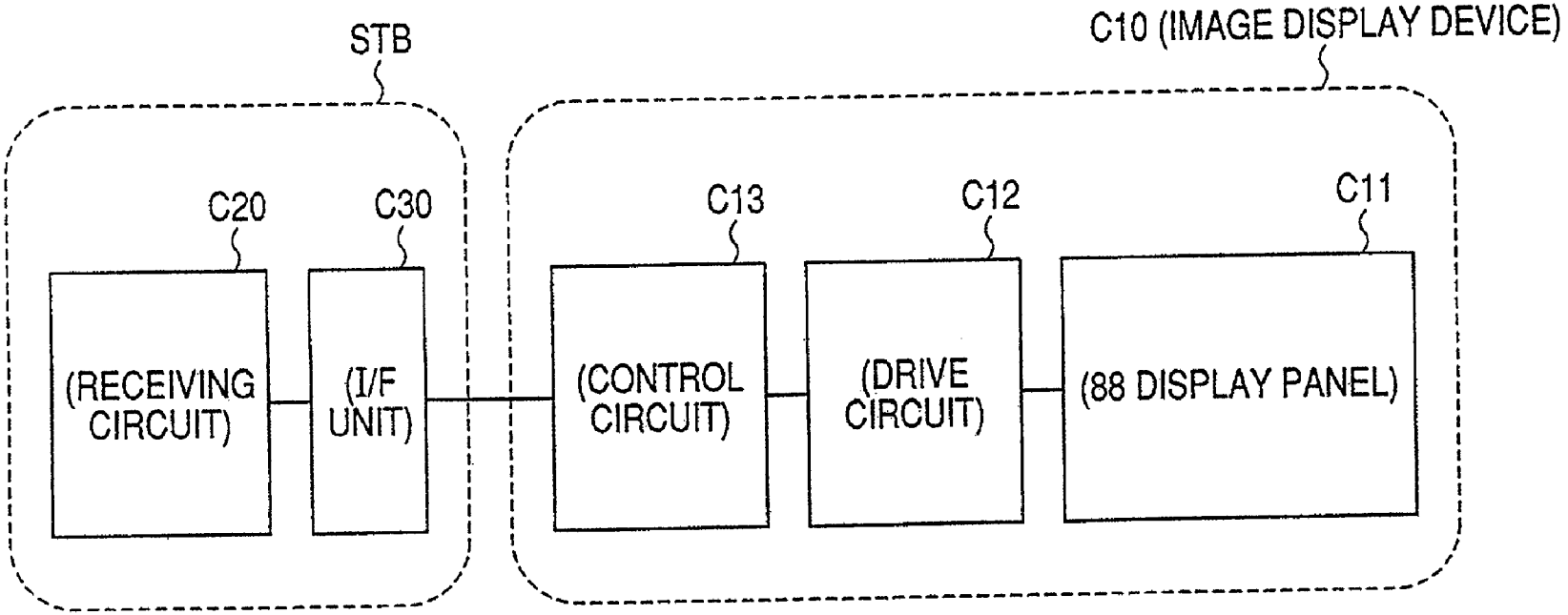
FIG. 23 is a block diagram of a television apparatus of the present invention.
Figure 24A:
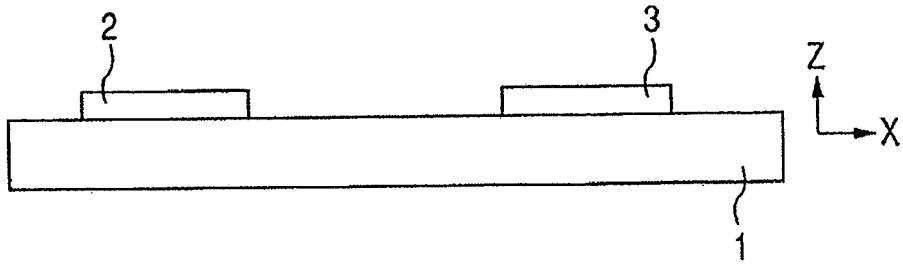
FIGS. 24A, 24B, 24C and 24D are schematic views showing an example of a manufacturing process of a conventional electron-emitting device.
Figure 24B:
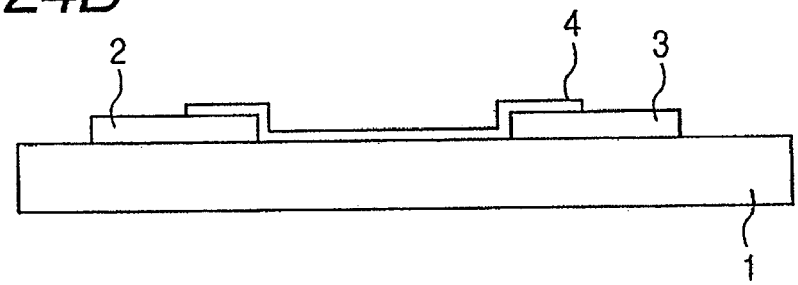
Figure 24C:
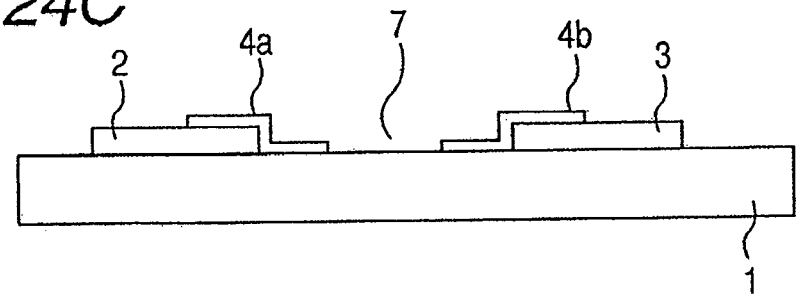
Figure 24D:
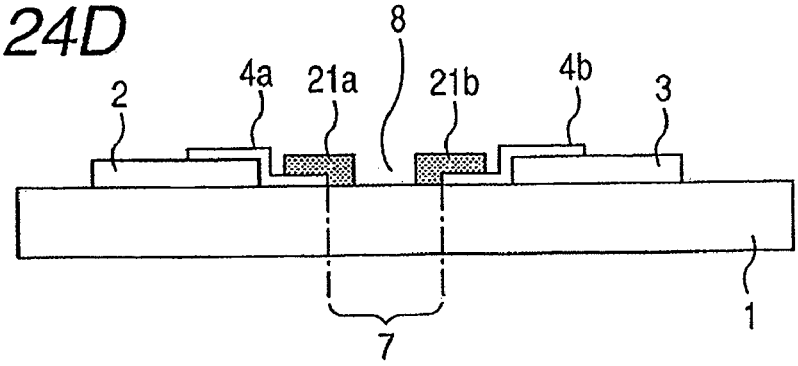

FIG. 23 is a block diagram of a television apparatus according to the present invention. A receiving circuit C20 composed of a tuner, a decoder and the like receives television signals such as satellite broadcasting, a ground wave and the like, data broadcasting through a network, and the like, and outputs decoded image data to an interface (I/F) unit C30. The I/F unit C30 converts the image data into a display format of a display device C10, and outputs image data to the display panel C11. The image display apparatus C10 includes the display panel C11, the drive circuit C12 and a control circuit C13. The control circuit C13 performs image processing such as correction processing suitable for the display panel to the input image data, and outputs the corrected image data and various control signals to the drive circuit C12. The drive circuit C12 outputs a drive signal to each wiring (refer to Dox1-Doxm and Doy1-Doyn of FIG. 16) of the display panel C11 based on the input image data, and a television image is displayed. The receiving circuit C20 and the I/F unit C30 may be stored in different housing from that of the image display apparatus C10 as a set top box (STB), or may be stored in the same housing as that of the image display apparatus 10.

Moreover, the I/F unit C30 can also be configured so as to be able to be connected with an image recording apparatus or an image output apparatus such as a printer, a digital video camera, a digital camera, a hard disk drive (HDD), a digital vide disk (DVD) and the like. And such a configuration enables a display of an image recorded on the image recording apparatus on the display panel C11. Moreover, it is possible to configure an information display apparatus (or a television) capable of processing an image displayed on the display panel C11 on occasion to output the processed image to the image output apparatus.

The configuration of the information display apparatus described here is an example, and various kinds of modification can be performed based on the sprit of the present invention. Moreover, the information display apparatus of the present invention can configure various information display apparatus by connecting with systems such as a TV conference system and a computer.

EXAMPLES

In the following, examples are cited to describe the present invention more minutely.

Example 1

The present example shows an example of producing the electron-emitting device described with regard to the second embodiment. The configuration of the electron-emitting device of this example is the same as that of FIG. 1. In the following, the basic configuration and a manufacturing method of the electron-emitting device of the present example are described with reference to FIGS. 1 and 2.

(Process-a)

First, a photoresist layer including an aperture corresponding to the pattern of the second portions 6 was formed on a cleaned quartz substrate 1. After that, concave portions of a pattern corresponding to the second portions 6 were formed on the surface of the substrate 1 using the dry etching method. Thus, five same substrates 1 were prepared.

After that, $Si_3N_4$, AlN, $Al_2O_3$, $TiO_2$ and $ZrO_2$ were deposited on the concave portions corresponding to the second portions 6 of each of the substrates 1 so that the material used for each substrate 1 might differ from each other. $Si_3N_4$ was formed by plasma CVD method, and AlN, $Al_2O_3$, $TiO_2$ and $ZrO_2$ were formed by the sputtering method. In the example, the first portion 5 was formed of quartz.

At the same time, quartz substrates for measuring a resistivity and heat conductance were prepared, and each material was also deposited on the substrates similarly to the method mentioned above. Then, the resistivity and the heat conductance of each one were measured to obtain the following results.

The resistivities at the room temperature were: $5\times10^{13}$ Ωm to AlN; $1\times10^{13}$ Ωm to $Si_3N_4$; $2\times10^{13}$ Ωm to $Al_2O_3$; and $1\times10^{8}$ Ωm to $ZrO_2$. Moreover, the heat conductances at a room temperature were: 200 W/m·K; 25 W/m to AlN; 25 W/m·K to $Si_3N_4$; 18 W/m·K to $Al_2O_3$; 6 W/m·K to $TiO_2$; and 4 W/m·K to $ZrO_2$. Moreover, the resistivity of the quartz substrate 1 was $1\times10^{14}$ Ωm or more, and the heat conductance thereof was 1.4 W/m·K.

Each of the materials was deposited so that the surfaces of the second portions 6 and the first portion 5 may become almost even.

Subsequently, the photoresist pattern was dissolved by an organic solvent, and the lift-off of the deposited film on the photoresist was performed. Thereby, the substrate 100 arranged so that the second portions 6 might put the first portion 5 between them was obtained (FIG. 2A).

In addition, the width L2 of the first portion was made to be 5 μm, and the thicknesses of the second portions 6 were made to be 2 μm.

Moreover, a substrate on which the first portion 5 and the second portions 6 were not formed (namely, only the quartz substrate 1) was prepared as a comparative example 1. Moreover, as also comparative example 1', the substrates 1 on which each of the materials was not patterned but was deposited (the whole surface was made to be the second portions 6) was prepared (Process-b)

Next, the auxiliary electrodes 2 and 3 which consist of Ti of a thickness of 5 nm and Pt of a thickness of 45 nm were formed on each substrate 100 of the present example and the comparative examples 1 and 1'. The interval L1 was set to 20 μm.

In addition, the center of the first portion 5 was formed so as to be almost the center of the auxiliary electrodes 2 and 3 in each substrate. Moreover, the width W (see FIGS. 1A to 1C) of the auxiliary electrodes 2 and 3 was set to 500 μm (FIG. 2B) in each substrate.

(Process-c)

Successively, organic palladium compound solution was coated by spin-coating method on each substrate 100 which had been subjected to the process-a and the process-b before performing baking processing. In this manner, the electroconductive film 4 which contains Pd as the main element was formed on each substrate. Successively, the patterning of the electroconductive film 4 was performed to form the electroconductive film 4 so as to connect the first auxiliary electrode 2 and the second auxiliary electrode 3 with each other (FIG. 2C). The sheet resistance (Rs) of the formed electroconductive film 4 was $1\times10^{4}$ Ω/□, and the film thickness was set to 10 nm.

(Process-d)

Next, each substrate 100 which had been subjected to the process-a to the process-c mentioned above was set in the vacuum chamber of FIG. 10, and the vacuum chamber was exhausted to become the degree of vacuum of $1\times10^{-6}$ Pa in the inside thereof. After that, a voltage Vf was applied between the first auxiliary electrode 2 and the second auxiliary electrode 3 using a power source 41 to perform the "energization forming" processing. As a result, the first gap 7 was formed in the electroconductive film 4 to form the electrodes 4*a* and 4*b* (FIG. 2D). In addition, the voltage waveform shown in FIG. 11B was used as the voltage waveform in the "energization forming" processing. In the present example, the pulse width T1 was set to 1 msec, and the pulse interval T2 was set to 16.7 msec. Moreover, the peak value of the triangular wave was boosted by 0.1 V step to perform the "energization forming." In addition, the end of the "energization forming" processing was made to be the time when the measured value between the first auxiliary electrode 2 and the second auxiliary electrode 3 had become about 1 MΩ or more.

(Process-e)

Successively, the "activation" processing was performed. Specifically, tolunitrile was introduced into the vacuum chamber. After that, a pulse voltage of the waveform shown in FIG. 12A was applied between the auxiliary electrodes 2 and 3 under the conditions in which the maximum voltage value was ±20V, the pulse width T1 was 1 msec, and the pulse interval T2 was 10 msec. After the start of the "activation" processing, it was ascertained that the device current If had entered a gentle rise, and the application of the voltage was stopped to end the "activation" processing. As a result, the carbon films 21*a* and 21*b* were formed (FIG. 2E).

Each of the electron-emitting devices was formed by the above process.

Thus, the same processing of the process-b to process-e was performed to each of the substrates 100 having the second portions 6 of AlN, $Si_3N_4$, $Al_2O_3$, $TiO_2$ and $ZrO_2$, respectively, and each of the substrates 100*a* of the comparative examples 1 and 1'. Moreover, ten electron-emitting devices were produced on each substrate 100 by the same manufacturing method.

Moreover, in the present example, because the resistivity of each material used for the second portions 6 was $10^8$ Ωm or more, no discharges which give a serious damage during the "activation" processing were generated.

(Process-f)

Next, the "stabilization" processing was performed to each electron-emitting device. To put it concretely, the exhausting of the vacuum chamber was continued while maintaining the temperatures of the vacuum chamber and the electron-emitting device at about 250° C. by heating the vacuum chamber and the electron-emitting device with the heater. After 20 hours, the heating by the heater was stopped and the temperatures were returned to the room temperature. Then, the pressure in the vacuum chamber reached about $1\times10^{-8}$ Pa.

Successively, the measurements of the emission current Ie and the luminance of each electron-emitting device were performed with the measurement apparatus shown in FIG. 10.

In the measurements of the emission current Ie and the luminance, a distance H between the anode electrode 44, on which phosphor had been coated beforehand, and the electron-emitting device was set to 2 mm, and the potential of 5 kV was applied to the anode electrode 44 by a high voltage power supply 43. In this state, a rectangle pulse voltage of a peak value of 17 V was applied between the first auxiliary electrode 2 and the second auxiliary electrode 3 of each electron-emitting device using the power supply 41.

In addition, at the time of this measurement, the emission current Ie of each of the electron-emitting devices of the present example and the comparative examples was measured with an ammeter 42, and the phosphor luminance thereof was measured from a transparent glass window (not shown) provided in the vacuum chamber. The "dispersion" of the measured emission currents Ie and the measured luminance are shown in the following table 1. Hereupon, the "dispersion" means a value expressed by (standard deviation/mean value×100(%)) of the emission currents Ie and the luminance of the ten electron-emitting devices formed on each of the substrates 100.

TABLE 1

| | MATERIAL OF SECOND PORTIONS 6 | THERMAL CONDUCTIVITY (W/m · K) | DISPERSION OF Ie (%) | DISPERSION OF LUMINANCE (%) |
|---|---|---|---|---|
| COMPARATIVE EXAMPLE 1 | NONE ($SiO_2$) | 1.4 | 8.0 | 8.0 |
| COMPARATIVE EXAMPLE 1' | $ZrO_2$ | 4 | 8.2 | 8.2 |
| | $TiO_2$ | 6 | 8.1 | 8.1 |
| | $Al_2O_3$ | 18 | 8.0 | 8.0 |
| | $Si_3N_4$ | 25 | 7.9 | 7.9 |
| | AlN | 200 | 8.0 | 8.0 |

TABLE 1-continued

| | MATERIAL OF SECOND PORTIONS 6 | THERMAL CONDUCTIVITY (W/m · K) | DISPERSION OF Ie (%) | DISPERSION OF LUMINANCE (%) |
|---|---|---|---|---|
| PRESENT EXAMPLE | $ZrO_2$ | 4 | 7.2 | 7.2 |
| | $TiO_2$ | 6 | 4.6 | 4.6 |
| | $Al_2O_3$ | 18 | 4.5 | 4.5 |
| | $Si_3N_4$ | 25 | 4.4 | 4.4 |
| | AlN | 200 | 4.0 | 4.0 |

As shown in the Table 1, the "dispersion" of the emission currents Ie and the "dispersion" of the luminance of the electron-emitting devices of the present example were remarkably reduced in comparison with those of the comparative example 1. Moreover, the emission current Ie of the electron-emitting device of the comparative example 1 was particularly larger than those of the electron-emitting devices of the comparative example 1' between the electron-emitting devices of the comparative examples 1' and 1. However, with regard to the "dispersion", there were not so much remarkable differences between the electron-emitting devices of the comparative examples 1' and 1.

In the electron-emitting device of the present example which used $ZrO_2$ for the second portions 6, the "dispersion" of the emission current Ie and the "dispersion" of the luminance differed from those of the electron-emitting device of the comparative example 1' not so much. However, with regard to the emission currents Ie, such far big emission currents Ie, up to the degree of the difference of a digit, were able to be obtained in the electron-emitting devices of the present example in comparison with the electron-emitting devices of the comparative example 1'. This appears that the electron-emitting devices of the present embodiments used the "activation" processing for the producing process, and that the electron-emitting devices of the comparative example 1' did not use silicon oxide directly under the first gaps 7 (first potions 5). That is, it is presumed that each electron-emitting device of the comparative example 1' could not perform the sufficient "activation" processing.

Moreover, when the heat conductances of the second portions 6 are at least four times as large as the heat of the first portions 5 among the electron-emitting devices of the present example, it is found that there is a remarkable effect in the suppressing of dispersion.

After performing the measurements of the emission currents Ie and the luminance, the vicinity of the second gap 8 of each electron-emitting device was observed with a scanning electron microscope (SEM).

In each electron-emitting device Of the comparative example 1, the electron-emitting region (gap 8) large meandered as shown in FIG. 8A. Moreover, in each electron-emitting device of the comparative example 1', the deposition of the carbon films 21*a* and 21*b* was dispersed, and also the second gap 8 large meandered.

On the other hand, in each electron-emitting device of the present embodiments, the second gap 8 was effectively fitted in the width L2 of the first portion 5 as shown in FIG. 1A except for the example in which $ZrO_2$ was used for the second portions 6. However, in the example in which $ZrO_2$ was used for the second portions 6, there was a portion at which a part of the second gap 8 in the X-Y protruded from the region immediately above the first portion 5 a little as shown in FIG. 27. However, in the region immediately above the first portion 5, no remarkable dispersion was found in the amount of deposition of the carbon films 21*a* and 21*b*. And dispersion was found in the deposition of the carbon films at the portion protruded from the region immediately above the first portion 5 a little. Consequently, it is presumed that no effective electron-emitting regions exist in the portion protruded from the region immediately above the first portion 5 a little, and that the electron-emitting regions are fitted in the region immediately above the first portion 5.

Example 2

In the present example, the electron-emitting devices of the configuration shown in FIGS. 1A to 1C were produced by the same method as the manufacturing method described with regard to the example 1. Materials, sizes and the like which were used are the same as those of the example 1. Moreover, the electron-emitting device of the comparative example 1 was also formed by the same method as that described with regard to the example 1 here.

However, an electron-emitting device of a comparative example 2 was created by the following methods here. First, the process-b and the process-c of the example 1 were performed to the quartz substrate 1. Similarly to the comparative example 1 in the example 1, the first portion 5 and the second portions 6 were not arranged to the substrate 100 of the comparative example 2. Next, the first gap 7 extending in the Y direction at almost the center of the first auxiliary electrode 2 and the second auxiliary electrode 3 as shown in FIGS. 1A to 1C and the like with the FIB. That is, the first electrode 4*a* and second electrode 4*b* were formed. In addition, the formed gap 7 was formed so as to be fitted in the same range as the range of the width L2 of the first portion 5 of the example 1. After that, the same processes as the process-d and the process-e of the example 1 were preformed. By the process described above, ten electron-emitting devices of the comparative example 2 were formed on the quartz substrate 1.

In the present example, the "fluctuation" of the electron emission quantity Ie and the luminance of each electron-emitting device formed in this manner were measured.

In addition, the "fluctuation" was measured by performing a practical drive to each electron-emitting device to measure the emission current Ie and the luminance over a long time. In the practical drive, the anode electrode 44, to which phosphor had been provided beforehand, was prepared similarly to the measurements described with regard to the example 1. And the distance H between the anode electrode 44 and the electron-emitting device was set to 2 mm, and the potential of 5 kV was applied to the anode electrode 44 with the high voltage power supply 43. And a voltage pulse of a rectangular shape having a peak value of 15 V, a pulse width of 100 μs and a frequency of 60 Hz was repeatedly applied from the power source 41 to between the first auxiliary electrode 2 and the second auxiliary electrode 3 of each electron-emitting device.

With the ammeter 42, the emission currents Ie of the electron-emitting devices of the present example, the electron-emitting devices of the comparative example 1 and the comparative example 2 were measured, and the luminescence luminance of phosphors was measured from the transparent glass window (not shown) formed in the vacuum chamber.

The fluctuation values of the emission currents Ie and the luminance were acquired by calculating (standard deviation/mean value×100(%)) of a plurality pieces of data acquired by the measurements performed a plurality of times with the same measurement interval in all of the electron-emitting devices.

The values of the fluctuation of the emission current Ie and the luminance of each electron-emitting device are shown in the following Table 2.

TABLE 2

| | MATERIAL OF PORTION 2 | THERMAL CONDUCTIVITY (W/m · K) | Ie FLUCTUATION (%) | LUMINANCE FLUCTUATION (%) |
|---|---|---|---|---|
| COMPARATIVE EXAMPLE 1 | NONE ($SiO_2$) | 1.4 | 8.5 | 8.5 |
| COMPARATIVE EXAMPLE 2 | NONE ($SiO_2$) | 1.4 | 6.3 | 6.3 |
| PRESENT EXAMPLE | $ZrO_2$ | 4 | 6.0 | 6.0 |
| | $TiO_2$ | 6 | 3.7 | 3.7 |
| | $Al_2O_3$ | 18 | 3.5 | 3.5 |
| | $Si_3N_4$ | 25 | 3.3 | 3.3 |
| | AlN | 200 | 3.1 | 3.1 |

As shown in Table 2, the fluctuation values of the emission currents Ie and the luminance of the electron-emitting devices of the comparative example 2, in which the meanders of the second gaps 8 were small to the same degree of the meanders of the second gaps 8 of the present example, were small to those of the electron-emitting device of the comparative example 1.

Moreover, in the electron-emitting devices in which the heat conductances for second portions 6 are at lest four times as large as that of the first portion 5 among the electron-emitting devices of the present example, the values of the fluctuations of the emission currents Ie and the luminance became singularly small. Moreover, the fluctuation values of the emission current Ie and the luminance of the electron-emitting device using $ZrO_2$ for the second portions 6 of the present example were smaller than those of the electron-emitting devices of the comparative example 2, but they did not have any singular difference.

The vicinity of the second gap 8 of each electron-emitting device was observed with the SEM after the measurement of the emission currents Ie and the luminance. The results of the observation were the same as those of the form described with regard to the embodiment 1 except for the comparative example 2. The electron-emitting device of the comparative example 1 was most large meandered. And the electron-emitting device in which $ZrO_2$ was used for the second portions 6 next large meandered. In any of the other electron-emitting devices, the meanders of the second gaps 8 were effectively fitted in the widths L2 of the first portions 5 as shown in FIG. 1A.

The electron-emitting device of the present invention was found to have little dispersion in emission current and little "fluctuation" to be a good electron-emitting device from the example 1 and the example 2.

Example 3

The present example shows an example of producing the electron-emitting device described with regard to the third embodiment.

The basic configuration of the electron-emitting device of this example is the same as that of FIG. 4. In the following, a manufacturing method of the electron-emitting device of the present example is described with reference to FIGS. 4 and 5.

(Process-a)

First, a photoresist including an aperture corresponding to the pattern of the auxiliary electrodes 2 and 3 was formed on a cleaned quartz substrate 1. Subsequently, Ti having the thickness of 5 nm and Pt having the thickness of 45 nm were deposited in order. Next, the photoresist was dissolved with an organic solvent, and the lift-off of the deposited Pt/Ti films was performed. Then, the auxiliary electrodes 2 and 3 opposed to each other with an interval L1 of 20 μm were formed. In addition, the width W between the auxiliary electrodes 2 and 3 was made to be 500 μm (FIG. 5A).

In addition, in the present example, the quartz substrate 1 corresponds to the first portion 5.

(Process-b)

Successively, organic palladium compound solution was coated on the substrate 1 produced at the process-a by the spin-coating method before performing heat baking processing. In this manner, the electroconductive film 4 which contains Pd as the main element was formed. Next, the patterning of the electroconductive film 4 was performed to form the electroconductive film 4 so as to connect the auxiliary electrodes 2 and 3 with each other (FIG. 5B). The sheet resistance (Rs) of the formed electroconductive film 4 was $1\times10^4$ Ω/□.

(Process-c)

Next, photoresist layer was formed on the substrate 1 produced by the process-b correspondingly to an aperture pattern formed on the second portions 6. In such a manner, five same substrates 1 were prepared.

After that, $Si_3N_4$, AlN, $Al_2O_3$, $TiO_2$ and $ZrO_2$ were deposited on the respective substrates 1 so that the material used for each substrate 1 might differ from each other. $Si_3N_4$ was formed by plasma CVD method, and AlN, $Al_2O_3$, $TiO_2$ and $ZrO_2$ were formed by the sputtering method. At the same time, each material was also deposited on the substrates for the measurements of resistivities and heat conductances. When the resistivity and the heat conductance of each substrate were measured, each measured value was the same as that of the example 1.

Subsequently, the photoresist pattern was dissolved by an organic solvent, and the patterning of the deposited film was performed. Thereby, the substrate 1 on which the second portions 6 provided with an aperture at almost the center between the first auxiliary electrode 2 and the second auxiliary electrode 3 was obtained (FIG. 5C).

In addition, the width L2 of the aperture of the second portions 6 was made to be 5 μm, and the thicknesses of the second portions 6 were made to be 2 μm.

Next, the process-d to process-f were performed similarly in the example 1.

In the following process, electron-emitting devices were formed. Moreover, also in this example the 10 electron-emitting devices were formed on the same substrate by the same manufacturing method similarly to the example 1.

In addition, because the resistivity of each material used for the second portions 6 was $10^8$ Ωm or more also in the present example, no large discharges were generated in the "activation" processing mentioned above.

Successively, the measurements of the emission current Ie and the luminance of each electron-emitting device were performed similarly to example 1. The "dispersion" of the measured emission currents Ie and the measured luminance is shown in the following table 3. Moreover, as the comparative example 3, the same electron-emitting device as the comparative example 1 was produced.

TABLE 3

| | MATERIAL OF SECOND PORTIONS 6 | THERMAL CONDUCTIVITY (W/m · K) | Ie DISPERSION (%) | LUMINANCE DISPERSION (%) |
|---|---|---|---|---|
| COMPARATIVE EXAMPLE 3 | NONE | 1.4 | 8.1 | 8.1 |

TABLE 3-continued

| | MATERIAL OF SECOND PORTIONS 6 | THERMAL CONDUCTIVITY (W/m · K) | Ie DISPERSION (%) | LUMINANCE DISPERSION (%) |
|---|---|---|---|---|
| PRESENT EXAMPLE | $ZrO_2$ | 4 | 7.2 | 7.2 |
| | $TiO_2$ | 6 | 4.6 | 4.6 |
| | $Al_2O_3$ | 18 | 4.4 | 4.4 |
| | $Si_3N_4$ | 25 | 4.5 | 4.5 |
| | AlN | 200 | 4.2 | 4.2 |

As shown in the table 3, the "dispersion" of the emission currents Ie and the luminance of the electron-emitting devices of the present example, namely electron-emitting device including the second portions 6, became smaller in comparison with the conventional electron-emitting device (comparative example 3). Moreover, especially the "dispersion" of the emission currents Ie and the luminance of the devices having the heat conductances at least four times as large as that of the comparative example 3 became smaller.

After the evaluation of the characteristics, the vicinity of the gap 8 of each electron-emitting device was observed with the SEM.

In all of the electron-emitting devices of the comparative example 3, the second gaps 8 large meandered as shown in FIG. 8A. On the other hand, any meander of the second gap 8 of each of the electron-emitting devices of the present example was limited within the width L3 of the aperture formed in the second portions 6 as shown in FIG. 4A.

Moreover, when the "fluctuations" of the electron-emitting devices of the present example were measured similarly to the example 2, good electron emission characteristics having little "fluctuations" could be acquired similarly to ones as shown in the table 2.

Example 4

The present example shows an example of producing the electron-emitting device described with regard to the fifth embodiment.

The basic configuration of the electron-emitting device of the present example is the same as that of FIG. 6B. In the following, a manufacturing method of the electron-emitting device of the present example is described with reference to FIGS. 6A to 6D and 7A to 7F.

(Process-a)

First, cleaned five quartz substrates 1 were prepared. Then, as the materials forming the second portions 6, $Si_3N_4$, AlN, $Al_2O_3$, $TiO_2$ and $ZrO_2$ were deposited on each of the substrates 1 so that the material used for each substrate 1 might differ from each other. $Si_3N_4$ was formed by plasma CVD method, and AlN, $Al_2O_3$, $TiO_2$ and $ZrO_2$ were formed by the sputtering method. At the same time, each material was also deposited on the substrates for the measurements of resistivities and heat conductances. When the resistivity and the heat conductance of each substrate were measured, each measured value was the same as that of the example 1.

After that, silicon oxide ($SiO_2$) was deposited on all of the substrates 1 with the plasma CVD method as the material of constituting the first portions 5. At the same time, $SiO_2$ was also deposited on the substrates for the measurements of resistivities and heat conductances. When the resistivity and the heat conductance of each substrate were measured, each measured value was the same as that of the comparative examples 1 and 2.

Next, the material for forming the second portions 6 was again deposited on the silicon oxides 5. Here, the same material as that constituting the second portions 6 which had been first formed in each substrate 1 was formed on the silicon oxide 5.

Moreover, Ti having the thickness of 5 nm and Pt having the thickness of 45 nm were deposited on the second portions 6 in order as the material constituting the auxiliary electrode 2 (FIG. 7A).

After that, the spin coating of photoresist, and exposure and development of a mask pattern were performed. Then, a layered product composed of the first portion 5 and the second portions 6 putting the first portion 5 between, and the first auxiliary electrode 2 arranged on the layered product were formed by dry etching (FIG. 7B).

Next, after exfoliating the photoresist, the spin coating of photoresist, the exposure of a mask pattern and development were again performed to form the photoresist, in which an aperture was formed, corresponding to the pattern of the second auxiliary electrode 3. Successively, in the aperture, Ti having the thickness of 5 nm and Pt having the thickness of 45 nm were deposited in order. Successively, the lift-off of the photoresist was performed, and the second auxiliary electrode 3 was formed (FIG. 7C).

The widths W of the auxiliary electrode 3 and an auxiliary electrode 2 were set to 500 μm. The film thickness of the first portion 5 was set to 50 nm. The film thickness of the second portion on the substrate 1 side was set to 500 nm between the second portions 6. On the other hand, the film thickness of the second portion 6 on the side distant from the substrate 1 between the second portions 6.

Moreover, the substrate 1 which the second portions 6 were not formed on but only $SiO_2$ layer (first portion) was formed to have the thickness of 580 nm between the surface of the substrate 1 and the first auxiliary electrode 2 was also prepared (comparative example 4). Moreover, the substrate 1 which the first portion 5 was not formed on but only the second portions 6 were formed to have the thickness of 580 nm between the surface of the substrate 1 and the first auxiliary electrode 2 was also prepared (comparative example 4').

The same process as the process-c to the process-f of the example 1 was performed as the following process to form an electron-emitting device. Similarly to the example 1, in the present example, ten electron-emitting devices were formed on each substrate.

Moreover, because the resistivity of each material used for the second portions was 108 Ωm or more in the present example, no large discharges were produced in the "activation" processing mentioned above.

Successively, similarly to examples 1 and 2, the emission current Ie and the luminance of each electron-emitting device were measured. The "dispersion" of the measured emission currents Ie and the measured luminance is shown in the following table 4.

TABLE 4

| | MATERIAL OF SECOND PORTIONS 6 | THERMAL CONDUCTIVITY (W/m · K) | Ie DISPERSION (%) | LUMINANCE DISPERSION (%) |
|---|---|---|---|---|
| COMPARATIVE EXAMPLE 4 | NONE | 1.4 | 8.0 | 8.0 |

TABLE 4-continued

| | MATERIAL OF SECOND PORTIONS 6 | THERMAL CONDUCTIVITY (W/m · K) | Ie DISPERSION (%) | LUMINANCE DISPERSION (%) |
|---|---|---|---|---|
| COMPARATIVE EXAMPLE 4' | $ZrO_2$ | 4 | 7.9 | 7.9 |
| | $TiO_2$ | 6 | 8.1 | 8.1 |
| | $Al_2O_3$ | 18 | 7.9 | 7.9 |
| | $Si_3N_4$ | 25 | 8.0 | 8.0 |
| | AlN | 200 | 8.2 | 8.2 |
| PRESENT EXAMPLE | $ZrO_2$ | 4 | 7.0 | 7.0 |
| | $TiO_2$ | 6 | 4.5 | 4.5 |
| | $Al_2O_3$ | 18 | 4.2 | 4.2 |
| | $Si_3N_4$ | 25 | 4.3 | 4.3 |
| | AlN | 200 | 4.0 | 4.0 |

As shown in the table 4, the "dispersion" of the emission currents Ie and the luminance of the electron-emitting device of the present example became smaller to those of the electron-emitting device of the comparative example 4. Moreover, the emission current Ie of the electron-emitting device of the comparative example 4 was larger than those of the electron-emitting devices of the comparative example 4' between the electron-emitting devices of the comparative examples 4 and 4'. Moreover, not so remarkable difference of the "dispersion" of the electron-emitting devices of the comparative examples 4 and 4' was found between them.

The "dispersion" of the emission current Ie and the luminance of the electron-emitting device using $ZrO_2$ for the second portions 6 was more excellent than those of the electron-emitting devices of the comparative examples, but the effect is not so large. However, with regard to the emission currents Ie, such far big emission currents Ie, up to the degree of the difference of a digit, were able to be obtained in the electron-emitting devices of the present example in comparison with the electron-emitting devices of the comparative example 4'. This is because the electron-emitting devices of the present example used the "activation" processing for the producing process, and because, in the electron-emitting devices of the comparative example 4', no silicon oxide existed directly under the first gaps 7, and sufficient "activation" processing could not be performed.

Moreover, when the heat conductances of the second portions 6 are at least four times as large as the heat conductances of the first portions 5, it is found that there is a remarkable effect in the suppressing of dispersion.

After the characteristic evaluation mentioned above, the vicinity of the second gap 8 of each electron-emitting device was observed with the SEM. In any electron-emitting devices of the comparative examples 4 and 4', the electron-emitting regions (gaps 8) large meandered as shown in FIG. 8A. Moreover, in each electron-emitting device of the comparative example 4', the deposition of the carbon films 21*a* and 21*b* was dispersed, and also the second gap 8 large meandered.

On the other hand, in each electron-emitting device of the present example, the second gap 8 was effectively fitted in the width L2 of the first portion 5 as shown in FIG. 1A except for the example in which $ZrO_2$ was used for the second portions 6. However, in the example in which $ZrO_2$ was used for the second portions 6, there was a portion at which the first gap 7 had a part of protruding from the width L of the first portion 5. However, in the region immediately above the first portion 5, the dispersion of the deposited amount of the carbon films 21*a* and 21*b* was not so large.

Moreover, when the "fluctuations" of the electron-emitting devices of the present example similarly to the example 2, as Table 2 showed, the good electron emission characteristic with little "fluctuations" was acquired.

Example 5

The present example shows an example of forming an electron source by arranging many electron-emitting devices on a substrate in a matrix which electron-emitting devices have been formed by the same manufacturing method as that of the electron-emitting devices produced with regard to the example 1. And the present example is also an example of producing an image display apparatus shown in FIG. 16 using the electron source. In the following, a manufacturing process of the image display apparatus produced in the present example is described.

<Substrate Producing Process>

A silicon oxide film was formed on the glass substrate 71. Photoresist was formed on the silicon oxide film correspondingly to the pattern of the first portion 5. After that, a concave portion equivalent to the pattern of the second portions 6 was formed using the dry etching method. After that, $Si_3N_4$ was deposited by the plasma CVD method as the material of the second portions 6 so that the surfaces of the second portions 6 and the silicon oxide film might become almost even. Subsequently, the photoresist pattern was dissolved by the organic solvent, and the lift-off of the deposited film was performed to obtain the substrate 71 in which the second portions 6 put the first portion 5 between them. In addition, the width L2 of the first portion was set to 5 μm, and the thicknesses of the second portions 6 were set to 2 μm. In addition, in the present example, the first portion 5 was made of silicon oxide.

<Auxiliary Electrode Producing Process>

Figure 18:
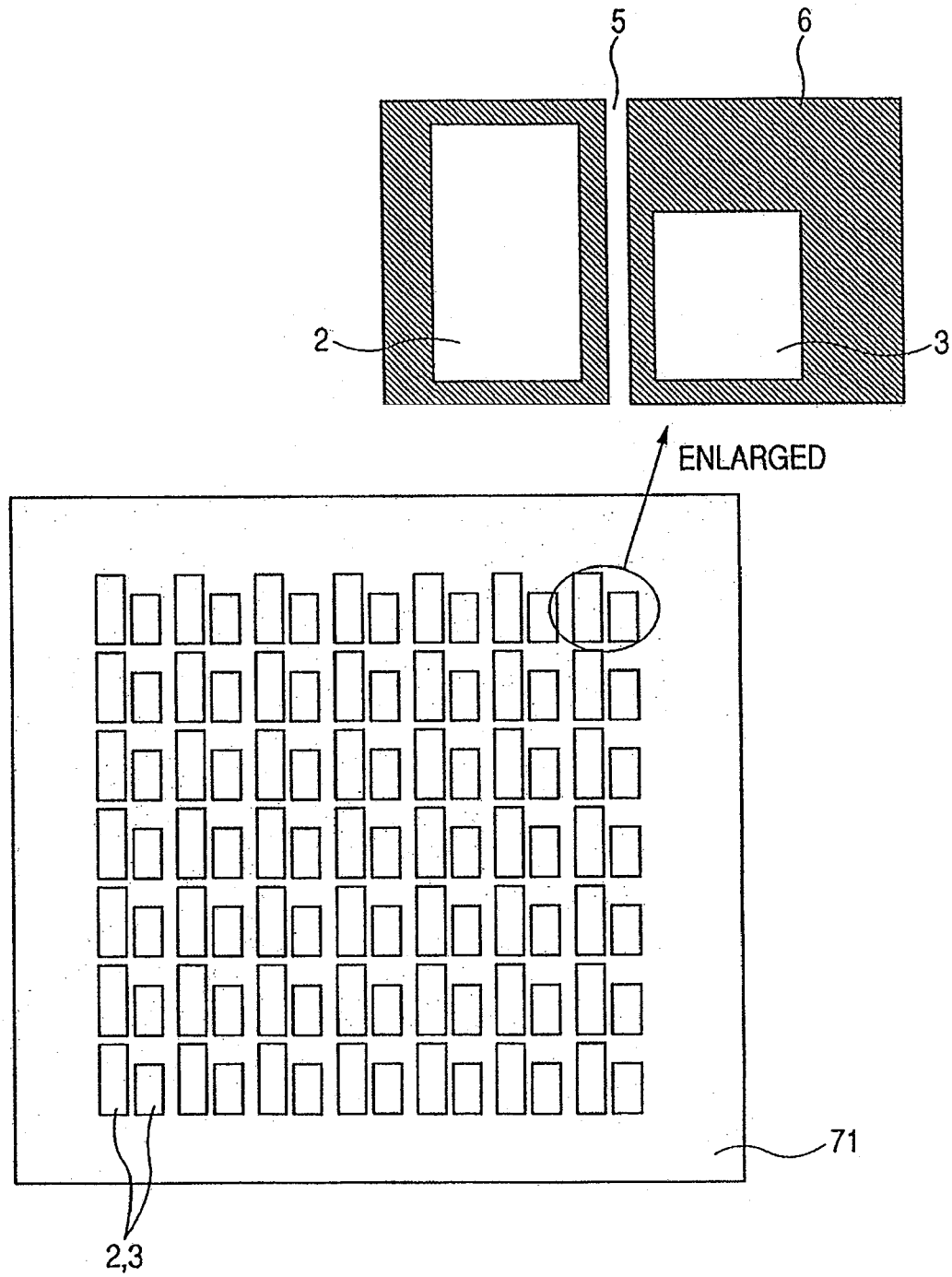
FIG. 18 is a schematic view showing an example of a manufacturing process of an electron source and an image display apparatus according to the present invention.

Next, the auxiliary electrodes 2 and 3 were formed on the substrate 71 (FIG. 18). To put it concretely, after forming a stacked film of titanium Ti and platinum Pt on the substrate 71 by the thickness of 40 nm, the patterning of the stacked film was performed by the photolithographic method to form the auxiliary electrodes 2 and 3. In the present example, the auxiliary electrodes 2 and 3 were arranged so that almost the center of the first portion 5 might be located at the center between the auxiliary electrodes 2 and 3. Moreover, the interval L1 of the auxiliary electrode 2 and the auxiliary electrode 3 was set to 10 μm, and the length W was set to 200 μm.

<Y Direction Wiring Formation Process>

Figure 19:
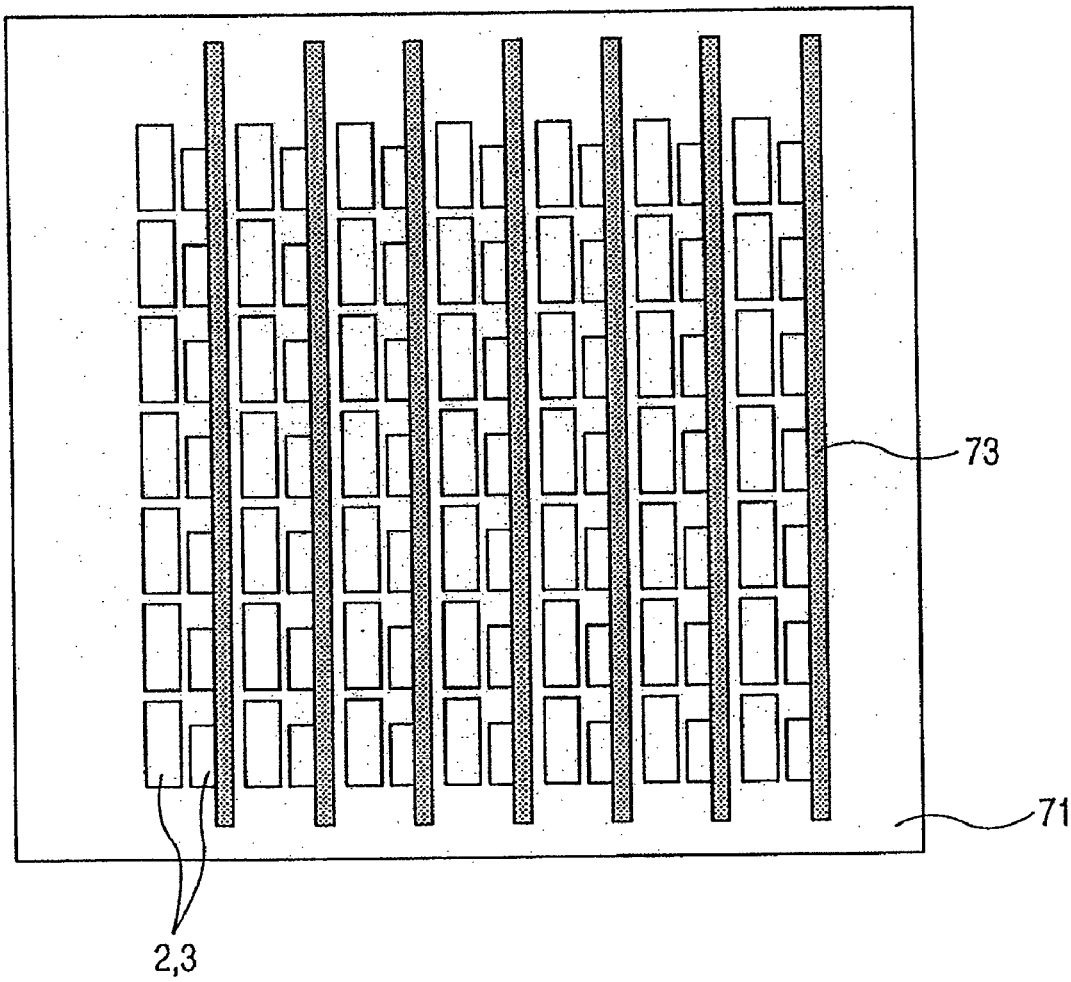
FIG. 19 is a schematic view showing an example of the manufacturing process of the electron source and the image display apparatus according to the present invention.

Next, as shown in FIG. 19, the Y direction wiring 73 including silver as the principal component was formed so as to be connected with the auxiliary electrodes 3. The Y direction wiring 73 functioned as wiring to which a modulating signal was applied.

<Insulating Layer Formation Process>

Figure 20:
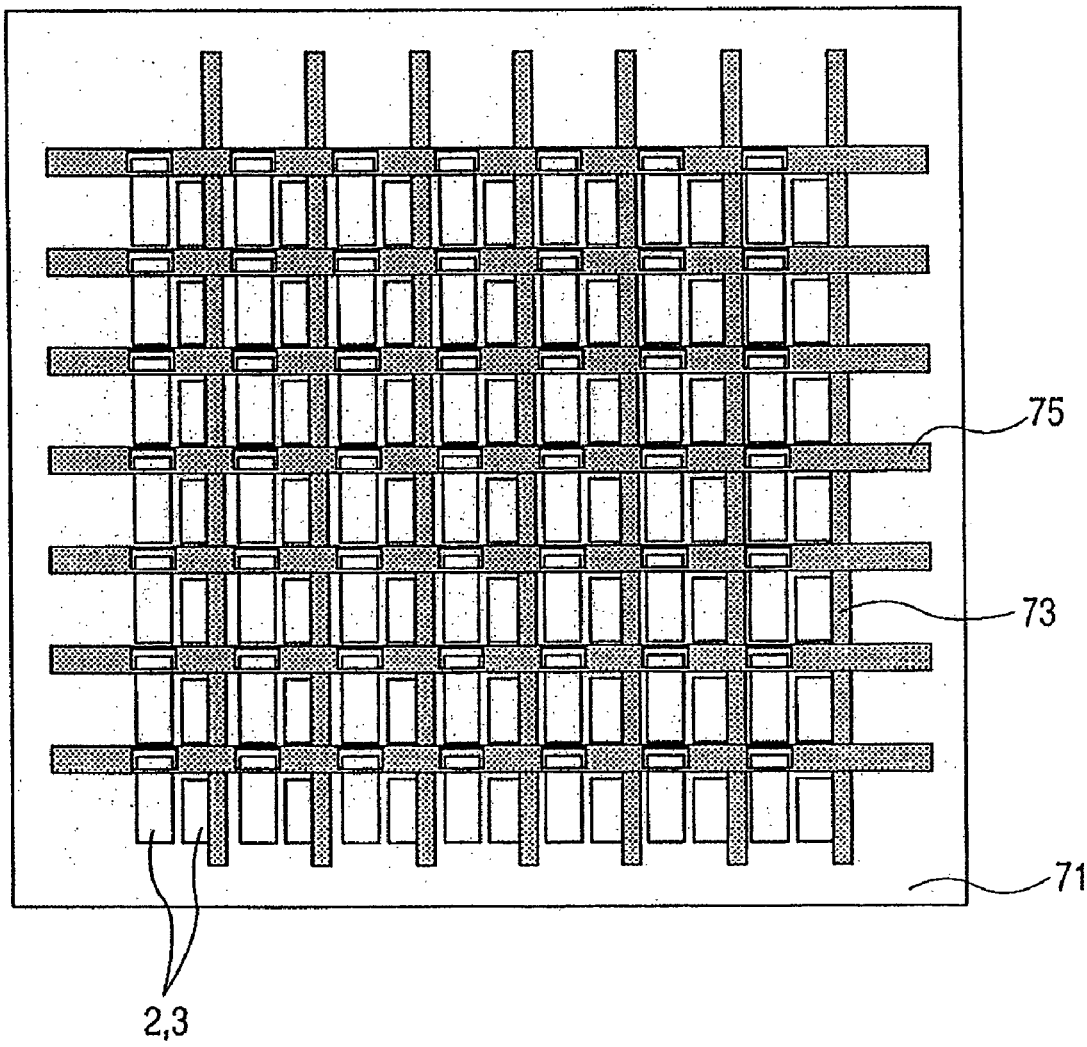
FIG. 20 is a schematic view showing an example of the manufacturing process of the electron source and the image display apparatus according to the present invention.

Next, as shown in FIG. 20, in order to insulate the X direction wiring 72 created at the next process and the Y direction wiring 73, an insulating layer 75, which consisted of silicon oxide, was arranged. The insulating layer 75 was arranged so as to be under the X direction wiring 72, which would be described later, and so as to cover the Y direction wiring 73, which had been formed in advance. A contact hole was opened and formed in a part of the insulating layer 75 so that the electric connection between the X direction wiring 72 and the auxiliary electrode 2 might be possible.

<X Direction Wiring Formation Process>

Figure 21:
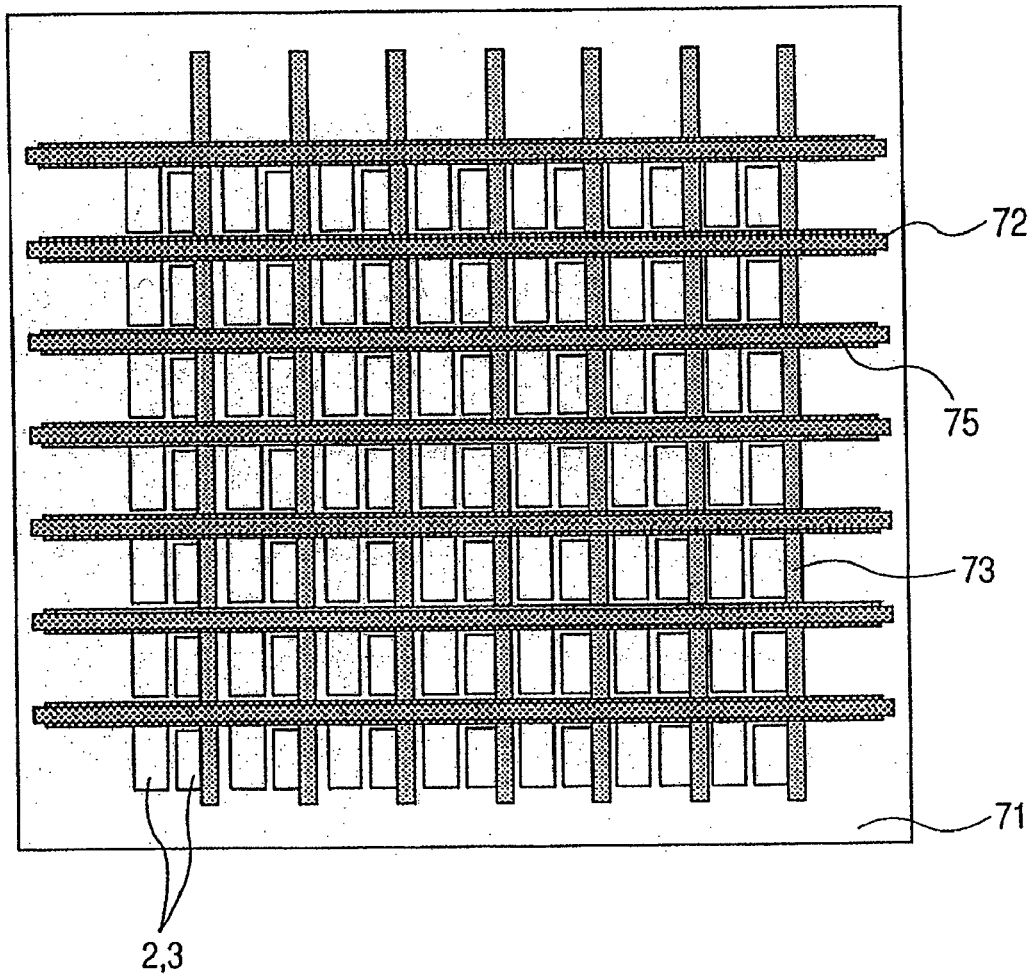
FIG. 21 is a schematic view showing an example of the manufacturing process of the electron source and the image display apparatus according to the present invention.

As shown in FIG. 21, the X direction wiring 72 having silver as its principal component was formed on the insulating layer 75 formed previously. The X direction wiring 72 intersected the Y direction wiring 73 with the insulating layer 75 put between them, and was connected to the auxiliary electrode 2 at the contact hole portion of the insulating layer 75. The X direction wiring 72 functioned as wiring to which a scanning signal was applied. Thus, the substrate 71 which had matrix wiring was formed.

<Electroconductive Film Formation Process>

Figure 22:
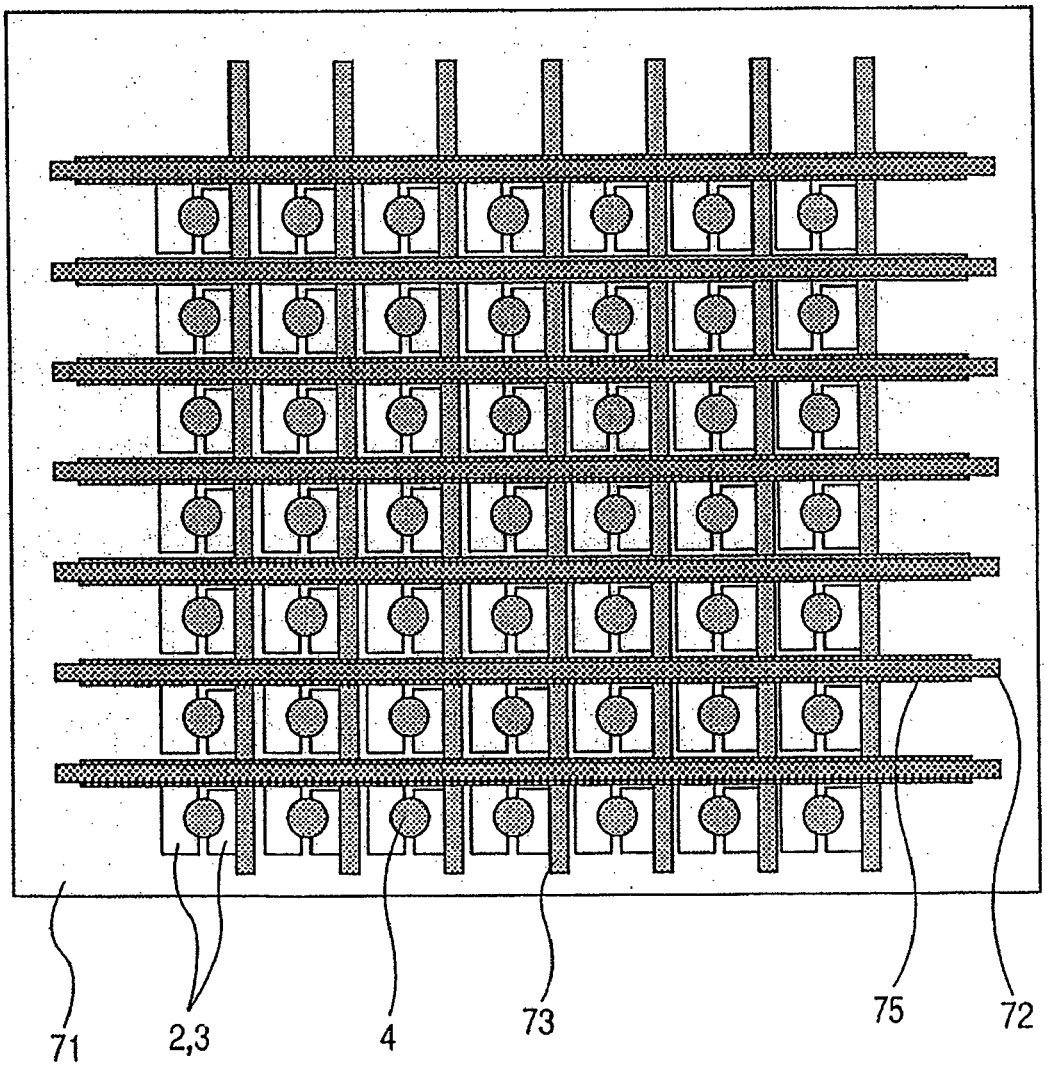
FIG. 22 is a schematic view showing an example of the manufacturing process of the electron source and the image display apparatus according to the present invention.

The electroconductive films 4 were formed between the auxiliary electrodes 2 and the auxiliary electrodes 3 on the substrate 71, on which the matrix wiring was formed, by the ink-jet method (FIG. 22). In the present example, organic palladium complex solution was used as ink used for the ink-jet method. The organic palladium complex solution was given so as to connect between the auxiliary electrodes 2 and the auxiliary electrodes 3. After that, the heat baking processing of the substrate 71 in the air was performed to make the electroconductive films 4 ones made of palladium monoxide (PdO).

<"Energization Forming" Processing and "Activation" Processing>

Next the substrate 71, on which many units composed of the auxiliary electrode 2 and the auxiliary electrode 3, both connected to each other with the electroconductive film 4 by the process mentioned above, were formed, was arranged in the vacuum chamber.

Then, after exhausting the vacuum chamber, the "energization forming" processing and the "activation" processing were performed. In the "energization forming" processing and the "activation" processing, the waveform of the voltage applied to each unit and the like were as having been shown by the manufacturing method of the electron-emitting device of the example 1.

In addition, the "energization forming" processing was performed by the method of applying one pulse to each wire of the X direction wiring 72 selected one by one among a plurality of wires of the X direction wiring 72. That is, the process of "applying one pulse to a wire of the X direction wiring 72 selected among the plurality of wires of the X direction wiring 72 before selecting another wire in the X direction wiring 72 to apply one pulse to the selected wire" was repeated.

By the above process, the substrate 71, on which the electron source of the present example (a plurality of electron-emitting device) was arranged, was formed.

Subsequently, as shown in FIG. 16, the face plate 86 composed of the glass substrate 83, the phosphor film 84 and the metal back 85, the latter two stacked on the inner surface of the former, was arranged at an upper position of the substrate 71 by 2 mm with the supporting frame 82 put between them.

Then, the seal bonding of joining regions of the face plate 86, the supporting frame 82 and the substrate 71 was performed by heating indium (In), which was a low melting point metal, and cooling it. Moreover, because the seal bonding process was performed in the vacuum chamber, seal bonding and sealing were simultaneously performed without using any exhaust pipes.

In the present example, a stripe shape phosphor (see FIG. 17A) was used as the phosphor film 84, which was an image formation member, for performing color display. And first black stripes 91 were arranged with a desired interval between them to form the stripe shape. Successively, each color phosphor 92 was coated between the black stripes 91 by the slurry method to produce the phosphor film 84. A material containing graphite, which was ordinary used frequently, as the principal component was used as the material of the black stripe 91.

Moreover, the metal back 85 made of aluminum was provided on the inner surface side (electron-emitting device side) of the phosphor film 84. The metal back 85 was produced by performing the vacuum evaporation of Al on the inner surface side of the phosphor film 84.

A desired electron-emitting device was selected through the X direction wiring and the Y direction wiring of the image display apparatus completed as above, and a pulse voltage of 14 V was applied to the selected electron-emitting device. At the same time, when a voltage of 10 kV was applied to the metal back 73 through the high voltage terminal Hv, a bright and good image having little luminance shading and little luminance changes could be displayed for a long time.

The embodiments and the examples which have been described above are only examples of the present invention, and the present invention does not exclude various modified examples in each material, each size and the like described above.

This application claims priority from Japanese Patent Application No. 2005-214528 filed Jul. 25, 2005, which is hereby incorporated by reference herein.

What is claimed is:

1. A manufacturing method of an electron-emitting device equipped with an electroconductive film including a gap at a part thereof, comprising the steps of:

preparing a substrate including at least a first insulating portion including silicon oxide and a second insulating portion having a heat conductance higher than said first insulating portion, said second insulating portion arranged abreast of said first insulating portion, wherein said first and said second insulating portions are arranged under an electroconductive film having a resistance lower than those of said first and said second insulating portions;

forming a gap at a part of the electroconductive film directly above said first insulating portion by flowing a current through said electroconductive film;

providing a first electrode and a second electrode separately arranged with the gap between them and respectively connected to the electroconductive film, and locating said second insulating portion directly under at least one of the electrodes so as to comprise a common contact area.

2. A manufacturing method of an electron-emitting device according to claim 1, wherein said second insulating portion is arranged on both sides of said first insulating portion to sandwich said first insulating portion therebetween, wherein said second insulating portion is located directly under both electrodes so as to respectively comprise a common contact area.

3. A manufacturing method of an electron-emitting device according to claim 1, wherein the heat conductance of said second insulating portion is at least four times as large as that of said first insulating portion.

4. A manufacturing method of an electron-emitting device according to claim 1, wherein resistivities of materials constituting said first and said second insulating portions is $10^8$ Ωm or more.

5. A manufacturing method of an electron-emitting device according to claim 1, wherein a sheet resistance of said electroconductive film is within a range of $10^2$ Ω/□ to $10^7$ Ω/□.

6. A manufacturing method of an electron-emitting device according to claim 1, wherein said first insulating portion contains silicon oxide as a main ingredient.

7. A manufacturing method of an electron source including a plurality of electron-emitting devices, comprising a step of:

manufacturing each of said plurality of electron-emitting devices according to claim 1.

8. A manufacturing method of an image display apparatus equipped with an electron source, comprising a step of: providing a light-emitting member emitting light responsive to an irradiation with electrons emitted from said electron source, and providing said electron source by said manufacturing method according to claim 7.

* * * * *